US007122378B1

(12) United States Patent
Akita et al.

(10) Patent No.: US 7,122,378 B1
(45) Date of Patent: Oct. 17, 2006

(54) CARRIERS HAVING BIOLOGICAL SUBSTANCE

(75) Inventors: Takashi Akita, Hiroshima (JP); Chiho Ito, Hiroshima (JP); Teruta Ishimaru, Hiroshima (JP); Haruko Miyauchi, Hiroshima (JP); Kei Murase, Hiroshima (JP); Atsushi Takahashi, Hiroshima (JP); Toshinori Sumi, Hiroshima (JP); Osamu Maehara, Hiroshima (JP); Tadanobu Ikeda, Hiroshima (JP); Nobuko Oogami, Hiroshima (JP); Takayuki Makino, Hiroshima (JP); Fujio Yu, Kanagawa (JP); Fumiaki Watanabe, Kanagawa (JP); Toshitaka Uragaki, Kanagawa (JP); Wataru Fujii, Kanagawa (JP); Takeharu Morishita, Kanagawa (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 09/914,782

(22) PCT Filed: Mar. 6, 2000

(86) PCT No.: PCT/JP00/01353

§ 371 (c)(1),
(2), (4) Date: Sep. 5, 2001

(87) PCT Pub. No.: WO00/53736

PCT Pub. Date: Sep. 14, 2000

(30) Foreign Application Priority Data

| | | |
|---|---|---|
| Mar. 5, 1999 | (JP) | 11/059361 |
| Mar. 26, 1999 | (JP) | 11/083964 |
| Mar. 26, 1999 | (JP) | 11/084100 |
| Mar. 26, 1999 | (JP) | 11/084101 |
| Mar. 31, 1999 | (JP) | 11/093043 |
| Mar. 31, 1999 | (JP) | 11/093044 |
| Jul. 29, 1999 | (JP) | 11/215014 |
| Aug. 26, 1999 | (JP) | 11/240041 |
| Oct. 20, 1999 | (JP) | 11/298613 |
| Nov. 15, 1999 | (JP) | 11/324194 |
| Dec. 6, 1999 | (JP) | 11/346288 |
| Dec. 6, 1999 | (JP) | 11/346309 |
| Dec. 6, 1999 | (JP) | 11/346521 |
| Mar. 1, 2000 | (JP) | 2000/055658 |
| Mar. 2, 2000 | (JP) | 2000/057075 |

(51) Int. Cl.

| | |
|---|---|
| ***G01N 33/00*** | (2006.01) |
| ***C12M 3/00*** | (2006.01) |
| *C07H 21/02* | (2006.01) |
| *C07H 21/04* | (2006.01) |

(52) U.S. Cl. ..... 436/94; 435/6; 435/287.1; 435/287.2; 536/23.1

(58) Field of Classification Search ..... 435/6, 435/287.1, 287.2; 436/94; 536/23.1
See application file for complete search history.

(56) References Cited

U.S. PATENT DOCUMENTS 4,649,111 A 3/1987 Keller et al.
(Continued)

FOREIGN PATENT DOCUMENTS

EP 0 195 860 10/1986
(Continued)

OTHER PUBLICATIONS

Webster's II New Riverside University Dictionary, 1984, p. 78.*
Gennady Yershov, et al., Proc. Natl. Acad. Sci. USA, vol. 93, No. 10, pp. 4913-4918, "DNA Analysis and Diagnostics on Oligonucleotide Microchips", May 1996.
(Continued)

*Primary Examiner*—Bradley L. Sisson
(74) *Attorney, Agent, or Firm*—Oblon, Spivak, McClelland, Maier & Neustadt, P.C.

(57) ABSTRACT

By the present invention, there is provided a fiber having nucleic acid immobilized thereon, an alignment of fibers having nucleic acid immobilized thereon, and a slice thereof.

24 Claims, 9 Drawing Sheets

U.S. PATENT DOCUMENTS

| | | | | |
|---|---|---|---|---|
| 5,486,126 | A | 1/1996 | Cathey et al. | |
| 5,753,227 | A | 5/1998 | Strahilevitz | |
| 5,786,216 | A | 7/1998 | Dionne et al. | |
| 5,843,767 | A | 12/1998 | Beattie | |
| 6,037,186 | A * | 3/2000 | Stimpson | 436/518 |
| 6,071,702 | A | 6/2000 | Yamamoto et al. | |
| 6,129,896 | A | 10/2000 | Noonan et al. | |
| 6,183,970 | B1 | 2/2001 | Okano et al. | |
| 6,846,635 | B1 * | 1/2005 | Anderson et al. | 435/7.1 |

FOREIGN PATENT DOCUMENTS

| | | |
|---|---|---|
| EP | 0 743 084 | 11/1996 |
| EP | 843 019 | 5/1998 |
| EP | 0 846 802 | 6/1998 |
| JP | 63-69509 | 3/1988 |
| JP | 4-46193 | 2/1992 |
| JP | 4-253560 | 9/1992 |
| JP | 6-342 | 1/1994 |
| JP | 8-188967 | 7/1996 |
| JP | 9-111010 | 4/1997 |
| JP | 11-000959 | 1/1999 |
| JP | 11-108928 | 4/1999 |
| JP | 11-342543 | 12/1999 |
| WO | WO 90/05018 | 5/1990 |
| WO | WO 96/17246 | 6/1996 |
| WO | WO 98/50782 | 11/1998 |
| WO | WO 99/03341 | 1/1999 |
| WO | WO 99/07458 | 2/1999 |
| WO | WO 99/13313 | 3/1999 |
| WO | WO 99/19711 | 4/1999 |
| WO | WO 99/55460 | 11/1999 |

OTHER PUBLICATIONS

D. Proudnikov, et al., Anal Biochem, vol. 259, No. 1, pp. 34-41, "Immobilization of DNA in Polyacrylamide Gel for the Manufacture of DNA and DNA-Oligonucleotide Microchips", May 1998.

Patent Abstracts of Japan, JP 6-262043, Sep. 20, 1994.

Patent Abstracts of Japan, JP 59-090605, May 25, 1984.

Patent Abstracts of Japan, JP 63-056611, Mar. 11, 1988.

Y. H. Bae, et al., Journal of Controlled Release, vol. 53, No. 1-3, XP-004121275, pp. 249-258, "Extracellular Matrix for a Rechargeable Cell Delivery System," Apr. 30, 1998.

T. D. Ll, et al., Journal of Membrane Science, vol. 133, No. 2, XP-004092181, pp. 177-187, "Hollow-Fiber Membranes Coated with Polymerizable Bicontinuous Microemulsions," Oct. 1, 1997.

Patent Abstracts of Japan, JP 11-036174, Feb. 9, 1999.

Patent Abstracts of Japan, JP 9-078453, Mar. 25, 1997.

Patent Abstracts of Japan, JP 1-136017, May 29, 1989.

Patent Abstracts of Japan, JP 8-188967, Jul. 23, 1996.

Patent Abstracts of Japan, JP 58-177140, Oct. 17, 1983.

Patent Abstracts of Japan, JP 60-004197, Jan. 10, 1985.

Patent Abstracts of Japan, JP 59-189906, Oct. 27, 1984.

Database EPODOC Online, XP-002193928, KR 8 501 496, Oct. 11, 1985.

J. A. Ferguson, et al., National Biotechnol., vol. 14, No. 13, pp. 1681-1684, "A Fiber-Optic DNA Biosensor Microarray for the Analysis of Gene Expression," 1996.

* cited by examiner

1. DNA-immobilized slice 2. sample 3. electrophoresis tank
4. negative electrode 5. positive electrode 6. direct current
7. filter paper 8. electrolytic tank 1. DNA-immobilized slice 2. sample 3. electrophoresis tank
4. negative electrode 5. positive electrode 6. direct current
7. filter paper

CARRIERS HAVING BIOLOGICAL SUBSTANCE

TECHNICAL FIELD

The present invention relates to a carrier containing a biological substance. More specifically, the present invention relates to fibers comprising a biological substance immobilized thereon, fiber alignments thereof, and slices of the same.

BACKGROUND ART

Recently, genome projects have progressed in respect of various organisms and a large number of genes including human genes, as well as their nucleotide sequences, are rapidly being clarified. The functions of the genes for which sequences have been clarified are being examined with various methods, and as one of these methods, gene expression analysis employing clarified sequence information is known. For example, various methods have been developed, such as Northern hybridization, which employ nucleic acid—nucleic acid hybridization reactions or which employ PCR reaction. These various methods have enabled examination of the relationship between various genes and the organic function expression thereof. However, there is a limit to the number of genes to which these methods can be applied. Therefore, given a complex reaction system constituted by a very large number of genes such as those clarified at an individual level by genome projects, there are difficulties in performing a generalized and systematic gene analysis with the above methods.

Recently, a new analysis method and methodology known as the DNA microarray method (DNA chip method) which allows one-operation expression analysis of numerous genes, has been developed and now attracts attention.

This method does not differ in principle from conventional methods in respect of the fact that it is nucleic acid detection and assay method based on nucleic acid-nucleic acid hybridization. However, a major characteristic of this method is the utilization of a large number of DNA fragments aligned and immobilized at high density on a flat substrate slice called a micro-array or chip. Examples of a specific method of using a micro-array method include for example hybridizing a sample of expression genes of a test subject cell labeled with fluorescent pigment on a flat substrate slice, allowing mutually complimentary nucleic acids (DNA or RNA) to bind with one another and after labeling these locations with fluorescent pigment, and rapidly reading with a high resolution analysis device. In this way, respective gene amounts in a sample can be rapidly estimated. That is, the essence of this new method is understood to be basically a combination of reduction of reaction sample amount and technology to arrange and align these reaction samples into a pattern allowing high volume, rapid, systematic analysis and quantification with good reproducibility.

Regarding techniques for immobilizing a nucleic acid on a substrate, apart from a method of high density immobilization on nylon sheets etc. such as in the above-mentioned Northern method, in order to further increase density, a method where polylysine is coated on a substrate of glass or the like, or a method involving direct solid phase synthesis of short-chain nucleic acids on a substrate of silicon or the like, are being developed.

However, while a spotting method of immobilization of nucleic acid on a substrate of glass or the like having an immobilization surface that is chemically or physically modified (Science 270, 467–470 (1995)) is superior to a sheet method in terms of spot density, it has been pointed out that in comparison to a direct synthesis method (U.S. Pat. No. 5,445,934, U.S. Pat. No. 5,774,305), spot density and amount of immobilized nucleic acid per spot are low and the method is inferior in terms of reproducibility. Alternatively, while a method involving solid phase synthesis of multiple short chain nucleic acids onto a silicon substrate in a regular manner using photolithography is superior in the number of types of nucleic acid able to be synthesized per unit of area (spot density), the amount immobilized per spot (synthesized amount), and reproducibility, the types of nucleic acid able to be immobilized are limited to relatively short-chained nucleic acids that are controllable with lithography. Further, it is difficult to effect a substantial reduction in cost per chip with this method due to the use of expensive manufacturing devices and multiple manufacturing steps. Also known as a method for solid phase synthesis of nucleic acid on a miniature carrier and library conversion thereof, is a method employing miniature beads. It is thought that this method enables synthesis of long chain nucleic acids with more types and at lower cost than a chip method, and also allows immobilization of longer nucleic acids such as cDNA, etc. However, differing from a chip method, it is difficult to produce a product such that specific compounds are arranged with good reproducibility according to a specific alignment standard.

Furthermore, when gene analysis is carried out using a currently available micro-array, it takes long time to perform hybridization and post-hybridization washing treatments.

An attempt to immobilize probe nucleic acid in a gel and detect hybridization with nucleic acid in a sample has been made (Japanese Patent Application Laying-Open (kokai) No. 3-47097, WO98/51823).

Examples of known methods involving the immobilization of nucleic acid in a gel include: a method involving the immobilization of aminated DNA in a copolymer gel having hydroxysuccinimide as a leaving group (*Polym. Gel. Netw.,* 4, (2), 111 (1996)); a method involving the binding of aminated DNA to a polyacrylamide gel into which an aldehyde group is introduced (*Nucleic Acid Res.,* 24, 3142 (1996)); a method involving the binding of aminated DNA to a polyacrylamide gel into which a mesyl group is introduced (ibid.); and a method involving the binding of aldehydated polyacrylamide to polyacrylamide into which a hydrazide group is introduced (*Proc. Natl. Acad. Sci.,* 93, 4913 (1996)), etc.

Furthermore, methods involving filling a hollow fiber with gel is also being attempted. Examples of such methods include a method regarding the production of a capillary for electrophoresis described in Japanese Patent Application Laying-Open (kokai) No. 11-211694. In this method, a gel is formed in a hollow part during capillary spinning, thereby obtaining a capillary.

However, it is very likely that gel to be filled is easily removed from a hollow fiber due to polymerization shrinkage generally occurring during polymerization, and that the gel easily falls out of the hollow fiber. Accordingly, it was difficult to use a hollow fiber filled with gel for capillary electrophoresis or for a micro-array for DNA analysis. In general, gel existing in a micro-array is transparent, and so it was not easy to confirm the presence of gel at each site. Therefore, in respect of operability and practicality, a superior method was desired.

DISCLOSURE OF THE INVENTION

Under such circumstances, the establishment of a new systematic methodology applicable to low cost mass manufacturing, enabling immobilization of nucleic acid at specific concentration irrespective of chain length and enabling alignment in measurable form, with high density and good reproducibility, is strongly sought for gene analysis, which is considered to be a field that will grow in importance in the future. This is the problem which the present invention seeks to solve.

Specifically, the problem sought to be solved by the present invention is to establish a method of producing an alignment, i.e. that is, a two dimensional (planar) alignment having nucleic acids immobilized thereon, which in comparison to methods for producing alignments of nucleic acid involving micro-spotting or micro-injection on two-dimensional substrates such as nylon sheets and glass substrate, has a high amount of immobilized nucleic acid, allows high densification of nucleic acid types arranged per unit of area, and is suitable for application of mass production. A further problem which the present invention seeks to solve is establishment of a production method for a two dimensional alignment of immobilized nucleic acids, applicable to long chain nucleic acids including cDNA, and having lower production cost than methods of producing a high-density oligonucleotide alignment by a combination of photolithography onto a silicon substrate and solid phase synthesis.

As a result of thorough studies by some of the present inventors directed toward the above objects, they first amended the concept of conventional methods that a biological substance arrangement process and an immobilization process are to be carried out on an identical two-dimensional carrier, and then they found that the slice of a two-dimensional high density alignment comprising biological substance-immobilized fibers can be produced by a process which comprises performing the biological substance immobilization process on a fiber (on a single fiber) as a one-dimensional structure, making a three-dimensional structure wherein a plurality of biological substance immobilized-fibers are arranged in an orderly manner, and cutting the three-dimensional fiber alignment into slices.

In this method, the effective systematic and high-density arrangement of biological substance-immobilized fibers is a further important object to be achieved, and the achievement of this object would be most beneficial to industrial production. Thus, the present inventors have found that a two-dimensional high density alignment comprising biological substance-immobilized fibers can be produced by using high precision sequencing technique with jigs.

Moreover, through intensive studies directed toward the above objects, the present inventors have found that, before filling the hollow part of a hollow fiber with gel, pretreatment (inner wall treatment) is carried out by adhering and polymerizing a gel-forming monomer solution on the inner wall of the fiber, thereby preventing removal of gel to be then filled.

Furthermore, the present inventors have also found that the filling, deformation and removal states etc. of gel during gel production and hybridization can easily be detected with a fluorescence microscope, by immobilizing a pigment, e.g., a fluorescent pigment, on the gel.

That is to say, the present invention relates to the following features.

(1) The present invention is a hollow fiber incorporating an immobilized biological substance, a porous fiber incorporating an immobilized biological substance, or a porous hollow fiber incorporating an immobilized biological substance, wherein the biological substance is directly immobilized on and/or in the fiber. Moreover, the present invention is a fiber retaining a gel which incorporates an immobilized biological substance whereby the biological substance is immobilized on and/or in the fiber.

Examples of a fiber retaining a gel include a solid fiber, a hollow fiber, a porous fiber and a porous hollow fiber. In such cases, the gel incorporating an immobilized biological substance is retained on a surface the solid fiber, in the hollow part of the hollow fiber, or in the pore(s) of the fiber.

Examples of a biological substance include any one selected from a group consisting of the following substances (a) to (c):

(a) nucleic acid, amino acid, sugar or lipid;

(b) a polymer consisting of one or more kinds of ingredients from the substances stated in (a) above; and (c) a substance interacting with substances stated in (a) or (b) above, but nucleic acid is preferable.

The above-stated fiber retaining a biological substance-immobilized gel also includes a fiber which also having a pigment retained on and/or in the fiber by means of the gel.

(2) Moreover, the present invention is a fiber alignment having a bundle of the fibers stated above. Examples of the fiber alignment include a fiber alignment wherein each fiber is regularly arranged and a fiber alignment wherein the bundle of the fibers comprises 100 or more fibers per cross-sectional $cm^2$. In this case, the type of biological substance on each fiber may be different in respect of some or all of fibers.

(3) Furthermore, the present invention is a slice of the fiber alignment which intersects the fiber axis of the above fiber alignment. The slice may comprise fiber units and coordinates reference points therefor (e.g. two or more marker fiber units in the slice). The slice may comprise marker fiber units which are stained. In this invention, a slice comprising the coordinates for a fiber unit determined based on the coordinate reference points is also included in the slice of the present invention.

(4) Still further, the present invention is a method for producing the above slice having coordinates for each fiber unit thereof, the method comprising the steps of:

(a) cutting sequentially a fiber alignment obtained by binding and immobilizing fibers, to obtain a series of fiber alignment slices S(1), S(2), . . . S(h), . . . S(m);

(b) selecting any given slice S(h) from m number of slices and determining two-dimensional coordinates for each fiber unit contained in said slice S(h) based on the coordinate reference pointss in said slice S(h);

(c) determining the two-dimensional coordinates of each fiber unit contained in slice S(i) located close to said slice S(h) based on the coordinate data of slice S(h) obtained in step (b) and the coordinate reference points in said slice S(i); and (d) repeating steps (b) and (c) to determine the two-dimensional coordinates of each fiber unit in said fiber alignment slice.

(5) Furthermore, the present invention is a method for determining the position of each fiber unit in the above slice, the method comprising the steps of:

(a) cutting sequentially a fiber alignment obtained by binding and immobilizing fibers, to obtain a series of fiber alignment slices S(1), S(2), . . . S(h), S(m);

(b) selecting any given slice S(h) from m number of slices and determining two-dimensional coordinates for each fiber unit contained in said slice S(h) based on the coordinate reference pointss in said slice S(h);

(c) determining the two-dimensional coordinates of each fiber unit contained in slice S(i) located close to said slice S(h) based on the coordinate data of slice S(h) obtained in step (b) and the coordinate reference points in said slice S(i); and (d) repeating steps (b) and (c) to determine the two-dimensional coordinates of each fiber unit in said fiber alignment slice.

(6) Furthermore, the present invention is a computer-readable recording medium on which the coordinate data of each fiber unit in the above slice is recorded.

(7) Moreover, the present invention is a set for sample detection, comprising the above slices and the above recording medium.

(8) Furthermore, the present invention is a method for producing the above slice, which comprises: binding a plurality of hollow fibers to make an alignment; introducing a biological substance into the inner wall and/or hollow part(s) of each hollow fiber constituting said alignment and immobilizing the substance therein; and slicing the said alignment in a direction intersecting with the fiber axis. In this method, the immobilization of a biological substance in the inner wall and/or hollow part(s) of each hollow fiber constituting an alignment is carried out, for example, by immersing the extended tip of each hollow fiber constituting the alignment into a solution containing a biological substance, and introducing the solution into the hollow part of each hollow fiber constituting the alignment.

(9) Still further, the present invention is a method for producing the above slice, which comprises: binding a plurality of porous hollow fibers to make an alignment; introducing a biological substance into the inner wall, hollow and/or porous part(s) of each porous hollow fiber constituting said alignment and immobilizing the substance therein; and slicing the said alignment in a direction intersecting with the fiber axis. In this method, the immobilization of a biological substance in the inner wall, hollow and/or porous part(s) of each porous hollow fiber constituting an alignment is carried out, for example, by immersing the extended tip of each porous hollow fiber constituting the alignment into a solution containing a biological substance, and introducing the solution into the hollow and/or porous part(s) of each porous hollow fiber constituting the alignment.

(10) Moreover, the present invention is a method for producing a fiber alignment, which comprises applying tension to a fiber bundle arranged in accordance with a sequence pattern of interest, and immobilizing said fiber bundle by filling resin among fibers of said fiber bundle to make a fiber alignment. In this production method, the sequence of a fiber bundle is formed by the steps of:

(a) passing fibers through a plurality of jigs having pores of the same pattern as a sequence pattern of interest; and (b) widening the intervals between said jigs.

In addition, examples of the jigs include support lines constituting networks obtained by longitudinal and transverse lines, or a perforated board.

(11) Furthermore, the present invention is a method for treating the inner wall part of a hollow fiber, which comprises applying a gel forming monomer (a) solution on the inner wall of a hollow fiber, and then forming gel on the inner wall of the hollow fiber by polymerization of the monomers. The inner wall is preferably porous. Examples of monomer (a) include an amphipathic monomer.

(12) Still further, the present invention is method for filling the hollow part of a hollow fiber with gel, which comprises filling a gel forming monomer (b) solution in the hollow part of a hollow fiber treated by any one of the methods according to claims 31 to 33, and forming gel in the hollow part by polymerization of said monomers, and also a method for producing the thus gel-filled fiber. Examples of monomer (b) is one having acrylamide as a main ingredient.

(13) Moreover, the present invention is a polymer gel incorporating immobilized nucleic acid, wherein modified nucleic acid is bound and immobilized thereon by means of a glycidyl group. Examples of the modified nucleic acid include one whose terminus is aminated. Examples of the polymer gel include a copolymer gel consisting of glycidyl (meta)acrylate, a polymerized monomer (e.g. acrylamide) and a cross-linker.

(14) Furthermore, the present invention is a method for producing the above polymer gel, which comprises reacting glycidyl(meta)acrylate with a modified nucleic acid, and then adding a polymerized monomer and a cross-linker to the obtained reaction product to polymerize them, or a method for producing the above polymer gel, which comprises reacting modified nucleic acid with a copolymer gel consisting of glycidyl(meta)acrylate, a polymerized monomer and a cross-linker. Examples of the modified nucleic acid include one whose terminus is aminated, and examples of the polymerized monomer include acrylamide.

(15) Still further, the present invention is a polymer gel comprising a nucleic acid ingredient, a polyvalent amine ingredient and at least two or more polymerized monomer ingredients. In this invention, at least one polymerized monomer ingredient is preferably a polymerized monomer having a glycidyl group such as glycidyl(meta)acrylate. An example of a nucleic acid ingredient is a nucleic acid having an aminated terminus.

(16) Moreover, the present invention is a method for producing the above polymer gel, which comprises polymerizing a solution comprising a nucleic acid ingredient, a polyvalent amine ingredient and at least two or more polymerized monomer ingredients, or a method for producing the above polymer gel, which comprises polymerizing a solution comprising a nucleic acid ingredient and at least two or more polymerized monomer ingredients, and cross-linking the obtained polymer with a polyvalent amine ingredient.

(17) Furthermore, the present invention is a method for detecting a sample which comprises using the above slice, the slice having as a probe a biological substance (e.g. nucleic acid) attached to a carrier, wherein said method comprises bringing the sample into contact with said slice by a method other than natural diffusion to form a hybrid, and removing from said slice samples which do not bind to the biological substance probe. Examples of the method other than natural diffusion include the sample is brought into contact with the slice by applying a voltage across said slice, and a water-absorbing substance is located on one side of said slice thereby bringing a sample located on the opposite side into contact with the slice, etc. In the above detection method, the sample is preferably labeled by fluorescence.

Examples of the carrier include a soluble polymer gel (e.g. gel having polyacrylamide as a main ingredient), and the carrier is retained in the hollow part of a hollow fiber.

This description includes the contents as disclosed in the descriptions and/or drawings of Japanese Patent Application Nos. 11-59361, 11-84100, 11-84101, 11-83964, 11-93043, 11-93044, 11-215014, 11-240041, 11-298613, 11-324194, 11-346288, 11-346309, 11-346521, 2000-55658 and 2000-57075, which are priority documents of the present application.

The present invention is described in detail below.

The present invention relates to a novel microarray. According to this invention, biological substance-immobilized fibers or fibers which carry a biological substance-immobilized gel on a surface, the hollow part or in the porous part thereof, and an alignment thereof are produced, and then a slice is obtained by cutting the alignment along a direction intersecting the fiber axis of the alignment. This slice is a nucleic acid-immobilized two-dimensional high-density alignment, i.e., a microarray.

1. Biological Substance

In the present invention, examples of target biological substances directly immobilized on a solid, hollow or porous hollow fiber, and target biological substances immobilized on a gel include nucleic acid such as deoxyribonucleic acid (DNA), ribonucleic acid (RNA) and peptide nucleic acid (PNA), amino acid, protein, sugar (e.g. polysaccharide) and lipid etc.

(1) Nucleic Acid

Where nucleic acid is used as a biological substance, any chain length is applied. The nucleic acid may be a commercially available one or may be obtained from viable cells. The preparation of DNA or RNA from viable cells can be carried out by known methods; for example, the extraction of DNA is carried out by the method of Blin et al. (Blin et al., *Nucleic Acid Res.* 3: 2303 (1976)) etc., and the extraction of RNA is carried out by the method of Favaloro et al. (Favaloro et al., *Methods Enzymol.* 65:718 (1980)) etc. Furthermore, as nucleic acid to be immobilized, there are also used linear or circular plasmid DNA, chromosomal DNA, DNA fragments obtained by cleaving these DNA molecules with restriction enzymes or chemically, DNA molecules synthesized with enzymes and the like in a test tube, and chemically synthesized oligonucleotides, etc.

In the present invention, nucleic acid may directly be immobilized to a hollow fiber, or derivatives obtained by chemically modifying nucleic acid or nucleic acid denatured as necessary, may also be immobilized.

Examples of known chemical modification of nucleic acids include amination, biotination and conversion into digoxygenin etc. (*Current Protocols In Molecular Biology*, Ed., Frederick M. Ausubel et al. (1990); *Experimental Protocol without using Isotope* (*Datsu Isotope Jikken Protocol*) (1) DIG Hybridization (Syujyun-sha)), and these modification methods can be applied in the present invention. By way of example, the introduction of an amino acid group into nucleic acid is described below.

The binding position of an aliphatic hydrocarbon chain having an amino group and a single-stranded nucleic acid is not particularly limited, and it may not be only the 5'- or 3'-terminal end of nucleic acid, but also be in the chain of nucleic acid (e.g. a phosphate diester binding site or nucleotide binding site). The derivatives of this single-stranded nucleic acid can be prepared according to the methods described in Japanese Patent Examined Publication (kokoku) No. 3-74239, U.S. Pat. Nos. 4,667,025 and 4,789,737 etc. Moreover, other than the above methods, the derivatives can be prepared, for example, using a commercially available reagent for introducing an amino acid group (e.g. Aminolink II (Trademark), PE Biosystems Japan; Amino Modifiers (Trademark), Clontech), or according to the publicly known method which introduces an aliphatic hydrocarbon chain having an amino acid group to the 5'-terminal phosphate of DNA (*Nucleic Acids Res.,* 11(18), 6513- (1983)).

(2) Amino Acid

The term "amino acid targeted to be immobilized on a fiber" in the present invention is used to mean any amino acid constituting protein, polypeptide or peptide. The length of amino acid is not particularly limited, and any given one can be arbitrarily selected. Examples of such an amino acid include a peptide comprising 2 to 10 amino acids, and polypeptide or protein comprising 11 or more amino acids.

These substances can be obtained by common peptide synthesis and the like. Examples of the methods include azide method, acid chloride method, acid anhydride method, mixed acid anhydride method, DCC method, active ester method, carbo-imidazole method, oxidation-reduction method and enzyme synthesis method etc. As a synthesis method, either a solid phase synthesis method or a liquid phase synthesis method can be applied.

With respect to condensation and the removal of a protecting group, any known means may be applied (e.g. Bodanszky, M and M. A. Ondetti, *Peptide Synthesis*, Interscience Publishers, New York (1966); Schroeder and Luebke, *The Peptide*, Academic Press, New York (1965); Nobuo Izumiya et al., *Base and Experiment of Peptide Synthesis* (*Peptide Gosei no Kiso to Jikken*, Maruzen (1975), etc.)

After reaction, a peptide of interest can be purified by using, in combination, common purification methods such as solvent extraction, distillation, column chromatography, liquid chromatography and recrystallization. Moreover, it can also be obtained by extracting and purifying from organisms.

(3) Lipid

The term "lipid" in the present invention is used to mean a substance, which has long chain fatty acid or a similar hydrocarbon chain in a molecule thereof, and exists in or derives from an organism, and examples of the lipid include neutral lipid, lipoprotein, phospholipid and glycolipid etc. Examples of a neutral lipid include fatty acid, wax, acylglycerol, sterol, dolichol and bile acid etc. Examples of a lipoprotein include chylomicron, VLDL, IDL, LDL and HDL etc. Examples of a phospholipid include diacyl-form glycerophospholipid (phosphatidyl choline, phosphatidylethanolamine, phosphatidylserine etc.), ether-form glycerophospholipid, sphingomyelin and phosphonolipid etc. Examples of a glycolipid include neutral glycolipid (ceramide monohexoside, ceramide dihexoside etc.) and acidic glycolipid (ganglioside, sulfatide etc.)

These lipids can be extracted from tissues or cells by using, singly or in combination as appropriate, high performance liquid chromatography, gas chromatography and thin-layer chromatography etc. Moreover, commercially available products can also be used, and synthesis by enzyme reaction can also be performed.

(4) Sugar

Examples of types of sugars herein include monosaccharide existing as a simple substance, oligosaccharide comprising several (2 to 10) monosaccharides condensed, and polysaccharide comprising further more monosaccharides. Glycoprotein is also included therein.

Specific examples of the above sugar include proteoglycan, glycosaminoglycan and glycoprotein such as γ-glutamyltranspeptidase, mucin and glycophorin.

Sugar can be prepared by using singly or in combination as appropriate, affinity chromatography with a lectin column, CsCl sedimentation equilibrium centrifugation, zone speed sedimentation centrifugation, liquid chromatography, hydrophobic column chromatography and immunoprecipitation method etc. And commercial products can also be used.

(5) Polymer

Biological substances used in the present invention also include polymers obtained by combining and polymerizing one or more kinds of the substances of (1) to (4) above. Examples of such polymers include homopolypeptide consisting of one kind of amino acid and copolymer (amino acid copolymer) having a repetition structure of a certain sequence, etc. To obtain these polymers, there are applied a method of polymerizing the same kinds of nucleic acids or peptides and a method of polymerizing different kinds of nucleic acids or peptides, etc.

(6) Interacting Substance

In the present invention, a substance interacting with the substances of (1) to (5) above can be used. The term "interaction" herein is used to mean an action to form a complex by binding or associating a substance with another particular substance. Examples of such an interaction include a reaction between an antigen and an antibody, a reaction between nucleic acid and antisense nucleic acid, and a reaction between biotin and streptoavidin, etc. Thus, either one or a pair of the above interacting substances is immobilized on a fiber.

2. Fiber (1) Type of Fiber

Fibers used for immobilization of a biological substance in the present invention include a solid fiber, a hollow fiber, a porous fiber and a porous hollow fiber etc. As these fibers, any one of a synthetic fiber, a semisynthetic fiber, a regenerated fiber and a natural fiber can be used.

Representative examples of synthetic fibers include: various polyamide-base fibers such as nylon 6, nylon 66 and aromatic polyamide; various polyester-base fibers such as polyethylene terephthalate, polybutylene terephthalate, polylactate and polyglycolic acid; various acryl-base fibers such as polyacrylonitrile; various polyolefin-base fibers such as polyethylene and polypropylene; various polyvinyl alcohol-base fibers; various polyvinylidene chloride-base fibers; polyvinyl chloride-base fiber; various polyurethane-base fibers; phenol-base fibers; fluorine-base fibers such as polyvinylidene fluoride and polytetrafluoroethylene; and various polyalkylene paraoxy benzoate-base fibers, etc.

Representative examples of semisynthetic fibers include various cellulose derivative-base fibers having, as crude materials, diacetate, triacetate, chitin and chitosan etc. and various protein-base fibers which is called promix.

Representative examples of regenerated fibers include various cellulose-base regenerated fibers (rayon, cupra, polynosic etc.) obtained by viscose process, cuprammonium process or organic solvent method.

Representative examples of natural fibers include plant fibers such as cotton, linen, ramie and jute; animal fibers such as wool and silk; and mineral fibers such as asbestos. These plant fibers can be used in the present invention because the fibers show a hollow fiber form.

Representative examples of inorganic fibers include a glass fiber and a carbon fiber etc.

Hollow fibers other than natural fibers can be produced by known methods, using a particular nozzle. For polyamide, polyester and polyolefin etc., a melt spinning process is preferably applied, and as a nozzle, a horseshoe nozzle, a C-form nozzle and a double pipe nozzle etc. can be used. In the present invention, it is preferable to use the double pipe nozzle, since it can form a series of homogenous hollow parts.

For the spinning of synthetic polymers to which melt-spinning can not be applied and polymers used for semi-synthetic or regenerated fibers, a solvent spinning process is preferably applied. In this case also, hollow fibers having a series of hollow parts can be obtained by spinning while filling into the hollow parts with a liquid appropriate as a core, using a double pipe nozzle just as in the case of a melt spinning process.

(2) Form of Fiber

The form of the fiber targeted for use in the present invention is not particularly limited, and so the present fiber includes any one of a solid fiber, a hollow fiber, a porous fiber and a porous hollow fiber. The term "solid" is herein used to mean a form where the inside of a fiber is not hollow, but a fiber is filled with fiber-constituting ingredients, the term "hollow" is herein used to mean a form where the inside of a fiber is sinuous, and tubular or straw-like, and the term "porous" is herein used to mean an unlimited number of voids (pores) exist on a fiber. The form of a section may not be only circular, but also deformed such as flat and hollow sections. The form is preferably hollow and porous particularly in terms of strong immobilization of gel.

The fiber used in the present invention may be either a monofilament or multifilament. Also, it may be spun yarn obtained by spinning staples. Where multifilament and fibers of spun yarns are used, voids between staples and the like can be used to immobilize a biological substance.

The fiber used in the present invention may be used in an untreated state, but as necessary, the fiber may be one into which a reactive functional group is introduced, or it may also be one to which plasma treatment and irradiation treatment such as γ radiation and electron beam are given.

Furthermore, fibers other than clothing fibers, i.e., optical fibers comprising a transparent amorphous polymer as a main ingredient, such as polymethylmethacrylate and polystyrene may also be used.

Where a porous fiber is used in the present invention, the porous fiber can be obtained by using known poration techniques such as a drawing process, a micro-phase separation process and an extraction process in combination with a melt spinning process or solution spinning process.

The porosity of a porous fiber of the present invention is not particularly limited, but from the viewpoint of the enhancement of density of biological substances immobilized per unit length of a fiber, high porosity is desired to increase the specific surface area thereof. The porosity of a porous fiber material is not particularly limited, but from the viewpoint of the enhancement of density of biological substances immobilized per unit length of a fiber material, high porosity is desired in order to increase the specific surface area, within a range such that the strength of fiber is not damaged. For example, a porous fiber with porosity of 20 to 80% is preferable, and a porous fiber with porosity of 30 to 60% is more preferable.

The pore size of the porous fiber used in the present invention is not particularly limited, as long as it enables immobilization of a biological substance and performance of subsequent hybridization. However, from the viewpoint of the enhancement of density of biological substances immobilized per unit length of a fiber, smaller size is desired.

As a porous fiber material, the following are used: a commercially available porous hollow fiber membrane directed to precision filtration and ultrafiltration, a reverse osmosis membrane obtained by coating a nonporous homogenous membrane on the external surface of a porous hollow fiber membrane, a gas separation membrane and a membrane obtained by sandwiching a nonporous homogenous layer between porous layers etc.

The structure of the porous hollow fiber used in the present invention is not particularly limited as long as it enables to fill biological substance-immobilized gel, and there can preferably be applied a three-dimensional network structure which has pores continuously communicating from the external surface of a porous hollow fiber to the internal surface, a structure which has continuously communicating pores constituted by fibril-like elements, a finger-shaped structure, an independent foam structure, and a foam structure having a communicating unit, and for the three-dimensional network structure, a structure constituted by fibril-like elements is preferable. The dimension of a pore to be used is around 0.01 μm to several tens of μm, and the pore size may be uniform from one surface of a porous layer to another surface, or the porous structure may be one which has a symmetric/asymmetric tilt structure having differing pore sizes towards the direction of thickness of a porous layer. Furthermore, in order to strongly retain a biological substance-immobilized gel, a higher hole rate and a larger specific surface area of the porous structure are preferable, as long as it is within a range that does not damage the management of a porous hollow fiber.

Accordingly, there can be applied a commercially available porous hollow fiber membrane directed to precision filtration and ultrafiltration, a reverse osmosis membrane obtained by coating the external surface of a porous hollow fiber membrane with a nonporous homogenous membrane, a gas separation membrane and a membrane obtained by sandwiching a nonporous homogenous layer between porous layers etc.

3. Immobilization of a Biological Substance on a Fiber

The present invention provides (i) a fiber incorporating an immobilized biological substance, wherein the biological substance is immobilized on and/or in the fiber (hereinafter, referred to as "a biological substance-immobilized fiber" at times) and (ii) a fiber retaining a gel which incorporates an immobilized biological substance whereby the biological substance is immobilized on and/or in the fiber (hereinafter, referred to as "a fiber retaining a biological substance-immobilized gel" at times). The target fibers include a hollow fiber, a porous hollow fiber and a porous fiber in respect of (i) above, and a hollow fiber, a solid fiber and a porous hollow fiber in respect of (ii).

In respect of each fiber, the method for immobilizing a biological substance is described below.

Where a biological substance is immobilized on a fiber, various chemical or physical interactions between the fiber and the biological substance can be employed, that is, the chemical or physical interactions between a functional group of the fiber and ingredients constituting the biological substance. In the case of the use of a porous fiber, hollow fiber or porous follow fiber, a solution containing a biological substance is introduced into the hollow or porous part of a fiber constituting an alignment, and then the biological substance is introduced into the fiber by utilizing the interaction between a functional group existing on the inner wall of the hollow or porous part of the fiber and a biological substance-constituting ingredient.

Where a non-modified biological substance is immobilized on a fiber, after allowing the biological substance to act on the fiber, the immobilization can be carried out by baking or ultraviolet irradiation.

Where an amino-modified biological substance is immobilized on a fiber, the substance can be bound to the functional group of the fiber with a cross-linker such as glutalaldehyde and 1-ethyl-3-(3-dimethylaminopropyl) carbodiimide (EDC). Furthermore, the immobilized biological substance can be denatured by performing a heat-treatment, an alkali-treatment and a surfactant-treatment etc. Where a biological substance obtained from living materials such as cells and cell bodies is used, a treatment that removes unnecessary cell components and the like may be performed. These treatments may be carried out separately or concurrently. Or, the treatment is carried out as appropriate, before immobilizing a sample containing a biological substance on a fiber.

In the case of a hollow fiber and a porous hollow fiber, it is characteristic that a biological substance can be immobilized in the hollow part of a fiber. In the present invention, however, the biological substance can be immobilized in the outer wall of the fiber as well as in the inner wall. Accordingly, viewed as a fiber section, the biological substance can be immobilized in both the outer and inner wall parts, and so it is characteristic that the amount of immobilization of biological substances per unit cross section can be increased when compared with normal fibers. Where a biological substance is immobilized in the inner wall part alone, since an adhesive material used to prepare an alignment (described later) does not adhere, an immobilized biological substance can effectively (precisely, without the influence of adhesive material) be used as a probe.

As a method of immobilizing a biological substance on a porous fiber, a sample containing a biological substance may be allowed to act to the porous fiber. In the case of a porous fiber, it is characteristic that a biological substance can be immobilized in the porous part of the fiber, of which has a large specific surface area is large. Accordingly, it is characteristic that the amount of immobilization of biological substances per unit cross section can be increased when compared with normal fibers.

The immobilization of a biological substance can be carried out by dissolving or suspending in water, buffer and physiological salt solution etc. A solvent for the biological substance can be selected as appropriate, depending on the physical or chemical property of the biological substance. A stabilizing agent and the like may be contained in the above solution or suspension.

When a sample containing a biological substance is allowed to act on a fiber, the temperature is preferably 5 to 95° C., and more preferably 15 to 60° C. The treatment period is generally 5 minutes to 24 hours, and more preferably 1 hour or more.

The method of preparing a fiber retaining a biological substance-immobilized gel (a solid fiber, a hollow fiber, a porous fiber, a porous hollow fiber) is not particularly limited, and the various chemical or physical interactions between a fiber and a gel, that is to say, the chemical or physical interaction between a functional group of the fiber and an ingredient constituting the gel can be used. Examples of such a method include: (i) a method in which a fiber is immersed into a mixed solution of a copolymer consisting of a monomer, an initiator and a biological substance having a vinyl group at a terminus thereof, and a cross-linker, to gelate the fiber; (ii) a method in which a fiber is immersed into a mixed solution of a monomer polymerized with an initiator, a cross-linker and a biological substance, to gelate the fiber; (iii) a method in which a fiber is immersed into a mixed solution consisting of a monomer polymerized with an initiator, a cross-linker and a product obtained by binding a biological substance to a carrier (a polymer particle, an inorganic particle etc.), to gelate the fiber; and (iv) a method in which a biological substance immobilized-agarose and the like is dissolved by heating, a fiber is immersed therein, followed by cooling gelation of the fiber, etc.

In the above methods, instead of immersing a fiber into a solution containing a biological substance, in the case of a hollow fiber and a porous hollow fiber etc., the solution may be injected or drawn into the hollow part and the porous part etc. of the fiber to fill it, followed by gelation.

A feature of the present invention is the production of a hollow fiber retaining a biological substance-immobilized gel, but the gel can also be retained in the outer wall part of the fiber as well as in the hollow part. Therefore, similar to what is stated above, viewed as a fiber section, a biological substance can be immobilized in both the outer wall part and the hollow part, and so it is characteristic that the amount of immobilization of biological substances per unit cross section can be increased when compared with normal fibers. Where a biological substance-immobilized gel is immobilized in the hollow part alone, since an adhesive material used to prepare an alignment (described later) does not adhere, an immobilized biological substance can effectively (precisely, without the influence of adhesive material) be used as a probe.

In the case of a porous hollow fiber retaining a biological substance-immobilized gel, the porous part as well as the hollow part are filled with the gel. So, the contact area between a biological substance-immobilized gel and a porous hollow fiber is large and the form is complicated, so that the biological substance-immobilized gel can strongly be retained in the porous part of the fiber.

The fiber retaining a biological substance-immobilized gel obtained by the above method can be subjected to an appropriate treatment, as long as the gel is not destroyed. For example, the immobilized biological substance is denatured by undergoing a heat-treatment, an alkali-treatment and a surfactant-treatment etc. Otherwise, where a biological substance obtained from living materials such as cells and cell bodies is used, unnecessary cell components and the like are removed. Then, the treated fiber retaining a biological substance-immobilized gel can be used as a material to detect a biological substance. These treatments may be carried out separately or concurrently. Or, the treatments are carried out as appropriate, before immobilizing a sample containing a biological substance on a fiber.

The above-prepared fiber retaining a biological substance-immobilized gel can be used as a base unit constituting the fiber alignment retaining a biological substance-immobilized gel of the present invention.

The type of gel used in the present invention is not particularly limited, and for example, there can be used a gel obtained by copolymerizing a polyfunctional monomer consisting of one or more monomer(s) such as acrylamide, N,N-dimethylacrylamide, N-isopropylacrylamide, N-acryloylaminoethoxyethanol, N-acryloylaminopropanol, N-methylolacrylamide, N-vinylpyrrolidone, hydroxyethylmethacrylate, (meta)acrylic acid and allyldextrin, and methylenebis(meta)acrylamide, polyethyleneglycoldi(meta)acrylate and the like, for example, in an aqueous solvent. Examples of other gels used in the present invention include gels such as agarose, alginic acid, dextran, polyvinyl alcohol and polyethyleneglycol, and gels obtained by crosslinking the above gels.

In the present invention, a polymerized monomer and a polyvalent amine can be used as a gel material. Types are not limited, and for example, a monomer having a glycidyl group can be used.

Examples of a polymerized monomer having a glycidyl group include glycidyl(meta)acrylate and the like. Examples of other polymerized monomers include acrylamide, N,N-dimethylacrylamide, N-isopropylacrylamide, N-acryloylaminoethoxyethanol, N-acryloylaminopropanol, N-methylolacrylamide, N-vinylpyrrolidone, hydroxyethylmethacrylate, (meta)acrylic acid and allyldextrin etc. Examples of polyvalent amine include ethylenediamine, diaminopropane, diaminobutane, diaminopentane, hexamethylenediamine, diethylenetriamine, triethylenetetramine, tetraethylenepentamine, pentaethylenehexamine and dimethylaminopropylamine etc.

Where nucleic acid as a biological substance is immobilized on a gel by means of a glycidyl group (e.g. where a vinyl group is introduced into the terminal group of nucleic acid by means of a glycidyl group), the nucleic acid needs to be modified in advance. The modification of nucleic acid is not particularly limited as long as it enables reaction with a glycidyl group.

As common chemical modifications of nucleic acid, amination, biotination and digoxygenin conversion, etc. are known (*Current Protocols In Molecular Biology*, Ed., Frederick M. Ausubel et al. (1990); *Experimental Protocol without using Isotope* (*Datsu Isotope Jikken Protocol*) (1) DIG Hybridization (Syujyun-sha)), and any of these modification methods can be applied in the present invention. By way of example, the introduction of an amino acid group into nucleic acid is described below.

The binding position of an aliphatic hydrocarbon chain having an amino group and a single-stranded nucleic acid is not particularly limited, and it may not be only the 5'- or 3'-terminal end of nucleic acid, but may also be within the chain of nucleic acid (e.g. a phosphate diester binding site or nucleotide binding site). It is preferable to bind at the 5'- or 3'-terminal end of a nucleic acid. The derivatives of this single-stranded nucleic acid can be prepared according to the methods described in Japanese Patent Examined Publication (kokoku) No. 3-74239, U.S. Pat. Nos. 4,667,025 and 4,789,737 etc. Moreover, other than the above method, the derivatives can be prepared, for example, by using a commercially available reagent to introduce an amino acid group (e.g. Aminolink II (Trademark), PE Biosystems Japan; Amino Modifiers (Trademark), Clontech), or according to the publicly known method in which an aliphatic hydrocarbon chain having an amino acid group is introduced to phosphate at the 5'-terminal end of DNA (*Nucleic Acids Res.,* 11(18), 6513- (1983).

In the present invention, a biological substance may directly be immobilized on a gel, or a derivative obtained by chemically modifying a biological substance or a biological substance denatured as required may also be immobilized thereon. To immobilize a biological substance on a gel, a method in which the substance is physically included in the gel and a method of directly binding to a gel component may be used. Also, a biological substance may be bound to a carrier such as a polymer or inorganic particle by covalent or noncovalent bond, and then the carrier may be bound to a gel.

For example, a vinyl group is introduced into the terminal group of a nucleic acid (WO98/39351) to copolymerize with a gel component such as acrylamide. Examples of copolymerization methods include a method involving copolymerization with a monomer, a polyfunctional monomer and a polymerization initiator; and a method involving copolymerization with a monomer and a polymerization initiator, and gelation with a cross-linker.

Furthermore, it is also possible that agarose is imidecarbonated by cyanogen bromide method, and after binding to the amino group of nucleic acid having an aminated terminus, the resulting product is gelated. In this case, the gel may be a mixed gel of nucleic acid-immobilized agarose and another gel (e.g. acrylamide gel).

To carry a gel on a fiber, a fiber may be immersed into a solution containing a monomer, e.g. acrylamide which is a gel component, a polyfunctional monomer, an initiator and a biological substance ingredient to polymerize and gelate. In this case, as stated above, a biological substance is preferably bound to a monomer such as acrylamide or a carrier such as a polymer particle and an inorganic particle.

Apart from a method involving copolymerization in the presence of a polyfunctional monomer, gelation may be also carried out by copolymerizing in the absence of a polyfunctional monomer and then applying a cross-linker.

In addition, there is a method in which a biological substance-immobilized agarose etc. is dissolved by beating, and then a fiber is immersed therein to obtain a cooling gel.

In the case of a hollow fiber and a porous hollow fiber, instead of immersing a fiber into the solution containing each ingredient stated above, the solution may be injected or drawn into the hollow part and/or the porous part of the fiber to fill the parts, followed by gelation.

Immobilization in this case can be carried out by introduction of a solution containing a biological substance and the above monomer and the above polymerization initiator into the hollow part of a hollow fiber and the like, followed by gelation during polymerization.

The types of biological substances immobilized in each hollow fiber and porous hollow fiber contained in a three-dimensional alignment can be different from one another. That is to say, according to the present invention, the kinds of immobilized biological substances and the order of alignments can arbitrarily be determined, depending on purposes.

In the present invention, a pigment can be mixed into the above gel component.

Pigments used in the present invention are mainly classified into a natural pigment and a synthetic dye. Representative examples of a natural pigment include a flavone derivative, a chalcone derivative, an anthraquinone derivative and an indigo derivative etc. Representative examples of a synthetic dye include an azo dye, an anthraquinone dye, an indigoid dye, a diphenylmethane dye, a triphenyl dye, a xanthene dye and an acridine dye etc. Especially in the above pigments, there are some pigments having fluorescence.

The kind of fluorescent pigment used in the present invention is not particularly limited as long as it emits fluorescence, and examples of such pigments include rhodamine, TexasRed, Fluorescein, Fluorescein isothiocyanate (FITC), Oregon Green, Pacific Blue, R-Phycoerythrin, Rhodol Green, Coumarin derivative and Amino Methyl Coumarin etc.

As the pigment immobilization method used in the present invention, a pigment may directly be immobilized on a gel, or a derivative obtained by chemically modifying a pigment or a pigment denatured as necessary may also be immobilized on a gel. To immobilize a pigment on a gel, a method involving physical inclusion of the substance in the gel and a method involving direct binding to a gel component may be used. Also, a pigment may once be bound to a carrier such as a polymer particle or an inorganic particle by covalent or noncovalent bond, and then the carrier may be bound to a gel. For example, a pigment can be copolymerized with a gel component such as acrylamide by introducing a polymeric group into the pigment.

For example, when a pigment is directly bound to a gel component, examples of applicable methods include a method in which a pigment is copolymerized with a gel component such as acrylamide and the like, using Fluorecein Dimethacrylate or 1-Pyrenylmethyl Methacrylate by Polyscience; a method in which a polymeric vinyl group is introduced into a gel by reacting a pigment derivative having an amino group with glycidyl methacrylate (GMA), and then copolymerizing the vinyl group with a gel component such as acrylamide; and a method in which an anionic monomer is introduced into a gel, followed by the ionic bonding of a cationic pigment thereto.

In the present invention, when hybridization is performed using a fluorescent-labeled sample which is obtained, especially, by immobilizing fluorescent pigment of a certain wavelength, the visibility of a gel can be imparted without damaging the high transparency of the gel at the detection wavelength.

The immobilization of a biological substance on a polymer gel can be carried out by mixing the polymer gel and the biological substance. Taking response rate or reaction rate into consideration, a catalyst such as nucleotide can be used.

Temperature for immobilization is preferably 0 to 100° C., and more preferably 20 to 80° C.

The immobilization of a modified biological substance on a polymer gel can be carried out by mixing the polymer gel and the modified biological substance. Taking response rate or reaction rate into consideration, a catalyst such as nucleotide can be used.

Temperature for immobilization is preferably 0 to 100° C., and more preferably 20 to 80° C.

Examples of other methods include a method in which nucleic acid is bound to a carrier such as a polymer particle or inorganic particle etc., and the particle is completely immobilized on the above-stated gel. For example, nucleic acid-immobilized agarose beads can be obtained by reacting biotinated nucleic acid with avidinated agarose beads (avidinated agarose etc., Sigma). Nucleic acid-immobilized beads can be completely immobilized on an acrylamide gel etc.

Moreover, when nucleic acid is bound to a gel or carrier, a cross-linker such as glutalaldehyde and 1-ethyl-3-(3-dimethylaminopropyl)carbodiimide (EDC) can be used.

A biological substance-immobilized polymer gel can be used to detect a substance having interaction with a biological substance in a sample, by hybridizing it with the sample, using the immobilized biological substance as a probe. For example, a nucleic acid having a sequence complementary to the nucleic acid can be detected by the immobilization of the nucleic acid on a gel.

Various forms of fibers formed as above (see Examples) are shown in FIGS. 1A to F.

4. Production of a Fiber Alignment

To arrange fibers so that a slice of a fiber alignment on which biological substances are immobilized at high density can be obtained, the outer diameter of each fiber is preferably thin. In the preferred embodiments of the present invention, the immobilization of biological substances is carried out at high density of 100 or more per $cm^2$. To achieve this, however, the outer diameter of one fiber is required to be less than about 1 mm. For example, a slice of a porous hollow fiber alignment, on which 400 or more biological substances are immobilized per $cm^2$, can be obtained from a porous hollow fiber membrane having an outer diameter of about 500 μm. A slice of a porous hollow fiber alignment, on which 100,000 or more biological substances are immobilized per $cm^2$, can be obtained by using a porous hollow fiber having an outer diameter of about 30 μm, produced by applying hollow fiber spinning.

The above-prepared biological substance-immobilized fiber (a solid fiber, a hollow fiber, a porous fiber, a porous hollow fiber and a fiber retaining gel of these fibers) can be used as a basic unit to constitute the fiber alignment of the present invention. These biological substance-immobilized fibers are tied in a bundle and adhered to obtain a fiber alignment (a three-dimensional alignment).

Furthermore, fibers retaining a biological substance and a pigment-immobilized gel are tied in a bundle and adhered to obtain a fiber alignment retaining a biological substance and a pigment-immobilized gel.

A slice (FIG. 3) having a biological substance-immobilized fiber alignment section (FIG. 2) can be obtained by cutting the above three-dimensional alignment in a direction intersecting a fiber axis, preferably in a direction perpendicular to a fiber axis.

In this case, for example, a fiber alignment comprising biological substances all regularly arranged lengthwise and breadthwise, can be obtained by regularly arranging biological substance-immobilized fibers and adhering with a resin adhesive or the like. The form of the fiber alignment is not particularly limited, but generally it is formed as square or rectangle by arranging fibers regularly.

The term "regularly" is used to mean that fibers are arranged in an orderly manner such that the number of fibers contained in a frame of certain size can be the same. For example, where a bundle of fibers, the diameter of each of which is 1 mm, are arranged so that the section becomes a square, 10 mm long and 10 mm wide, the number of fibers contained in an edge of the frame of the square (1 $cm^2$) is set as 10 fibers, and these 10 fibers are tied in a line to obtain a sheet, and then this sheet is overlaid to make 10 layers. As a result, i.e., 100 fibers in total can be arranged 10 fibers lengthwise and 10 fibers breadthwise. However, a method in which fibers are regularly arranged is not limited to the superposition of sheets stated above.

In this case, fibers should be arranged with predetermined positions of specific biological substances-immobilized fibers, but this is not always required. This is because even if positions of specific biological substances-immobilized fibers are not known when alignments are formed, the positions can be confirmed by cutting the alignments and then determining the biological substances-arranged positions on a cross-section using hybridization. Hence, predetermining the positions of several types of biological substances arranged in a slice enables the positions of biological substances of all the slices obtained from the same alignments to be known, since slices obtained from the same alignments have the same biological substance-arranged positions.

The number of bundles of fibers in this invention can be appropriately determined according to purpose and is 100 or more, and preferably 1,000 to 10,000,000. The density of fibers in alignments is preferably adjusted to 100 to 1,000,000 per 1 $cm^2$. Further, thinner fibers are preferred in order to arrange fibers so that a slice of a fiber alignment to which biological substances are immobilized at high density can be obtained. In preferred embodiment of this invention, fiber thickness is required to be 1 mm or less.

When a monofilament with a diameter of 50 μm is used in this invention, mono-filaments can be arranged 200 fibers/1 cm. 40,000 monofilaments can be arranged on a square (1 $cm^2 \times 1$ $cm^2$). Therefore, a maximum of 40,000 types of biological substance can be immobilized per 1 $cm^2$.

For example, when a monofilamentous hollow fiber or a monofilamentous porous hollow fiber with an outer diameter of 500 μm is used, a three-dimensional structure in which 400 or more hollow fibers or porous hollow fibers are arranged per 1 $cm^2$ of the cross-section of an immobilized alignment can be obtained. Moreover, hollow fiber or porous hollow fiber with outer diameter of around 30 μm are produced by applying hollow fiber spinning technology for this purpose. Such hollow fibers enable a three-dimensional structure in which 100,000 or more hollow fibers or porous hollow fibers are arranged per 1 $cm^2$ of the cross-section of an immobilized alignment to be obtained.

An example of monofilament is a commercially available fishline which is a thread 50 to 900 μm thick. In addition, 1 dtex (when it is polyethylene terephthalate, diameter is about 14 μm) monofilaments and even thinner fibers (super thin fibers or ultra super thin fibers) can be produced by recent spinning technology (diameter of 1 to 10 μm).

On the other hand, multifilament e.g. 83 dtex/36 filament and 82 dtex/45 filament can be used as is.

Types of biological substances immobilized within each fiber in each fiber alignment can be varied, that is, the types may be differ from one another. Further, any number of fibers can be selected from the same biological substance-immobilized fibers and the selected fibers can be made into bundles and appropriately arranged. In this invention, types of immobilized biological substances and order of alignment can be freely set according to purpose.

In this invention, an extended portion, which is not immobilized with resin, is provided in each fiber constituting an alignment; the tip of this portion is immersed in a cistern containing biological substances so as to introduce this solution into each fiber constituting an alignment (see 6. Inner wall treatment of fibers).

The extended portion which is not immobilized with resin to each hollow fiber or porous hollow fiber composing alignments is provided on one end of an alignment or preferably on both ends of an alignment so that various treatments can be performed according to need in addition to introduction of solution containing biological substances. For example, treatment with heat, alkaline, surfactant or the like can alter biological substances immobilized to the inner wall of the hollow fibers or porous hollow fibers constituting an alignment. When biological substances obtained from living materials e.g. cells and bacteria are used, such a treatment can remove unnecessary cellular components. These treatments may be performed separately or simultaneously. Further, these treatments may be appropriately performed before immobilization of samples containing biological substances into the hollow fibers or porous hollow fibers constituting an alignment.

5. Production of Fiber Alignments Using Jigs

In this invention, fiber alignments having fibers arranged to form a three-dimensional structure can be produced using jigs.

Fiber alignments of this invention can be produced by threading a fiber through the hole of a jig, which comprises many small holes following an alignment pattern so as to produce bundles of fibers and filling spaces among the fibers with resin to immobilize under tension.

Small holes perforated on a jig used in this invention are for example, arranged in a certain pattern. Examples of jigs include a jig comprising circular holes arranged longitudinally and transversely as shown in FIG. 4 and a jig having spaces formed by a network which is divided by support line groups consisting of longitudinal and transverse lines shown in FIG. 5.

As shown in FIG. 4 when a certain pattern is formed and a jig having many small holes perforated thereon (perforated plate) is used, fibers 12 are threaded through holes of a jig 11 and then spaces between the jigs are enlarged. At this time, positions of the holes of the jig 11 are preferably arranged properly so as to correspond to positions of holes of an adjacent jig. Alternatively, as shown in FIG. 5, fibers can be threaded through a division of support line groups 21 consisting of longitudinal and transverse lines to produce a bundle of fibers, enlarging the space between jigs. Then, tension is applied to the fibers and under this condition spaces between the fibers are filled with resin so as to immobilize the bundle of the fibers, thereby obtaining fiber alignments.

The number of fibers to be made into three-dimensional alignments can be properly set according to purposes. Such number of fibers is 100 or more, preferably 1,000 to 10,000,000. Here a preferred density of fibers in alignments is adjusted to 100 to 1,000,000 fibers per 1 $cm^2$. Further, a thinner outer diameter of a fiber is preferred in order to arrange fibers at a high density. In a preferred embodiment of this invention the outer diameter of a fiber is 1 mm or less, preferably 300 to 10 μm. When a monofilament with an outer diameter of 50 μm is used, 200 fibers can be arranged per 1 cm. Thus, 40,000 fibers can be arranged within a 1 $cm^2$ square. In other words, a maximum of 40,000 types of biological substance can be immobilized per 1 $cm^2$. On the other hand, multifilament e.g. 83 dtex/36 filament and 82 dtex/45 filament and the like can be used intact. When a monofilamentous hollow fiber or a monofilamentous porous hollow fiber with an outer diameter of about 300 μm is used, three-dimensional alignments in which 1,000 or more fibers are arranged per 1 $cm^2$ of the cross-section of immobilized alignment can be obtained.

When a perforated plate having holes arranged in a pattern the same as that of a fiber alignment is used as a jig to define fiber alignments, distance between fibers in fiber alignments will be the same as the pitch of holes of the jig (distance between the hole center and its adjacent hole center).

A preferred diameter of each hole of a jig is 100% or more and 125% or less of the outer diameter of a fiber, and most preferably 105% in view of alignments-defining power and difficulty in alignment.

A preferred process for manufacturing such a perforated plate is photo etching processing which can provide the plate with a good accuracy at the lowest cost in large quantities. In this case, the thickness of a plate suitable for the processing is 200% or less, preferably 100% or less of the clearance dimension between holes. Normally, stainless steel, copper or copper alloy is used as material for the plate. In this invention, stainless steel plate (SUS304 material) is the most appropriate material in terms of material strength, processing cost and material cost.

The use of a support line group consisting of longitudinal and transverse lines as a jig enables formation of a network that has the same or a similar figure with the pattern of fiber alignments and that can be expanded and reduced. Compared to the use of a perforated plate, the use of a support line group can improve alignment-defining power and can ease difficulties in alignment.

For example, support lines are arranged into two perpendicular directions for the fiber axes (the number of support lines to be arranged equals the number of biological substance-immobilized fiber alignments per direction+1), thereby forming a mesh having a number of holes equaling the number of biological substance-immobilized fibers in an alignment (FIG. 5). Both ends of a support line possess linear motion mechanism. Each mesh size formed by support line groups can be expanded or reduced by parallel displacement of each support line to its adjacent support line. Expanding the mesh size greatly facilitates arranging of fibers. Reducing the mesh size after all the fibers are arranged causes no opening to form between jigs and fibers thus enables defining of very tight alignments. Therefore, distances between fibers in fiber alignments can be reduced up to the diameter or width of the support line.

Two such jigs (or two or more if necessary) are arranged to be adjacent to each other so that the positions of the holes or the meshes are set in the right order. Then arranging is performed by threading fibers through the holes or the meshes of the jigs. When support lines are used as jigs, arranging is partially or completely done, and then the mesh size is reduced to adjust to a certain size.

Next, spaces between the jigs are expanded. Expanding can also be performed before or simultaneously with the above adjusting of meshes. Spaces are not specifically limited and may be determined as appropriate. Setting larger spaces enables formation of long three-dimensional alignments. Further, production cost in this case can be reduced by minimizing loss in the post-processing such as in a step of cutting into slices. Setting excessively large spaces may cause disordered alignments due to reduced arresting force of fibers around the span center. Thus in this case spaces should be appropriately adjusted so as not to cause such problems. In addition, number of jigs may be properly increased as appropriate in order to enhance defining of alignments around the span center.

Subsequently, tension is applied to all the fibers threaded through jigs. In this condition, spaces between fibers are filled with resin and immobilized. Tension may differ depending on the form of the cross-section or material of fibers, that is elastic modulus, extension ratio and the like. However, tension to be applied should be set so as not to cause loosening and breaking of fibers. To keep fibers in a tightened but not loosened state, tension is maintained. Examples of methods to keep tension include a method involving stretching all the fibers with a coil, a method involving sucking (with no contact) with an air sucker, a method involving properly collecting and pasting fibers with an adhesive tape to jigs and a method using gravity.

Examples of support lines that can be used in this invention are not specifically limited so far as these are made of materials that are not easily broken by tension, including SUS304 wire and fishing line.

Resin used in this invention to immobilize bundles of fibers is liquid with low viscosity that can be easily filled into and solidified in spaces between fibers at normal temperature. A preferred example of resin is double-fluid reactive setting resin e.g. urethane resin.

6. Treatment of Inner Wall of Fiber

The present invention provides a process for forming gel in the inner wall portion of hollow fiber (including inner wall surface, and a region from the inner wall surface to the outer wall surface).

This process comprises adhering a gel-forming monomer solution (a) to the inner wall portion of a hollow fiber, and polymerizing the monomer so as to cause formation of the gel on the inner wall portion. In this invention, such a process is called inner wall treatment. Here, monomer solution (a) means a solution to be used for inner wall treatment, and is capable of infiltrating into inside the inner wall from the inner wall surface and penetrating from the inner wall surface to the outer wall surface. Thus, the inner wall portion of this invention means a portion where monomers can infiltrate from the inner wall surface inward, including a region from the inner wall surface to the outer wall surface in addition to the inner wall surface.

The inner wall treatment enables gel to be physically or chemically immobilized in the inner wall portion of hollow fiber when gel is filled in the centrum of a fiber.

Moreover, the present invention provides a process for filling gel within the centrum portion which comprises filling a gel-forming monomer (b) solution within the centrum of hollow fiber pretreated in the manner as described above (that is, hollow fiber in which gel is formed in the inner wall portion), and polymerizing the monomer. In this invention, monomer solution (b) means a solution used for gel formation by filling the gel within the centrum of the hollow fiber having the pretreated inner wall portion. Further, this invention provides a process for manufacturing a fiber which contains the centrum of hollow fiber filled with gel by the above filling process. Thus the obtained fiber is appropriate for use in capillary electrophoresis and microarrays for analyzing DNA and the like.

Examples of hollow fiber or porous hollow fiber subjected to the inner wall treatment in this invention include various polyamide fibers, such as nylon 6, nylon 66, aromatic polyamide; various polyester fibers, such as polyethylene terephthalate, polybutylene terephthalate, polylactic acid, polyglycolic acid; various acrylic fibers, such as polyacrylonitrile; various polyolefin fibers, such as polyethylene and polypropylene; various polymethacrylate fibers, such as poly methyl methacrylate; various polyvinyl alcohol fibers; various polyvinylidene chloride fibers; polyvinyl chloride fibers; various polyurethane fibers; phenol fibers; fluorine fibers including polyvinylidene fluoride and various polytetrafluoroethylene; and polyalkylene paraoxybenzoate fibers.

Capillary electrophoresis requires irradiation of detection light from outside the capillary. Thus, a material with transparency is preferred when used as a hollow fiber for capillary electrophoresis. Preferably, a hollow fiber or capillary (hereinafter generally called a hollow fiber) made of a methacrylate resin, a representative example of which is poly methyl methacrylate.

Examples of the structures of porous hollow fiber employed include a three-dimensional network structure which contains holes communicating from the outer surface to the inner surface of a fiber, a structure which contains connecting holes composed of fibrillated materials, a finger-shaped structure, an independent foam structure, or foam structure which contains a communicating part.

Furthermore, a porous hollow fiber for precision filtration and ultrafiltration, a reverse permeable film having an outer surface coated with non-porous homogenous film, a gas separation film, a porous hollow fiber having a non-porous homogenous layer placed between porous layers can also be used. The hollow fiber of this invention has an external diameter of 2 nm or less, preferably 1 mm or less, and more preferably 0.05 mm to 0.5 mm. The internal diameter of the hollow fiber is preferably 0.03 mm or more, and more preferably 0.03 mm to 0.08 mm. A preferable hollow fiber for capillary electrophoresis is a relatively thick hollow fiber because it is easily handled. Moreover, the gel-filled fiber of this invention can be used in microarrays for analyzing DNA and the like. In this case, probe DNAs are immobilized in gel-filled fiber, a great many fibers are arrayed, set by resin, and then sliced perpendicularly to the fiber axis, thereby producing microarrays (slices of a fiber alignment). Microarrays for such applications require the presence of many fibers per unit area. A fiber with a thinner outer diameter is preferred, being 0.5 mm or less, more preferably 0.05 mm to 0.3 mm. In addition, regularity of arrays should be maintained for arranging fibers. Therefore, to impart tension to the fibers during an arraying step, the use of materials with high rigidity is preferred. Examples of such materials include metacrylic resins, such as aromatic polyamide and methyl metacrylate.

The purpose of this invention is to stably immobilize gel to be filled into the centrum by physical or chemical binding of the gel and the inner wall portion. Accordingly when the inner wall portion of hollow fiber forms at least porosity, the inner wall portion preferably possesses a structure which allows gel-forming monomer solution (a) for inner wall treatment to easily penetrate from the surface to the inside of the inner wall. Further when the inner wall portion of hollow fiber forms no porosity, the inner wall portion preferably possesses a structure which allows the monomer or the monomer solution to swell the material of the hollow fiber so as to penetrate into the inner wall portion. Then, polymerization of the monomer achieves the formation of a gel fixed to the inner wall portion.

Since the gel-filled fiber of the present invention is applied to electrophoresis or analysis of DNA and the like, the gel to be filled in the centrum contains as a main ingredient polyacrylamide having high affinity to water. Thus a gel-forming monomer (a) for inner wall treatment is preferably an amphiphatic monomer which has affinity to both hollow fiber materials and gel to be filled in the centrum.

Examples of such a monomer (a) include a (meta)acrylamide monomer, or a (meta)acrylate monomer. Examples of acrylamide monomers include N-methyl(meta)acrylamide, N,N-dimethyl(meta)acrylamide, N-ethyl-N-methyl (meta)acrylamide, N,N-diethyl(meta)acrylamide, N-n-propyl(meta)acrylamide, N-isopropyl(meta)acrylamide, N-t-butyl(meta)acrylamide, N-s-butyl(meta)acrylamide, N-n-butyl(meta)acrylamide, N-methyl-N-isopropyl(meta) acrylamide, N-methyl-N-n-propyl(meta)acrylamide, N-ethyl-N-isopropyl(meta)crylamide, N-ethyl-N-n-propyl (meta)acrylamide, and N,N-di-n-propyl(meta)acrylamide. Examples of (meta)acrylate monomers include monomethylaminoethyl(meta)acrylate, monomethylaminopropyl(meta) acrylate, dimethylaminoethyl(meta)acrylate, dimethylaminopropyl(meta)acrylate, diethylaminoethyl(meta)acrylate, dipropylaminoethyl(meta)acrylate, diisopropylaminoethyl (meta)acrylate, diethylaminopropyl(meta)acrylate, dipropylaminopropyl(meta)acrylate, diisopropylaminopropyl(meta) acrylate, methylethylaminoethyl(meta)acrylate, methylethylaminopropyl(meta)acrylate, hydroxymethyl (meta)acrylate, 2-hydroxyethyl(meta)acrylate, and 3-hydroxypropyl(meta)acrylate. These monomers can be used individually or a mixture of two or more of these monomers. If necessary, a monomer having a functional group which is capable of chemically binding with a gel to be filled with the centrum as described below can also be used in combination with the above monomers. Examples of such a monomer include (meta)acrylate and glycidyl methacrylate which have a carboxylic acid group or an epoxy group; and allyl methacrylate which is graft cross-linker in addition to the above monomer having a hydroxyl group.

Examples of crosslinkers required for gel formation include bi(or higher)-functional acrylamide monomers, preferably such as N,N'-methylenebis acrylamide, N,N'-(1, 2-dihydroxyethylene)-bisacrylamide, N,N'-diallyltaltaldiamide, N,N'-cystamine-bisacrylamide, or N-acryloiltris(hydroxymethyl)aminomethane.

These monomers usually dissolve monomers and cross-linkers and are used as a solution of alcohol including methanol, ethanol and propanol, and acetone, which is capable of penetrating from the inner wall portion of hollow fiber into the inside.

Examples of a polymerization initiator that may be used include azo, peroxide, and redox initiators that can be dissolved in a solvent used herein. Such initiators include 2,2'-azobisisobutylonitrile, 2,2'-azobis(2-methylbutylonitrile)isobutyronitrile, benzoyl peroxide, and benzoyl peroxide-dimethylaniline initiators.

The degree of inner wall treatment can be varied depending on the monomer concentration of a monomer solution or the concentration of a cross-linker. Monomer concentration range is preferably 80% or less, more preferably 1 to 50%. Cross-linker concentration is preferably 0.5 to 50% relative to a monomer concentration, more preferably 1 to 30%.

Next, the treatment will be described more specifically.

First, the inner wall treatment is explained. The tip of a hollow fiber or porous hollow fiber is immersed in a solution containing a monomer or a cross-linker for suction. The monomer solution is introduced into the inner wall and/or the porous portion of a hollow fiber or porous hollow fiber for polymerization, thereby forming gel on inner wall surface and the inside of the inner wall.

When the inner wall portion of the hollow fiber or porous hollow fiber is treated, a monomer solution (a) is filled within the hollow fiber by suction, and allowed to adhere to the inner wall portion. The solution which does not adhere to and remains in the inner wall is discharged, followed by polymerization.

Now, a step for filling the centrum of hollow fiber obtained by the inner wall treatment with gel-forming monomer solution (b) is described. An acrylamide-based monomer solution can be used as a gel-forming monomer solution (b) to be filled. Examples of solvents include alcohol, such as methanol and ethanol, and water. Generally, acrylamide is used as a monomer to be mixed with gel-forming monomer solution (b). Other examples of the monomer include, but are not limited to, the above (meta)acrylamide, and (meta) acrylate monomers which can co-polymerize with acrylamide. In this case, preferred monomer concentration ranges from 2 to 20% of the total monomer solution. Polymerization is performed by adding a cross-linker and a polymerization initiator to a solution. A method for filling the centrum of hollow fiber with a monomer solution is generally, but is not limited to, vacuum suction.

When porous fiber, hollow fiber or porous hollow fiber is used in this invention, fiber alignments 31 immobilized with resin and fiber portion (extended portion) 32 not immobilized with resin are preferably provided, as shown in FIG. 6. Immersion of tip portion 32 in container 33 containing biological substances enables introduction of the solution into the centrum or the porous portion of each fiber. In this figure, the tip portion 32 continues through continuous surface 34 to the container 33.

That is, fiber portion 32 which is not immobilized with resin extends from fiber alignments 31 immobilized with resin. Thus, when fiber portion 32 is immersed in container 33 containing biological substances and the biological substances are sucked from the opposite side of the immersed portion (the side of fiber immobilized with resin), biological substances are sucked into the centrum of fiber within fiber alignments 31. In this manner, biological substances can be introduced into fiber alignments 31.

Types of biological substance to be immobilized in each fiber within three-dimensional alignments can be varied.

Temperature to allow samples containing biological substances to act on fiber preferably ranges from 5° C. to 95° C., more preferably 15° C. to 60° C. Time for processing usually ranges from 5 min to 24 hours and preferably is 1 hour or more.

7. Slices of Fiber Alignments

The present invention can provide slices containing cross-sections of randomly arranged biological substance-immobilized hollow fiber alignments by cutting the above described biological substance-immobilized fiber alignments, or biological substance- and pigment-immobilized fiber alignments in a direction intersecting with, or preferably perpendicular to, the fiber axis. An example of a cutting method which involves cutting slices from alignments using a microtome. Thickness of a slice can be freely adjusted, and generally ranges from 1 to 5,000 μm, preferably 10 to 2,000 μm.

The thus obtained slice can be easily observed for deformation of gel, shape of deciduation, or the like using e.g., a fluorescence microscope.

Since a step to impart tension to a fiber as described above is included in this invention, a fiber with high rigidity is preferred. For example, methyl methacrylate fiber, aromatic polyamide fiber and the like are preferably used.

In the resultant cross-sections of biological substance-immobilized hollow fiber alignments or a slice having biological substance-immobilized porous hollow fiber alignments (biological substance-arranged slices), biological substances are present in a number corresponding to that of hollow fibers or porous hollow fibers composing the alignments. Regarding the number of biological substances per cross-sectional area of a slice, a slice containing 100 or more biological substances immobilized per 1 $cm^2$ of cross-sectional area of the slice can be produced by appropriately selecting an outer diameter or the like of a hollow fiber or a porous hollow fiber used. Furthermore, a slice containing 1000 or more biological substances immobilized per 1 $cm^2$ of cross-sectional area of the slice can be produced.

Since the positions in an alignment of biological substances in a slice obtained from the same alignments are all identical to each other, the positions and arrangement of biological substances in all slices obtained from the same alignments can be identified.

When biological substances immobilized to a fiber are, for example nucleic acids, the slice is allowed to react with a sample for hybridization, so that a specific polynucleotide present in the sample can be detected using the above nucleic acid as a probe.

8. Slices of Fiber Alignments with Coordinate Reference Points, Determination of a Coordinate Per Fiber Unit and a Recording Medium Containing Coordinate Reference Data The present invention provides slices of fiber alignments in which a position of each fiber unit contained in the slice is determined as coordinates. Terms in this invention are defined as follows. "Fiber alignments" means bundles of fibers. "Slices of fiber alignments" means slices which are obtained by cutting fiber alignments. "A fiber unit" means each fiber portion in a slice of fiber alignments following cutting. "Coordinates" mean numerical values shown by X and Y coordinates.

The slices of fiber alignments of this invention can be produced by making fibers into bundles, adhering them to one another and fixing. The fibers used in this invention, that is, slices of fiber alignments containing fiber units derived from the fibers fulfill certain functions according to the application (e.g. function to detect a certain substance). To achieve the purpose, chemical substances, such as dye, chemically active functional groups, ligands, nucleic acids and proteins (e.g. antibodies) can be bound to or carried (hereinafter binding and retaining are collectively referred to as immobilization) by each of the fibers; or electric charge and the like which causes an electric and magnetic physical interaction can be fixed to each of the fibers.

Now, detailed descriptions of slices of biological substance-immobilized fiber alignments wherein a position of each fiber unit is determined as coordinates will be given as one of the preferred embodiments of this invention.

Each basic fiber unit becomes twisted or bent during manufacturing process for fiber alignments, so that each fiber unit in slices cut out from the fiber alignments may shift bit by bit with respect to one another. When types or amount of biological substances in samples are analyzed using the slices of fiber alignments, each fiber unit in a slice of fiber alignments is mechanically recognized and detected. Accordingly, a position of each fiber unit on a slice should be previously determined. In most cases such a shift of fiber unit positions between slices obtained from the same fiber alignments is caused by continuous meandering of fibers. Therefore, base coordinates are set at two different positions in each slice. Based on the base coordinates, coordinates for all the fiber units on each slice can be determined.

(1) Coordinate Reference Points

The coordinate reference points are signs continuing into the fiber axis of fiber alignments. Various types of coordinate reference points can be employed and are not limited, so far as the margin of error set from the sign is small. Examples of coordinate reference points that may be employed include freely chosen fiber units present in the slices of fiber alignments, lines drawn with e.g. magic ink on the side of fiber alignments, and slots cut by a cutter on the side of fiber alignments. 2 to 10 coordinate reference points, most preferably 2 coordinate reference points per 1000 fiber units can be provided on a slice of fiber alignments.

For example, when fiber units present in a slice of fiber alignments are used as coordinate reference points, fibers stained with dye (e.g. fluorescent dye) (herein after referred to as marker fibers) which reacts well with light under microscopy and facilitates detection of the positions stained with dye, are included in fiber alignments upon manufacture of slices of fiber alignments, so that slices of marker fiber unit-containing fiber alignments can be produced.

(2) Determination of Coordinates for Each Fiber Unit

Coordinates for each fiber unit in a slice of fiber alignments can be determined as follows. First, slices obtained in 7 above are numbered in order of cutting, such as S(1), S(2), . . . , S(h), . . . , S(m). A slice is freely chosen from the slices and numbered S(h). Coordinates for "n" (n=the number of fibers) fibers in a slice are determined. A method for determining individual coordinates will be described later. If fibers to which "n" biological substances (n=the number of biological substances) are immobilized are present in a slice, the coordinates can be determined using biological substances labeled with some multiple labeling substances which cause e.g. hybridization reaction with each of the biological substances.

Coordinates used in this case should be coordinate reference points present within the slice. Further, coordinates for "n" fibers contained in the slice are regulated by the standards. Once the coordinates for S(h) are determined based on the coordinates, coordinates for "n" fibers in a slice S(i) which is located near S(h) can be similarly determined based on the coordinate reference points within the slice S(i). This determination uses pre-determined coordinate data of "n" fibers in the slice S(h). A method of determination will be described later. It is clearly understood from the above explanation that preferably slices S(i) and S(h) are directly adjacent to each other. Similarly, coordinates for a slice S(j) near S(i) is determined based on the coordinate reference points provided within S(j) and the "n" coordinate data contained in the slice S(i). Therefore, all the coordinates for the obtained "m" number of slices can be determined.

To give a simple explanation, a case will be explained in which two slices are continuously cut from fiber alignments having marks being two continuous base coordinates along a direction of the fiber axis of a fiber alignment.

A fiber unit in each slice has a finite area. The central part in this area is considered as a representative point. Based on coordinate reference points within a slice which is cut out first, two-dimensional coordinates are determined per fiber unit of all the fiber units within the slice cut out first. Coordinates can be read using a projection microscopy with XY stages which enables reading of XY coordinates. To determine coordinates, two coordinate reference points within the first cut slice are plotted as P1 and P2. Then the coordinates read with projection microscopy with XY stages are plotted as (P1X, P1Y) and (P2X, P2Y). Further a freely chosen fiber unit within the slice cut out first is plotted as A1, and the coordinates read with projection microscopy with XY stages are plotted as (A1X, A1Y). Thus, the coordinates of A1 fiber unit (B1X, B1Y) in the coordinate system with P1 and P2 as standards within the slice can be obtained from the following equations (1) and (2):

$$\begin{pmatrix} B1X \\ B1Y \end{pmatrix} = \begin{pmatrix} \mathrm{COS}(-\theta 1) & -\mathrm{SIN}(-\theta 1) \\ \mathrm{SIN}(-\theta 1) & \mathrm{COS}(-\theta 1) \end{pmatrix} \begin{pmatrix} A1X - P1X \\ A1Y - P1Y \end{pmatrix} \quad \text{Equation (1)}$$

$$\theta 1 = \mathrm{TAN}^{-1}\left(\frac{P2Y - P1Y}{P2X - P1X}\right) \quad \text{Equation (2)}$$

Here, coordinates of a freely chosen fiber unit to be read with projection microscopy with XY stages are preferably located at a barycentric position of the cross-section of the fiber unit.

Similarly, when coordinates of all the fiber units in a slice cut out first are read with projection microscopy with XY stages, coordinates of all the fiber units in the coordinate system based on P1 and P2 within the slice can be determined.

A thinner slice is cut out secondly so that the two-dimensional coordinates of the same fiber units in the slice cut out first and in the slice cut out second are proximate to one another. Hence, a fiber unit of the slice cut out second, which is same with that of the slice cut out first, can be easily found from those in the slice cut out second. Then the two-dimensional coordinates of the fiber unit in the coordinate systems based on the base coordinates within the slice cut out second can be determined. For example, coordinates of a freely chosen fiber unit A1 based on the base coordinates within the slice cut out first are plotted as (B1X, B1Y). Next, two base coordinates within the slice cut out second are plotted as P3, and P4; coordinates read for P3 with projection microscopy with XY stages are plotted as (P3X, P3Y), and for P4 as (P4X, P4Y). If a marker fiber unit and the fiber unit A1 within the first slice shift in parallel to those within the second slice, coordinates (C1X, C1Y) of a fiber unit (same as that of A1) within the slice cut out second on projection microscopy with XY stages are shown by the following equations (3) and (4):

$$\begin{pmatrix} C1X \\ C1Y \end{pmatrix} = \begin{pmatrix} \mathrm{COS}(\theta 2) & -\mathrm{SIN}(\theta 2) \\ \mathrm{SIN}(\theta 2) & \mathrm{COS}(\theta 2) \end{pmatrix} \begin{pmatrix} B1X \\ B1Y \end{pmatrix} + \begin{pmatrix} P3X \\ P3Y \end{pmatrix} \quad \text{Equation (3)}$$

$$\theta 2 = \mathrm{TAN}^{-1}\left(\frac{P4Y - P3Y}{P4X - P3X}\right) \quad \text{Equation (4)}$$

The fiber unit within the slice cut out second corresponding to the fiber unit A1 within the slice cut out first can be easily found by adjusting XY coordinates on a projection microscopy with XY stages to (C1X, C1Y). Then, correct coordinates (A2X, A2Y) of the thus found A1 fiber unit are found on XY stages. In the same manner employed for the above first slice, coordinates (B2X, B2Y) are determined based on base coordinates P3, P4 within the second slice using the above equations (1) and (2). Also in the same manner, coordinates of all the fiber units in the second slice can be determined based on coordinate data of fiber units in the first slice. Alternatively, coordinates of a freely chosen fiber unit within the second slice are determined based on the base coordinates within the second slice using the equations (1) and (2). Then coordinates of the freely chosen fiber unit in the second slice are compared with that of the fiber unit in the first slice determined based on the standard coordinates in the first slice. Thus the fiber units located nearest to each other can be determined as the same fiber unit.

Similarly, two-dimensional coordinates of a fiber unit within the slice cut out second are obtained based on the base coordinates within a slice cut out third and that within the slice cut out second. Two-dimensional coordinates of all the fiber units within the slice cut out third can also be determined based on the base coordinates within the slice cut out third. Here, the two dimensional coordinates of all the fiber units within the slice cut out third correspond to all the fiber units within the slice cut out second (that is, correspond all the fiber units within the slice cut out first). By repeating the above steps, two-dimensional coordinates of all the fiber units within slices which are cut out from fiber alignments can be determined based on base coordinates within slices cut out from fiber alignments, even when fiber alignments become twisted or fibers within fiber alignments bend or become coiled around each other. Hence, specifying fiber units within a slice cut out first enables determining of two-dimensional coordinates per fiber unit of all of them within slices cut out from fiber alignments based on specification of fiber units within all the slices cut out from fiber alignments and on base coordinates within slices cut out of fiber alignments.

The explanation above concerns two methods to be employed for determining two slices adjacent to each other, wherein coordinate data of a first slice are used for determining coordinates of a second slice. However, it is not always necessary to use coordinates data of slices adjacent to each other. Especially when alignments in fiber bundles are relatively good, coordinates are determined by the above method using slices having a space (several slices) between them. The coordinates of the slices placed between them can be found by interpolation using coordinate data of two slices whose coordinates have been determined.

(3) Computer Readable Recording Media Containing Each Fiber Unit within a Fiber Alignment Slice Coordinate data of fiber units of a fiber alignment slice as determined above can be used in a form recorded in a computer readable recording medium. Examples of coordinate data are coordinates which have been determined based on the base coordinates for every fiber alignment slice and plotted on a table. Recording media which can be used herein include magnetic disks, floppy disks, magnetic tapes, CD-ROM, IC cards, and RAM. Registering before measurement of a slice of fiber alignments these coordinate data in a computer which works in combination with a detector enables the computer to automatically recognize which fiber unit corresponds to which probe of biological substances.

9. A Set Comprising Slices of Fiber Alignments and a Recording Medium Containing Coordinate Data of Fiber Units In this invention, a set of a fiber alignment slice for detecting biological substances can be produced, wherein the set comprises slices of fiber alignments obtained in 7 above and a recording medium obtained in 8 above containing coordinate data of each fiber unit within the fiber alignment slice. For example, this invention can provide a fiber alignment slice set for *E. coli* genotype analysis, comprising 100 slices of a fiber alignment for analyzing *E. coli* genotype, and a magnetic disk which contains coordinate data of positions of each fiber unit within an individual slice of a fiber alignment plotted on a table.

10. Hybridization and Detection of Samples

Slices of this invention can be used for detection of a certain substance (a substance that interacts with a biological substance) in samples by hybridization with samples using immobilized biological substances as probes.

Probes in this invention widely mean immobilized biological substances which can specifically bind with biological substances which are present in samples, such as proteins and low molecular compounds. Probes in this invention narrowly mean nucleic acids having a nucleotide sequence complementary to that of a gene to be detected. That is, nucleic acids in a sample having a nucleotide sequence of interest in samples can be detected by allowing the slices of this invention to react with samples (hybridization), causing formation of hybrids of probes and nucleic acids present in the samples.

Known techniques can be employed for detecting nucleic acids which form hybrids with immobilized nucleic acids and various biological components which bind specifically to immobilized nucleic acids. For example, biological substances in samples are labeled with fluorescent substances, emission substances, radio isotopes or the like, and then the labeled substances can be detected. Types of and methods for introduction of these labels are not specifically limited, and for which various standard means can be applied.

Slices for which hybrids are formed by the above mean as described above can be examined by a fluorescence microscopy.

Therefore, applications of slices of this invention are not only for detecting nucleic acids which form hybrids with immobilized nucleic acids (probes), but also for detecting various samples (including biological components), such as proteins and low molecular compounds which specifically bind to immobilized nucleic acids.

Types and forms of those containing probes of this invention are not specifically limited so far as the methods of this invention can be applied thereto. Examples of such biological substances as probes include deoxyribonucleic acid (DNA), ribonucleic acid (RNA), peptide nucleic acid, protein (e.g. enzyme and antibody), antigen, and polysaccharide.

Formation of hybrids of probes and samples is performed preferably by physical or chemical treatment rather than by free diffusion. For example when samples have charge, hybridization of the samples and probes can be efficiently performed by applying voltage. Alternatively, one surface of a slice (front or back) is allowed to contact with water absorbing substances (e.g. filter, sponge, and water absorbing resin), so that hybrid formation can be facilitated because water moves from the other surface towards the absorbing substances. Especially when fibers making up a slice are hollow fibers, this method is efficient.

When voltage is applied to both front and back faces of a slice (or called a biological substance chip) of this invention to perform hybridization of samples and probes, examples of devices include, but are not limited to, a sub-marine type electrophoretic bath (FIG. 7) and a blotting device (FIG. 8). Analytes are intimately adhered to biological substance chips by e.g. allowing the samples to adsorb to filters or membranes or high molecular polymers, such as acrylamide or agarose, to enclose the samples. Next, voltage is applied for a certain period of time, and then positions at which hybridization occurs are identified using a detector. In addition, water-absorbing substances are arranged on the one side of a biological substance chip, thereby allowing samples arranged on the opposite face to move towards the inside of the chip and binding reaction to proceed. Examples of these water-absorbing substances include sponge and paper.

Now, a detailed description of detection of total RNA which is derived from cells will be given as follows.

(1) Preparation of Total RNA from Cells

Total RNA can be prepared from cells by standard techniques [e.g. see Sambrook, J et al., *Molecular Cloning*, Cold Spring Harbor Laboratory Press (1989)]. Commercially available kits (e.g. RNeasy Total RNA KIT (Qiagen)) can also be used for this preparation.

Total RNA obtained by the above technique is labeled with e.g. fluorescent substances or radioactive substances in order to enable detection of the total RNA. For fluorescent labeling, for example fluorescein (FITC), sulforhodamine (TR), and tetramethylrhodamine (TRITC) can be used.

(2) Hybridization

The total RNA labeled as described above is hybridized to the slice of fiber alignments produced in 7 above. Conditions for hybridization should be optimized depending on the type of a probe immobilized on a slice of a fiber alignment. That is, conditions to be determined should allow probes on a slice of a fiber alignment to hybridize only with nucleotide sequences having high homology with the probes. For example, when hybridization is performed by immersing a slice of fiber alignments in a total RNA solution, salt concentration (e.g. concentration of NaCl, or trisodium citrate), temperature and time and the like of the solution upon hybridization and washing are set so that probes hybridize only with nucleotide sequences having high homology with the probes. In addition, lower salt concentration or higher temperature can accelerate the formation of hybrids with high homology.

(3) Detection

A double strand formed on a slice of fiber alignments by hybridization is analyzed with RI or a fluorescent image scanner. At this time, positions of each fiber unit on the slice of fiber alignments are recognized based on the coordinate data of each fiber unit obtained in 8 above. Fluorescence intensity on the slice of fiber alignments can be automatically measured using a device combining fluorescent laser microscopy, a CCD camera, and a computer. A preferred scanner can quantitatively distinguish between spots located about 10 to 1000 μm apart from each other when a diameter of each fiber unit is approximately 10 to 500 μm. Further, a preferred scanner can recognize multiple types of labels, scan a wide area at high speed and possesses an autofocus function which can adapt micro distortion of a substrate. A scanner provided with such functions is GMS 418 Array Reader (Micro Systems (GMS)). Preferred software for data analysis can be used for complex analysis, such as analysis for mutations or polymorphism containing many oligonucleotides with partially overlapping sequences

EXPLANATION FOR SYMBOLS

Figure 1:
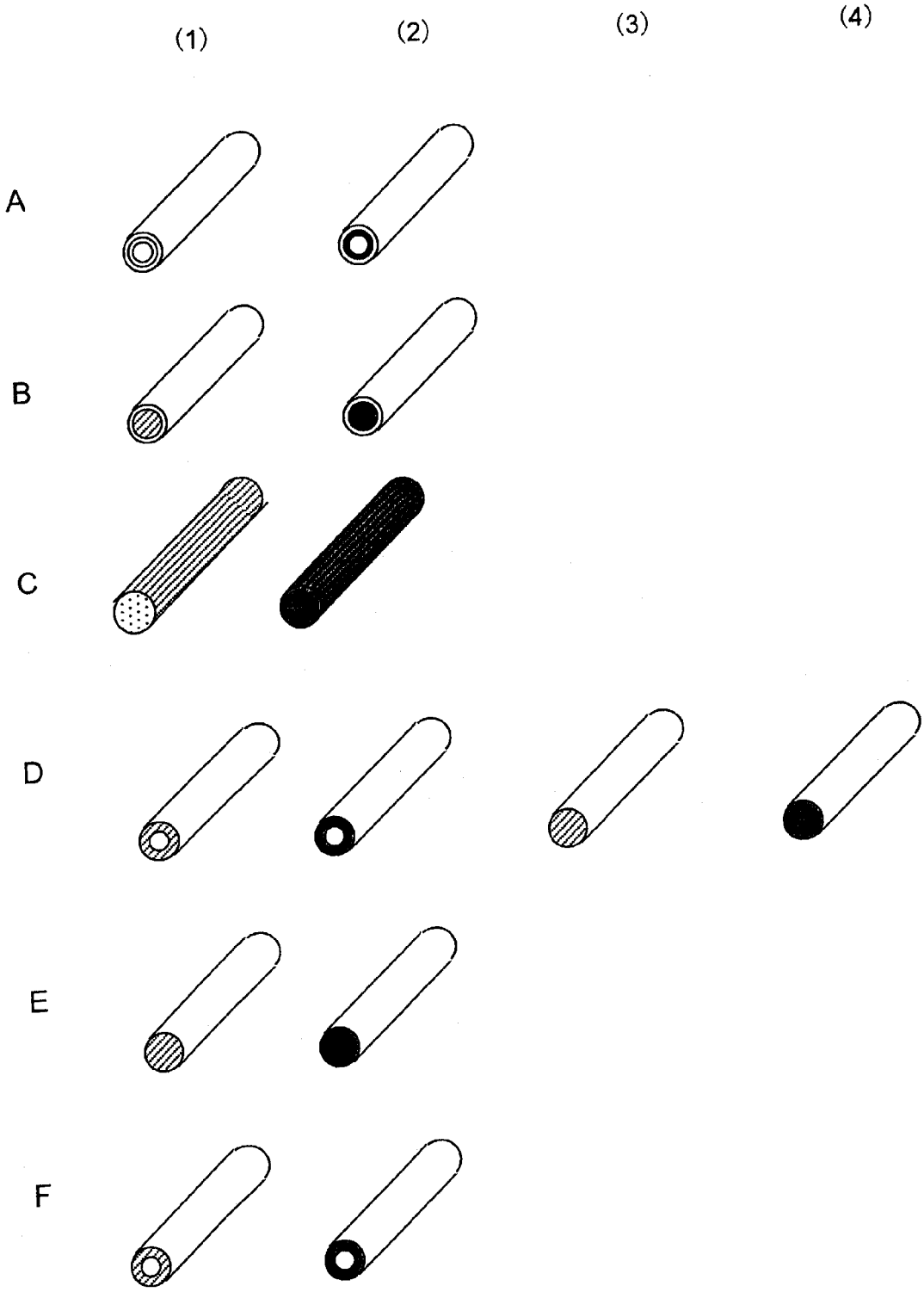
FIG. 1 A to F is a schematic diagram showing a nucleic acid-immobilized fiber (hollow fiber, porous fiber, porous hollow fiber, hollow fiber retaining gel, porous fiber retaining gel, and porous hollow fiber retaining gel).

11 . . . perforated plate
12 . . . hollow fiber
21 . . . support line group
22 . . . hollow fiber
31 . . . hollow fiber alignments (immobilized with resin)
32 . . . hollow fiber not immobilized with resin

33 . . . vessels containing biological substances
34 . . . continuing face

BEST MODE FOR CARRYING OUT THE INVENTION

Now the present invention will be further described by using the following Examples. However the technical scope of this invention is not limited by these Examples.

Reference 1

Pretreatment of Hollow Fiber (1):

Pretreatment of a hollow fiber was performed as follows. Formic acid (0.1 ml, 99% purity) at room temperature was injected into about 1 m of the centrum of nylon hollow fiber (outer diameter: about 300 μm) and held for 10 sec. Then, a large amount of water at room temperature was injected into the centrum to thoroughly wash, hollowed by drying.

Reference 2

Pretreatment of Hollow Fiber (2):

Pretreatment of nylon hollow fiber was performed in the same manner as in Reference 1 except the use of 10% ethanol solution of sulfuric acid instead of formic acid (99% purity).

Reference 3

Preparation of Oligonucleotides Having Amino Groups or Biotin at the 5' Termini Thereof.

The following oligonucleotides (probes A and B) were synthesized.

Probe A: GCGATCGAAACCTTGCTGTACGAGC-GAGGGCTC (SEQ ID NO: 1)

Probe B: GATGAGGTGGAGGTCAGGGTTTGGGA-CAGCAG (SEQ ID NO: 2)

Oligonucleotides were synthesized using an automatic synthesizer, DNA/RNA synthesizer (model 394, PE Biosystems). At the final step of DNA synthesis, $NH_2(CH_2)_6$— was introduced at the 5' terminus of each oligonucleotide using Amino Link II (Trademark, Applied Biosystems), and then the aminated probe and a probe biotinated with biotinamidide were prepared. These probes were used after deprotection and purification by general techniques.

Example 1

Preparation of Nucleic Acid-Immobilized Hollow Fiber (1)

The oligonucleotides (probes A and B) having amino groups prepared in Reference 3 were each immobilized to the inside of the nylon hollow fiber pretreated in References 1 and 2.

Figure 2:
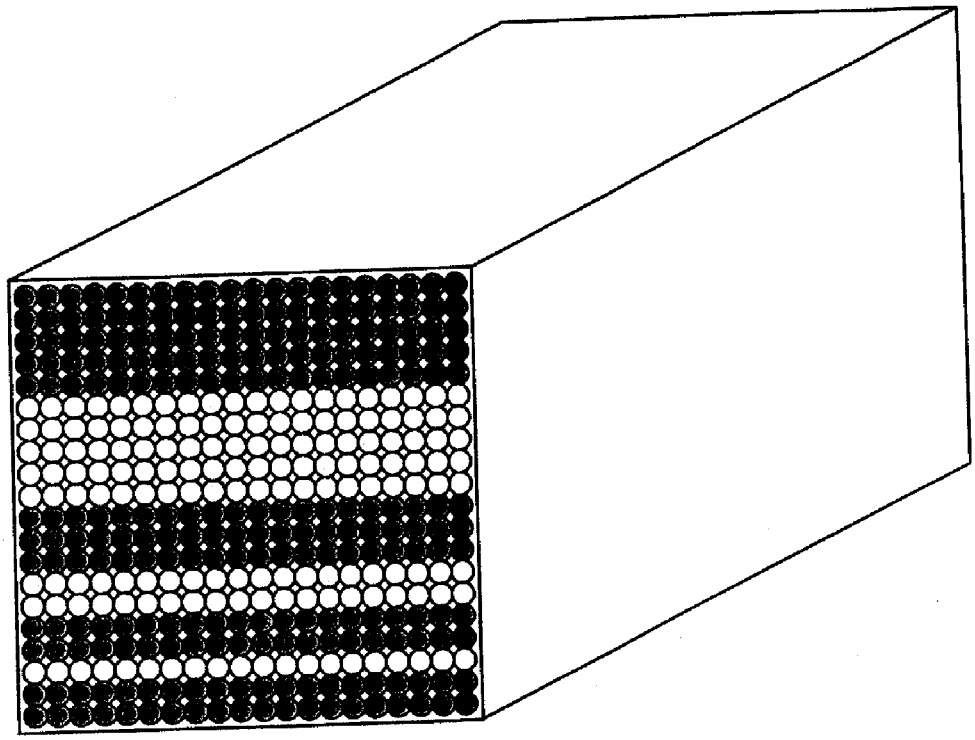
FIG. 2 shows a schematic diagram showing a nucleic acid-immobilized fiber alignment which comprise two types of nucleic acid-immobilized fibers.

A solution prepared by adding oligonucleotides having amino groups prepared in Reference 3 (0.1 to 30 mM) to 10 mM potassium phosphate buffer (pH 8) was injected into the nylon hollow fiber pretreated in References 1 and 2. After overnight reaction at 20° C., the hollow fiber was washed with 10 mM potassium phosphate buffer (pH 8), 1M potassium phosphate solution (pH 8), 1M KCl solution, and water, thereby obtaining a nucleic acid-immobilized hollow fiber in which oligonucleotides were immobilized on the inner wall of the hollow fiber (FIG. 1 A). FIG. 1A shows (1) probe A-immobilized hollow fiber and (2) probe B-immobilized hollow fiber. In FIG. 2, probe A-immobilized bundles of fiber are shown with white circles (○); probe B-immobilized bundles of fiber are shown with black circles (●).

Example 2

Preparation of Nucleic Acid-Immobilized Hollow Fiber (2)

The oligonucleotides (probes A and B) having amino groups prepared in Reference 3 were each immobilized by the following method to the inside of the nylon hollow fiber pretreated in References 1 and 2.

A solution (2500 μl) of the oligonucleotide having amino groups prepared in Reference 3 (nucleic acid concentration: 10 μg/ml, phosphate buffer-normal saline solution containing 0.1M $MgCl_2$ was used as a solvent) and 0.06 g of 1-ethyl-3-(3-dimethylaminopropyl)-carbodiimide (EDC) were nixed. Then the mixture was injected into the nylon hollow fiber pretreated in References 1 and 2. Then, the hollow fiber was washed with 1/15 mol/l phosphate buffer (pH 8.0), immersed in 5 ml of the same buffer, and then to which 0.12 g of EDC was added, followed by shaking at room temperature for 3 hours. Next the hollow fiber was further washed with 1/15 mol/l phosphate buffer (pH 8.0). Hence, nucleic acid-immobilized hollow fiber was obtained, in which oligonucleotides were immobilized on the inner wall of the hollow fiber.

Example 3

Preparation of a Nucleic Acid-Immobilized Fiber Alignment

Twenty probe-A immobilized nylon fibers (pretreated in Reference 1, 20 cm long) obtained in Example 1 were aligned on a Teflon plate, close to but without overlapping with one another, and then fixed at both ends. To this plate was applied, a thin coat of a polyurethane resin adhesive (manufactured by Nippon Polyurethane Industry Co., Ltd, coronate 4403, nippolan 4223). After the polyurethane resin had sufficiently solidified, the fibers were removed from the Teflon plate, so as to obtain a sheet like product on which probe A-immobilized fibers were arranged in line. In the same manner, a sheet like product was also obtained for probe B-immobilized fibers. Then, twenty sheet-shaped products were laminated so as to form sequences as shown in FIG. 2, and then adhered using the above adhesive. Thus, a nucleic acid-immobilized fiber alignment was obtained, which contained a total of 400 fibers (20 fibers long and 20 fibers wide) being regularly arranged to form a square.

In the same manner, nucleic acid-immobilized fiber alignments were obtained from each of the fibers subjected to surface treatment in Reference 2.

Furthermore in the same manner, nucleic acid-immobilized fiber alignments were obtained from the nucleic acid-immobilized fibers obtained in Example 2.

Example 4

Preparation of Nucleic Acid-Immobilized Fiber Alignments

Twenty each of two types of probe A-immobilized nylon hollow fiber (20 cm long) obtained in Example 1 differing in their surface treatment were aligned on a Teflon plate, close to but without overlapping with one another, and then fixed at both ends. To this plate was applied, a thin coat of a polyurethane resin adhesive (manufactured by Nippon Polyurethane Industry Co., Ltd., coronate 4403, nippolan 4223). After the polyurethane resin had sufficiently solidified, the fibers were removed from the Teflon plate, so as to obtain a sheet like product on which probe A-immobilized fibers were arranged in line. In the same manner, a sheet like product was also obtained for probe B-immobilized fibers.

Figure 3:
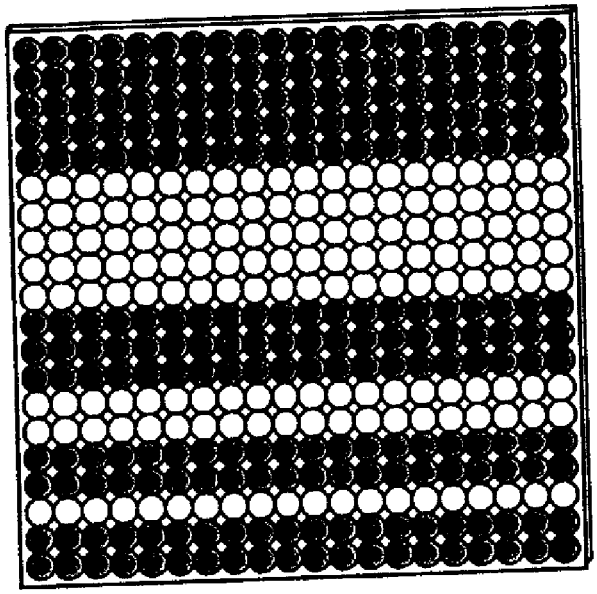
FIG. 3 is a schematic diagram showing a slice of a nucleic acid-immobilized fiber alignment. This is a cross-sectional view where the nucleic acid-immobilized fiber alignment is cut perpendicular to the fiber axis.
Figure 4:
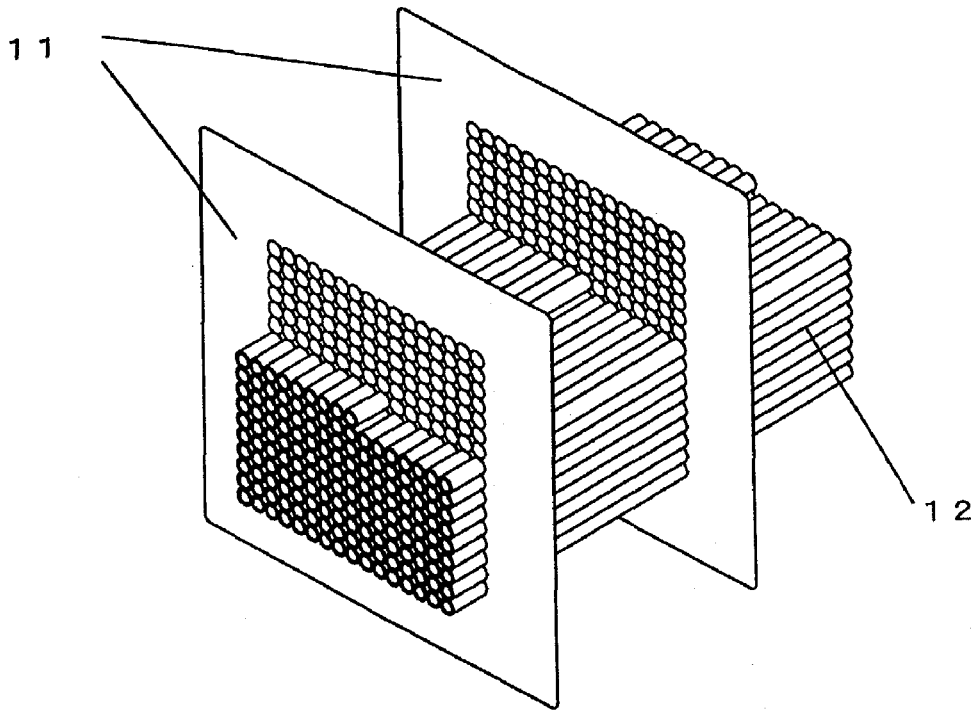
FIG. 4 is a schematic diagram showing a method for producing a fiber alignment where perforated plates are used as jigs.
Figure 5:
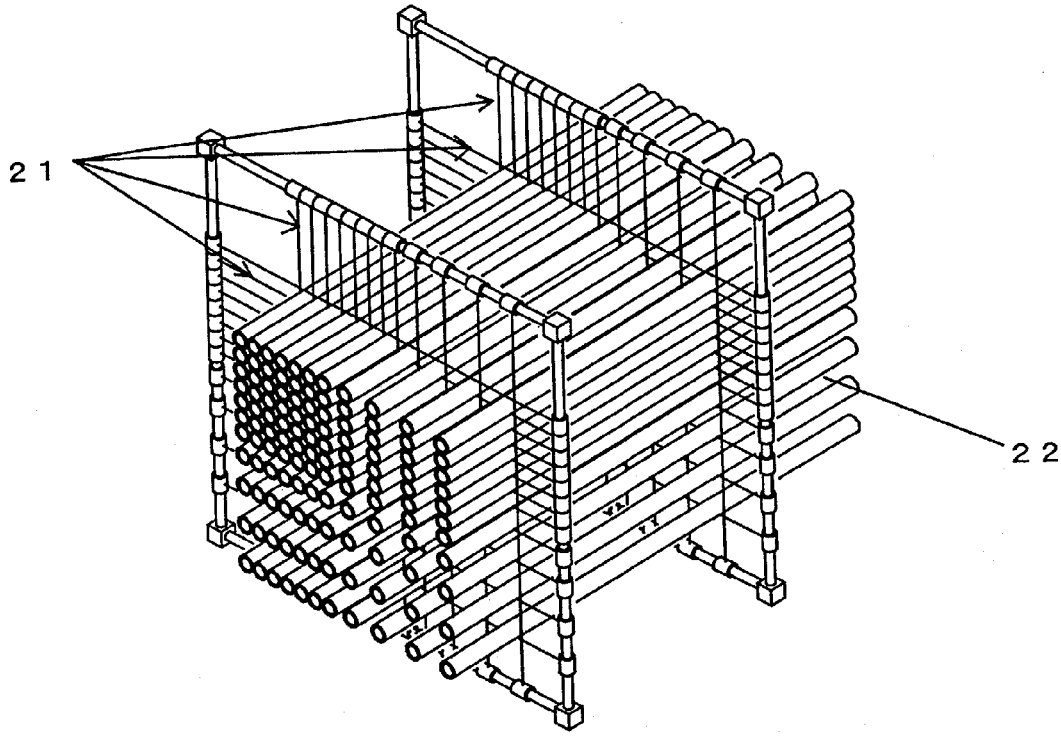
FIG. 5 is a schematic diagram showing a method for producing fiber alignments where groups of support lines composing a net are used as jigs.
Figure 6:
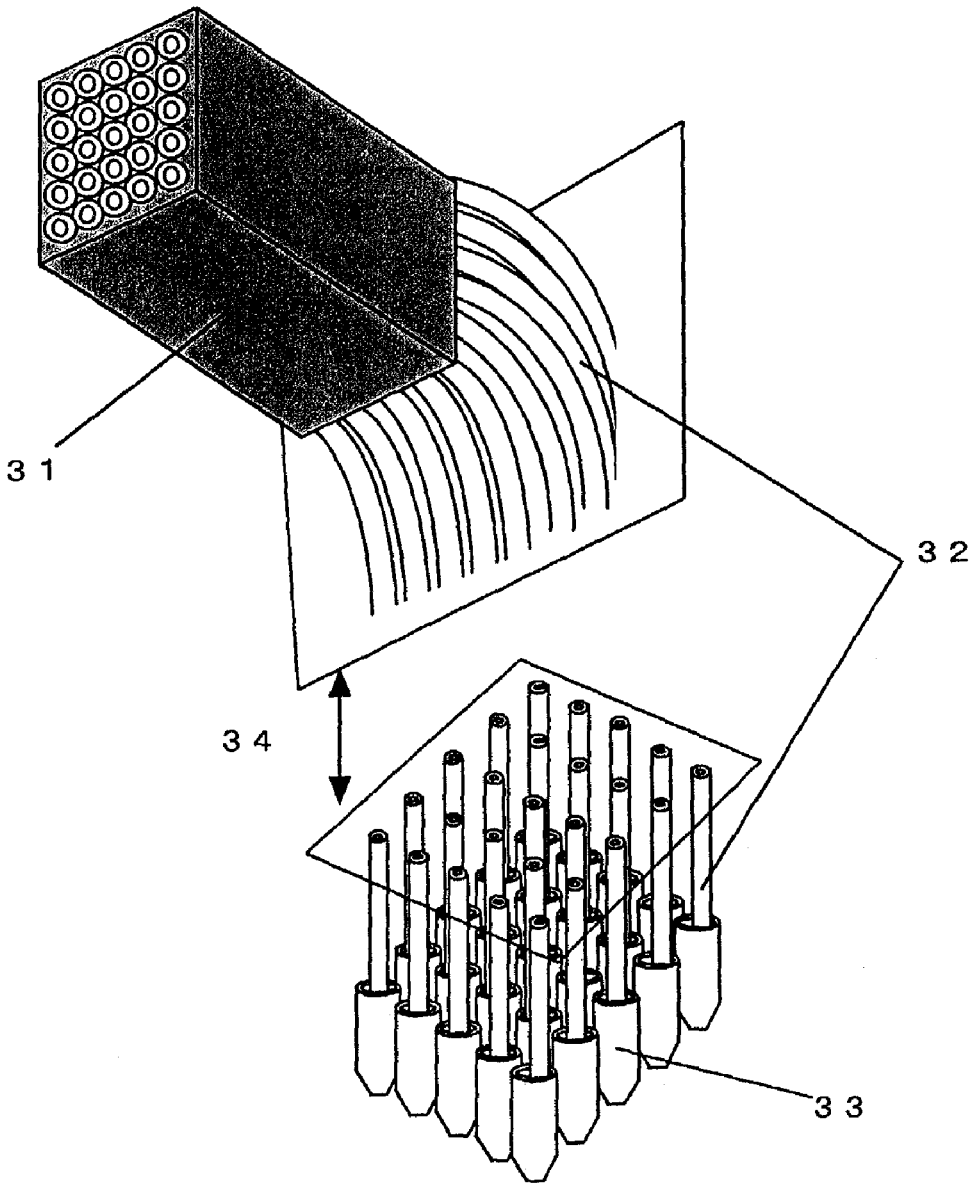
FIG. 6 is a schematic diagram of steps to introduce biological substances into the inside of hollow fiber alignments.
Figure 7:
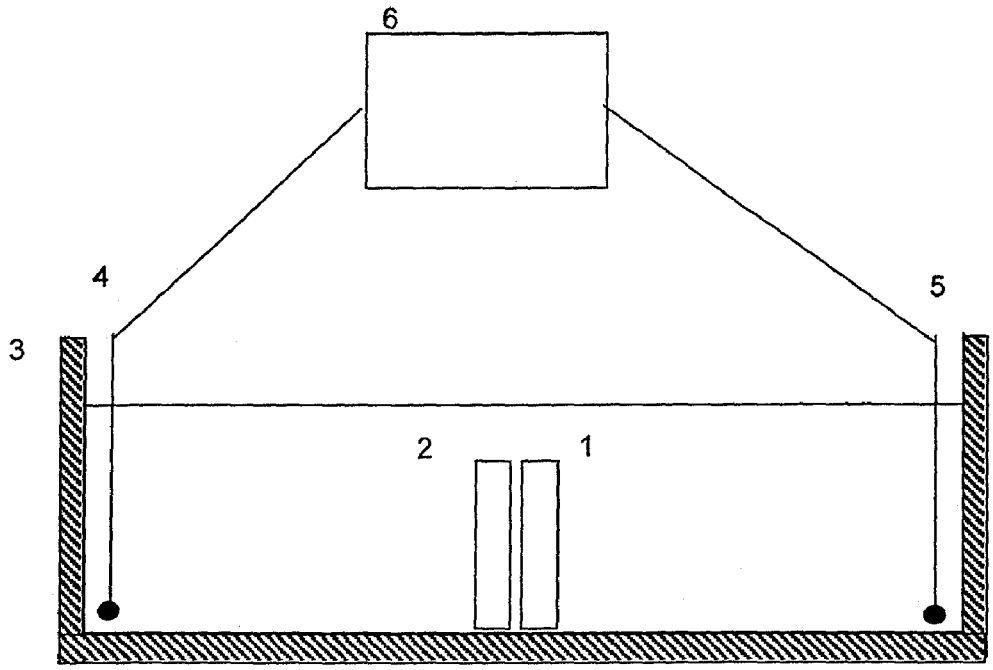
FIG. 7 shows a submarine type electrophoretic bath.
Figure 8:
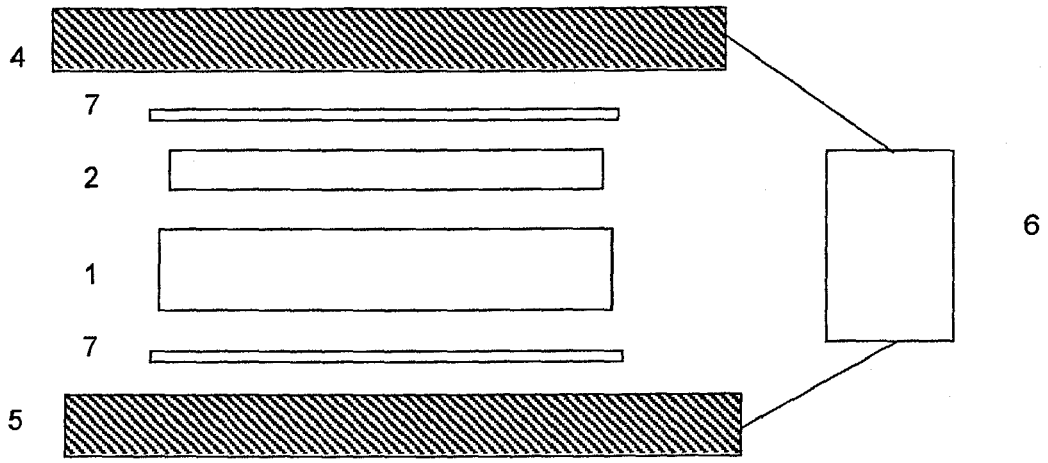
FIG. 8 shows a blotting device.

Next sheet-shaped products were prepared from fibers subjected to the same surface treatment. The products were sheet-shaped products consisting of probe A-immobilized fibers, those consisting of probe B-immobilized fibers, and those comprising probe B-immobilized fibers as a part thereof and probe A-immobilized fibers as the other part of the fibers constituting a line of fiber alignments. As shown in FIG. 2, twenty of these sheet-shaped products were laminated and then adhered using the above adhesive. Thus, a two-type of nucleic acid-immobilized fiber alignment was obtained, each of which contained total 400 fibers (20 fibers long and 20 fibers wide) being regularly arranged to form a square (FIG. 3).

In the same manner, 4 types of nucleic acid-immobilized hollow fiber alignments were obtained from the nucleic acid-immobilized hollow fibers obtained in Examples 2 and 3.

Example 5

Preparation of Slices of Nucleic Acid-Immobilized Fiber Alignments

The 100 μm thick nucleic acid-immobilized fiber alignments obtained in Example 4 were cut perpendicular to the fiber axis using a microtome. Thus a slice of a nucleic acid-immobilized fiber alignment was obtained, containing total 400 fibers (20 fibers long and 20 fibers wide) being regularly arranged to form a square (FIG. 3).

Reference 4

Labeling of Sample Nucleic Acid:

As a nucleic acid sample model, oligonucleotides (C, D) were synthesized to be complementary to part of the oligonulcleotide (probes A and B) sequences synthesized in Reference 3.

Oligonucleotide C: GAGCCCTCGCTCGTACAGCAAGGTTTCG (SEQ ID NO: 3)

Oligonucleotide D: CTGCTGTCCCAAACCCTGACCTCCACC (SEQ ID NO: 4)

$NH_2(CH_2)_6$— was introduced to each of the 5' termini of these oligonulcleotides using Amino Link II (trademark, PE Biosystems) in the same manner as in Reference 3. Then, the products were labeled with Digoxygenin (DIG, Roche Diagnostics) as follows.

The oligonucleotides with aminated termini were each dissolved in 100 mM boric acid buffer (pH 8.5) to a final concentration of 2 mM. Equivalent amount of Digoxygenin-3-0-methylcarbonyl-ε-aminocapronic acid-N-hydroxy-succinimide ester (26 mg/ml dimethylformamide solution) was added to the solution, and then allowed to stand at room temperature overnight.

The amount of the above solution was adjusted to 100 μl, and then to which 2 μl of glycogen (Roche Diagnostics), 10 μl of 3M sodium acetate (pH5.2), and 300 μl of cold ethanol were added. The mixture was centrifuged at 15,000 rpm for 15 min, thereby collecting the precipitate. 500 μl of 70% ethanol was added to the precipitate, and then centrifuged at 15,000 rpm for 5 min, thereby collecting again the precipitate at the bottom of the tube. The precipitate was air-dried, and then dissolved in 100 μl of 10 mM Tris-HCl (pH 7.5) and 1 mM EDTA.

Thus the obtained DIG-labeled oligonucleotides were used as nucleic acid sample models.

Example 6

Preparation of a Hollow Fiber Retaining Nucleic Acid-Immobilized Gel (1)

A solution containing the oligonucleotides having biotin groups at the 5' termini obtained in Reference 3 was prepared to have the following composition.

| | |
|---|---|
| Acrylamide | 3.7 part by weight |
| Methylene bisacrylamide | 0.3 part by weight |
| 2,2'-azobis(2-amidinopropane)dihydrochloride | 0.1 part by weight |
| biotinated oligonucleotide (probe A or B) | 0.005 part by weight |
| avidinated agarose (6%) suspension | 1.0 part by weight |

The solution was injected into the centrum of the nylon hollow fiber pretreated in References 1 and 2 (outer diamter: 300 micron). Then, the hollow fiber was transferred in a closed glass container saturated with water vapor, and then polymerization reaction was allowed to proceed at 80° C. for 4 hours.

Thus a hollow fiber internally retaining gel to which oligonucleotides (probe A or B) were immobilized by biotin-avidin binding (FIG. 1 B) was obtained.

FIG. 1B shows (1) hollow fiber retaining probe A-immobilized gel and (2) hollow fiber retaining probe B-immobilized gel. In (3) and (4), probe A-immobilized bundles of fiber are shown with white circles (○); probe B-immobilized bundles of fiber are shown with black circles (●).

Example 7

Preparation of Hollow Fiber Retaining Nucleic Acid-Immobilized Gel (2)

A hollow fiber retaining nucleic acid-immobilized gel was obtained by the same manner as Example 1 except that instead of nylon hollow fiber, polyethylene hollow fiber (outer diameter: about 300 μm, the surface was coated with polyethylene-vinyl alcohol copolymer) whose surface has been treated to have hydrophilia was used.

Example 8

Preparation of Hollow Fiber Alignments Retaining Nucleic Acid-Immobilized Gel Twenty nylon hollow fibers retaining probe A immobilized gel (20 cm long, the surface has been treated as in Reference 1) obtained in Example 6 were aligned on a Teflon plate, close to but without overlapping with one another, and then fixed at both ends. To this plate was applied, a thin coat of a polyurethane resin adhesive (manufactured by Nippon Polyurethane Industry Co., Ltd., coronate 4403, nippolan 4223). After the polyurethane resin had sufficiently solidified, the fibers were removed from the Teflon plate, so as to obtain a sheet like product on which hollow fibers retaining probe A-immobilized gel were arranged in line. In the same manner, sheet like products were also obtained from hollow fibers retaining probe B-immobilized gel. As shown in FIG. 2, twenty of these sheets were laminated and then adhered using the above adhesive. Thus, a hollow fiber alignment retaining nucleic acid-immobilized gel was obtained, containing total 400 fibers (20 fibers long and 20 fibers wide) being regularly and squarely arranged.

In the same manner, hollow fiber alignments retaining nucleic acid-immobilized gel were obtained from the fibers subjected to surface treatment in Reference 2.

Further in the same manner, hollow fiber alignments retaining nucleic acid-immobilized gel were obtained from the hollow fiber retaining nucleic acid-immobilized gel obtained in Example 7.

Example 9

Preparation of Slices of Hollow Fiber Alignments Retaining Nucleic Acid-Immobilized Gel The 100 μm thick hollow fiber alignments retaining nucleic acid-immobilized gel obtained in Example 8 was cut perpendicular to the fiber axis using microtome, thereby obtaining a slice of hollow fiber alignments retaining nucleic acid-immobilized gel, which slice comprised total 400 fibers (20 fibers long, 20 fibers wide) arranged regularly to form a square cross section (FIG. 3).

Example 10

Preparation of Fiber Retaining Nucleic Acid-Immobilized Gel

An aqueous solution containing the oligonucleotides having biotin groups at the 5' termini obtained in Reference 3 was prepared to have the following composition.

| | |
|---|---|
| Acrylamide | 3.7 part by weight |
| Methylene bisacrylamide | 0.3 part by weight |
| 2,2'-azobis(2-amidinopropane)dihydrochloride | 0.1 part by weight |
| biotinated oligonucleotide (probe A or B) | 0.005 part by weight |
| avidinated agarose (6%) suspension | 1.0 part by weight |

A cotton yarn made up of two doubling spun yarns (25 tex, previously washed with methylethylketone and dried) was immersed in this solution. Then the yarn was transferred into a closed glass container saturated with water vapor, and allowed to stand at 80° C. for 4 hours for polymerization reaction to proceed.

Thus fibers retaining gel to which oligonucleotides (Probe A or B) had been immobilized by biotin-avidin binding Were obtained (FIG. 1C). FIG. 1C shows (1) fiber retaining probe A- and nucleic acid-immobilized gel and (2) fiber retaining probe B- and nucleic acid-immobilized gel.

Example 11

Preparation of Fiber Alignments Retaining Nucleic Acid-Immobilized Gel

Twenty fibers retaining probe A-immobilized gel (20 cm long) obtained in Example 10 were aligned on a Teflon plate close to but without overlapping with one another, and then fixed at both ends. To this plate was applied, a thin coat of a polyurethane resin adhesive (manufactured by Nippon Polyurethane Industry Co., Ltd, coronate 4403, nippolan 4223). After the polyurethane resin had sufficiently solidified, the fibers were removed from the Teflon plate, so as to obtain a sheet like product on which fibers retaining nucleic acid-immobilized gel (to which probe A had been immobilized) were arranged in line. In the same manner, sheet like products were obtained from fibers retaining nucleic acid-immobilized gel to which probe B had been immobilized. Then, twenty sheets were laminated so as to form sequences as shown in FIG. 2, and then adhered using the above adhesive. Thus, a nucleic acid-immobilized fiber alignment was obtained, containing a total of 400 fibers (20 fibers long and 20 fibers wide) being regularly arranged to form a square cross section.

Example 12

Preparation of Slices of Fiber Alignments Retaining Nucleic Acid-Immobilized Gel The 100 μm thick fiber alignments retaining nucleic acid-immobilized gel obtained in Example 11 were cut perpendicular to the fiber axis using a microtome. Thus a slice of a fiber alignment was obtained, containing a total of 400 fibers (20 fibers long and 20 fibers wide) being regularly arranged to form a square (FIG. 3).

Example 13

A commercially available nylon porous hollow yarn membrane (the surface of which had been treated to have hydrophilia, about 0.6 mm of the outer diameter of hollow yarn) was immersed in an aqueous solution (10 mg/l nucleic acid concentration) of the oligonucleotides synthesized in Reference 3 (probe A or B; no amino group had been introduced at the final step). Then, the product was air-dried and then baked at 80° C. for 1 hour, thereby obtaining oligonucleotide(Probe A or B)-immobilized nylon porous hollow yarn membrane (FIG. 1D). FIG. 1 D shows (1) probe A-immobilized nylon porous hollow yarn, and (2) probe B-immobilized nylon porous hollow yarn.

Example 14

25 ml of oligonucleotide (Probe A or B, having an amino group at its 5' terminus) solution (10 mg/l nucleic acid concentration, phosphate buffer (pH 8.0) containing 0.1 mol/l magnesium chloride was used as a solvent), 0.6 g of 1-ethyl-3-(3-dimethylaminopropyl) carbodiimide, and 0.05 g of nylon porous hollow yarn membrane, which had been used in Example 1 and immersed in 5 ml of water, were mixed, and allowed to stand at room temperature for 10 min.

The mixture was washed with 50 mmol/l phosphate buffer (pH 8.0), and then immersed in 50 ml of the same buffer. 1.2 g of 1-ethyl-3-(3-dimethylaminopropyl) carbodiimide was added to the mixture, which was then allowed to stand at room temperature for 3 hours. Next, the mixture was washed with 50 mmol/l phosphate buffer (pH 8.0), so that oligonucleotide (probe A or B)-immobilized nylon porous hollow yarn membrane was obtained (FIG. 1D). FIG. 1 D shows (1) nucleic acid-immobilized porous hollow fiber in which probe A was immobilized to the porous portion, and (2) nucleic acid-immobilized porous hollow fiber in which probe B was immobilized to the porous portion.

Example 15

1 g of cyanogen bromide was dissolved in 2 ml of N,N-dimethylformamide. The solution was added to an aqueous solution containing 5 g of porous cellulose fiber (20 cm long), and allowed to stand at 15 to 20° C. for 10 to 20 min, while adding 5 mol/l sodium hydroxide solution to maintain pH within 10.5 to 11.5. After reaction, the mixture was washed with cold water with a volume 15-fold greater than the mixture. Finally, the mixture was washed with 10 mmol/l phosphate buffer (pH 8.0).

The resulting 10 mmol/l phosphate buffer containing porous cellulose fiber and the oligonucleotide (probe A or B, 0.1 to 30 mmol/l) having an amino group adjusted in Reference 3 were allowed to stand at 20° C. overnight for reaction to proceed. After reaction, the mixture was washed in turn with 10 mmol/l phosphate buffer (pH 8.0), 1 mmol/l phosphate buffer (pH 8.0), 1 mol/l potassium chloride solution, and water. Thus, oligonucleotide (probe A or B)-immobilized porous cellulose fiber was obtained (FIG. D(3) and (4)). FIG. 1D shows (3) nucleic acid-immobilized porous fiber in which probe A had been immobilized to the porous portion and (4) nucleic acid-immobilized porous fiber in which probe B had been immobilized to the porous portion.

Example 16

Twenty probe-A immobilized porous fibers obtained in Example 13 were aligned on a Teflon plate, close to but without overlapping with one another, and then fixed at both ends. To this plate was applied a thin coat of a polyurethane resin adhesive (manufactured by Nippon Polyurethane Industry Co., Ltd., coronate 4403. nippolan 4223). After the polyurethane resin had sufficiently solidified, the fibers were removed from the Teflon plate, so as to obtain a sheet like product on which nucleic acid-immobilized porous fibers were arranged in line.

In the same manner, sheet like products were obtained from probe B- and nucleic acid-immobilized porous hollow fiber. Then, twenty sheets were laminated so as to form sequences as shown in FIG. 2, and then adhered using the above adhesive. Thus, a nucleic acid-immobilized fiber alignment was obtained, which contained a total of 400 fibers (20 fibers long and 20 fibers wide) being regularly arranged to form a square.

Furthermore in the same manner, a nucleic acid-immobilized porous fiber alignment was obtained from each of the porous fibers obtained in Examples 14 and 15 (FIG. 2).

Example 17

The 0.1 mm thick nucleic acid-immobilized porous fiber alignment obtained in Example 16 containing two types of oligonucleotides was cut using a microtome, thereby obtaining a slice comprising a total of 400 nucleic acid-immobilized porous fibers (20 fibers long, 20 fibers wide) arranged regularly to form a square cross section (FIG. 3). Nucleic acids were immobilized on the slice at a density of approximately 220 per $cm^2$.

Example 18

Preparation of Porous Fiber Retaining Nucleic Acid-Immobilized Gel

An aqueous solution containing the oligonucleotides obtained in Reference 3 having biotin groups at the 5' termini was prepared to have the following composition.

| | |
|---|---|
| Acrylamide | 3.7 part by weight |
| Methylene bisacrylamide | 0.3 part by weight |
| 2,2'-azobis(2-amidinopropane)dihydrochloride | 0.1 part by weight |
| biotinated oligonucleotide (probe A or B) | 0.005 part by weight |
| avidinated agarose (6%) suspension | 1.0 part by weight |

Polyethylene porous fiber (outer diameter: 200 μm) was immersed in this solution, and then transferred into a closed glass container saturated with water vapor, and allowed to stand at 80° C. for 4 hours for polymerization reaction to proceed.

Thus porous fibers retaining gel within their spaces were obtained, wherein oligonucleotides (Probe A or B) had been immobilized by biotin-avidin binding to the gel (FIG. 1E). FIG. 1E shows (1) porous fiber retaining nucleic acid-immobilized gel, in which probe A was immobilized to the porous portion and (2) porous fiber retaining nucleic acid-immobilized gel, in which probe B was immobilized to the porous portion.

Example 19

Preparation of Porous Fiber Alignments Retaining Nucleic Acid-Immobilized Gel

Twenty porous fibers obtained in Example 18 retaining probe A- or probe B-immobilized gel were aligned on a Teflon plate, close to but without overlapping with one another, and the both ends were fixed. To this plate was applied, a thin coat of a polyurethane resin adhesive (manufactured by Nippon Polyurethane Industry Co., Ltd, coronate 4403, nippolan 4223). After the polyurethane resin had sufficiently solidified, fibers were removed from the Teflon plate, so as to obtain a sheet like product on which porous fibers retaining probe A- and nucleic acid-immobilized gel were arranged in line. In the same manner, sheet like products were obtained for porous fibers retaining probe B- and nucleic acid-immobilized gel. Then, twenty sheets were laminated so as to form sequences as shown in FIG. 2, and then adhered using the above adhesive. Thus, a porous fiber alignment retaining nucleic acid-immobilized gel was obtained, comprising a total of 400 fibers (20 fibers long and 20 fibers wide) being regularly arranged to form a square.

Example 20

Preparation of Slices of Porous Fiber Alignment Retaining Nucleic Acid-Immobilized Gel The 100 μm thick porous fiber alignments obtained in Example 19 retaining nucleic acid-immobilized gel was cut perpendicular to the fiber axis using a microtome, thereby obtaining slices of a porous fiber alignment retaining nucleic acid-immobilized gel comprising a total of 400 fibers (20 fibers long, 20 fibers wide) arranged regularly to form a square cross section (FIG. 3).

Example 21

An aqueous solution A having the following composition was prepared. In this solution A, polyethylene porous hollow yarn membrane MHF200TL (Mitsubishi Rayon Co., Ltd., outer diameter: 290 μm, inner diameter: 200 μm) having a non-porous intermediate layer was immersed. Then the membrane was transferred into a closed glass container saturated with water vapor, and allowed to stand at 80° C. for 4 hours for polymerization reaction to proceed.

Thus the obtained porous hollow yarn membrane retained gel within the porous layer placed inner side of the centrum and the non-porous intermediate layer (FIG. 1 F). Here the gel contained oligonucleotides (probe A or B) immobilized through biotin-avidin binding thereto. FIG. 1 F shows (1) porous hollow fiber retaining nucleic acid-immobilized gel with probe A immobilized thereto, and (2) porous hollow fiber retaining nucleic acid-immobilized gel with probe B immobilized thereto.

| Solution A | |
|---|---|
| Acrylamide | 3.7 part by weight |
| Methylene bisacrylamide | 0.3 part by weight |
| 2,2'-azobis(2-amidinopropane)dihydrochloride | 0.1 part by weight |
| biotinated oligonucleotide (probe A or B) | 0.005 part by weight |
| avidinated agarose (6%) suspension | 1.0 part by weight |

Example 22

Twenty porous hollow fibers obtained in Example 21 retaining probe A-immobilized gel were aligned on a Teflon plate, close to but not overlapping with one another, and then fixed at both ends. To this plate was applied, a thin coat of a polyurethane resin adhesive (manufactured by Nippon Polyurethane Industry Co., Ltd, coronate 4403, nippolan 4223). After the polyurethane resin had sufficiently solidified, the fibers were removed from the Teflon plate, so as to obtain a sheet like product on which porous hollow fibers retaining nucleic acid-immobilized gel were arranged in line.

In the same manner, sheet-shaped products were obtained for porous hollow fiber retaining probe B-immobilized gel.

Then, twenty sheets were laminated so as to form sequences as shown in FIG. 2, and then adhered using the above adhesive. Thus, a porous hollow fiber alignment retaining nucleic acid-immobilized gel was obtained, comprising a total of 400 nucleic acid-immobilized porous fibers (20 fibers long and 20 fibers wide) being regularly arranged to form a square (FIG. 3).

Example 23

The 0.1 mm thick porous hollow fiber alignment retaining nucleic acid-immobilized gel obtained in Example 22 containing two types of oligonucleotides (probe A and B) was cut using microtome, thereby obtaining a slice comprising a total of 400 nucleic acid-immobilized porous fibers arranged regularly to form a square cross section (20 fibers long, 20 fibers wide) (FIG. 3). Nucleic acids were immobilized on the slice at a density of approximately 1100 per $cm^2$.

Example 24

Preparation of Porous Hollow Fiber

An aqueous solution A having the following composition was prepared. In this solution A, polyethylene porous hollow yarn membrane MHF200TL (Mitsubishi Rayon Co., Ltd., outer diameter: 290 μm, inner diameter: 200 μm) having a non-porous intermediate layer was immersed. Then the membrane was transferred into a closed glass container saturated with water vapor, and allowed to stand at 80° C. for 4 hours for polymerization reaction to proceed.

Thus the obtained porous hollow yarn membrane retained gel within the porous layer placed inside the centrum and the non-porous intermediate layer (FIG. 1 D). Here the gel contained oligonucleotides (probe A or B) immobilized through biotin-avidin binding thereto. FIG. 1 D shows (1) porous hollow fiber retaining probe A- and nucleic acid-immobilized gel, and (2) porous hollow fiber retaining probe B- and nucleic acid-immobilized gel.

| Solution A | |
|---|---|
| Acrylamide | 3.7 part by weight |
| Methylene bisacrylamide | 0.3 part by weight |
| 2,2'-azobis(2-amidinopropane)dihydrochloride | 0.1 part by weight |
| biotinated oligonucleotide (probe A or B) | 0.005 part by weight |
| avidinated agarose (6%) suspension | 1.0 part by weight |

Example 25

Preparation of Porous Hollow Fiber Alignments

Twenty porous hollow fibers obtained in Example 24 retaining probe A-immobilized gel were aligned on a Teflon plate close to but without overlapping with one another, and then fixed at both ends. To this plate was applied, a thin coat of a polyurethane resin adhesive (manufactured by Nippon Polyurethane Industry Co., Ltd., coronate 4403, nippolan 4223). After the polyurethane resin had sufficiently solidified, fibers were removed from the Teflon plate, so as to obtain a sheet like product on which porous hollow fibers retaining nucleic acid-immobilized gel were arranged in line.

In the same manner, sheet like products were obtained for porous hollow fibers retaining probe B-immobilized gel.

Then, twenty sheets were laminated so as to form sequences as shown in FIG. 2, and then adhered using the above adhesive. Thus, a porous hollow fiber alignment retaining nucleic acid-immobilized gel was obtained, comprising a total of 400 nucleic acid-immobilized porous fibers (20 fibers long and 20 fibers wide) being regularly arranged to form a square (FIG. 2)

Example 26

Preparation of Nucleic Acid-Immobilized Slices

The 0.1 mm thick porous hollow fiber alignments obtained in Example 25 retaining nucleic acid-immobilized gel containing two types of oligonucleotides (probe A and B) was cut using a microtome, thereby obtaining a slice comprising a total of 400 porous hollow fibers (20 fibers long, 20 fibers wide) retaining nucleic acid-immobilized gel arranged regularly to form a square cross section (FIG. 3). Nucleic acids were immobilized on the slice at a density of approximately 1100 per $cm^2$.

Example 27

Preparation of Nucleic Acid-Immobilized Slices and Detection of Nucleic Acid (1) Preparation of Chromosome DNA

*Rhodococcus rhodochrous* strain J1 was cultured in 100 ml of nutrient media (glucose 15 g, yeast extract 1 g, sodium glutamate 10 g, $KH_2PO_4$ 0.5 g, $K_2HPO_4$ 0.5 g, $MgSO_4.7H_2O$ 0.5 g/l, pH7.2) at 30° C. for 3 days, and then collected. Chromosomal DNA was prepared from the cells and used as a template for PCR. *Rhodococcus rhodochrous* strain J1 was deposited with National Institute of Bioscience and Human-Technology, Agency of Industrial Science and Technology (1-1-3, Higashi, Tsukuba-shi, Ibaraki-ken, Japan). The accession number received was FERM BP-1478.

(2) Preparation of Probes

Figure 9:
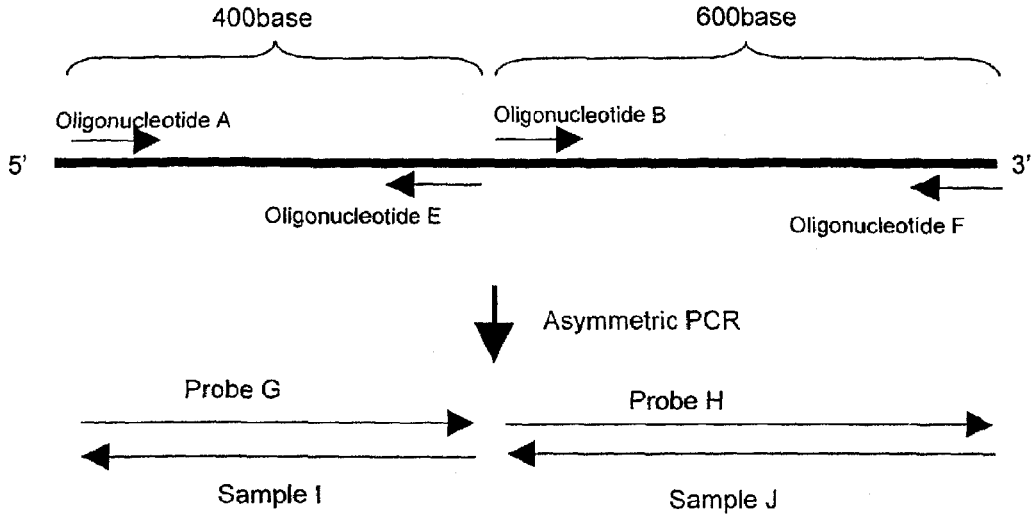
FIG. 9 shows positions of oligonucleotides which are synthesized for preparation of probes.

FIG. 9 shows the positions of oligonucleotides synthesized for preparation of probes. Oligonucleotide A (SEQ ID NO: 1) is located approximately 400 bases upstream of oligonucleotide B (SEQ ID NO: 2); oligonucleotide E (SEQ ID NO; 5) is located 400 bases upstream of oligonucleotide A; oligonucleotide F (SEQ ID NO: 6) is located 600 bases downstream of oligonucleotide B.

Oligonucleotide E: GCTCAAGCGC GATTTCGGTT TCGACATCCC C (SEQ ID NO: 5)

Oligonucleotide F: CATGTCGCGT CGTTGTTGGA CGAAGCGGTA (SEQ ID NO: 6)

Oligonucleotides prepared by modifying with acrylamide the 5' termini of oligonucleotides A and B (oligonucleotides having the 5' termini to which acrylamide had been added, WO98/39351) were synthesized (commissioned synthesis by Wako Pure Chemical Industries Co., Ltd), and used for PCR.

Asymmetric PCR (one primer is present in an excess amount relative to the other) was performed. Primer concentration prepared herein were oligonucleotide A with 5' modified with acrylamide: oligonucleotide E=100:1, or oligonucleotide B with 5' modified with acrylamide: oligonucleotide F=100:1. Other conditions were as described in the specification of Ex-Taq (Takara Shuzo Co., Ltd) and PCR was performed using TaKaRa PCR Thermal Cycler PERSONAL. Reaction was conducted for 40 cycles with 100 μl under temperature conditions consisting of 93° C. for 30 sec, 65° C. for 30 sec and 72° C. for 2 min.

The PCR resulted in amplification of approximately 400 bases (probe G: SEQ ID NO: 7) and 600 bases (probe H: SEQ ID NO: 8) of probe DNA with 5' modified with acrylamide.

(3) Preparation of Nucleic Acid-Immobilized Slices

Nucleic acid-immobilized slices were prepared in the same manner as in Examples 24 to 26 except that the probe DNA modified with acrylamide prepared in step (2) was used for immobilization of nucleic acid to gel. Following this change, the composition of solution A was changed as follows.

| Aqueous solution A | |
|---|---|
| Acrylamide | 3.7 part by weight |
| Methylene bisacrylamide | 0.3 part by weight |
| 2,2'-azobis(2-amidinopropane)dihydrochloride | 0.1 part by weight |
| Probe G (or Probe H) | 0.005 part by weight |

Probe G or H-immobilized gel was retained in the porous layer located on the inner side of the centrum and the non-porous intermediate layer of the obtained porous hollow yarn membrane.

Five porous hollow fibers retaining probe G-immobilized gel obtained as described above were aligned on a Teflon plate, close to but without overlapping with one another, and then fixed at both ends. To this plate was applied, a thin coat of a polyurethane resin adhesive (manufactured by Nippon Polyurethane Industry Co., Ltd., coronate 4403, nippolan 4223) to adhere said nucleic acid-immobilized porous hollow fibers. After polyurethane resin had sufficiently solidified, the fibers were removed from the Teflon plate, so as to obtain a sheet like product on which porous hollow fibers retaining nucleic acid-immobilized gel were arranged in line. In the same manner, sheet like products were obtained for probe H. In addition, similar sheet like products but to which no nucleic acid had been immobilized were prepared (blank).

Subsequently, 5 of these sheets were laminated in order of blank, probe G, blank, probe H and blank, and then adhered using the above adhesive. Thus, a porous hollow fiber alignment retaining nucleic acid-immobilized gel was obtained, comprising total 25 nucleic acid-immobilized porous fibers (5 fibers long and 5 fibers wide) being regularly arranged to form a square.

(4) Preparation of Fluorescent-Labeled Samples

To prepare a sample which hybridizes only to probe G, PCR was performed using oligonucleotides E and A, so that sample I (approximately 400 bases) was prepared. To prepare a sample which hybridizes only to probe H, PCR was performed using oligonucleotides F and B, so that sample J (approximately 600 bases) was prepared.

To fluorescently label the samples, oligonucleotides E and F with the 5' termini labeled with Cy5 (Cy5-oligonucleotide E, Cy5-oligonucleotide F) were synthesized (Amersham Pharmacia Biotech, OlidoExpress) and used for PCR.

Primer concentrations prepared for PCR were Cy5-oligonucleotide E: oligonucleotide A=100:1 or Cy5-oligonucleotide F: oligonucleotide B=100:1. Other conditions were as described in the specification of Ex-Taq (Takara Shuzo Co., Ltd) and PCR was performed using TaKaRa PCR Thermal Cycler PERSONAL. Reaction was conducted for 40 cycles with 100 μl under temperature conditions consisting of 93° C. for 30 sec, 65° C. for 30 sec and 72° C. for 2 min. The PCR resulted in amplification of approximately 400 bases (Sample I: SEQ ID NO: 9) and 600 bases (Sample J: SEQ ID NO: 10) of DNA.

Unreacted primers were removed from the solution following reaction using SUPEC-02 (Takara Shuzo Co., Ltd), and the solution was collected using GFX PCR DNA and Gel Band Purification Kit (Amersham Pharmacia Biotech).

(5) Hybridization

The nucleic acid-immobilized slices obtained in step (3) above were put in a bag for hybridization, to which hybridization solution was added, and then pre-hybridization was performed at 45° C. for 30 min. Next, fluorescent-labeled samples were added, followed by hybridization at 45° C. for 15 hours.

Following hybridization, the nucleic acid-immobilized slices were transferred into 50 ml of a pre-warned solution (0.1×SSC and 0.1% SDS). Then washing at 45° C. for 20 min was performed three times while shaking. Next, the solution was replaced with 0.5×SSC, and then observed with a fluorescence detector (fluorescence microscopy).

Therefore, specific hybridization of sample I to only probe G-immobilized porous fiber cross section, and of sample J to only probe H-immobilized porous fiber cross section were confirmed in the nucleic acid-immobilized slices.

Example 28

Preparation of Nucleic Acid-Immobilized Slices and Detection of Nucleic Acid (1) Preparation of Yeast (JCM7255) Chromosome DNA

*Saccharomyces cerevisiae* (JCM7255) was cultured in 100 ml of YPD media (glucose 20 g, yeast extract 10 g, polypeptone 20 g/l, pH 6.0) at 30° C. for 1 day, and then collected. Chromosome DNA was prepared from the cells, and used as templates for PCR.

(2) Preparation of Probes

Open reading frames (ORF) were randomly chosen from yeast gene groups, and the ORFs were amplified by PCR. Table 1 shows the relation between 4 types of probes (SEQ ID NOS: 11, 12, 13 and 14) and oligonucleotides used for PCR.

TABLE 1

| Probe | Primers for PCR | | Sample |
|---|---|---|---|
| Probe K (SEQ ID NO: 11) | Oligonucleotide O (SEQ ID NO: 15) | Oligonucleotide S (SEQ ID NO: 19) | Oligonucleotide W (SEQ ID NO: 23) |
| Probe L (SEQ ID NO: 12) | Oligonucleotide P (SEQ ID NO: 16) | Oligonucleotide T (SEQ ID NO: 20) | Oligonucleotide X (SEQ ID NO: 24) |
| Probe M (SEQ ID NO: 13) | Oligonucleotide Q (SEQ ID NO: 17) | Oligonucleotide U (SEQ ID NO: 21) | Oligonucleotide Y (SEQ ID NO: 25) |
| Probe N (SEQ ID NO: 14) | Oligonucleotide R (SEQ ID NO: 18) | Oligonucleotide V (SEQ ID NO: 22) | Oligonucleotide Z (SEQ ID NO: 26) |

Oligonucletides O, P, Q and R having their 5' termini modified with acrylamide were synthesized (commissioned synthesis by Wako Pure Chemical Industries). Asymmetric PCR (one primer is present in an excess amount to the other) was performed. When probe K was amplified, primer concentration prepared herein was oligonucleotide O with 5' modified with acrylamide: oligonucleotide P=100:1. Other conditions were as described in the specification of Ex-Taq (Takara Shuzo Co., Ltd) and PCR was performed using TaKaRa PCR Thermal Cycler PERSONAL. Reaction was conducted for 40 cycles with 100 μl under temperature conditions consisting of 93° C. for 30 sec, 65° C. for 30 sec, and 72° C. for 2 min. The PCR amplified approximately 600 bases (probe K: SEQ ID NO: 11) of probe DNA with 5' modified with acrylamide. In the same manner, probes L, M and N were amplified.

(3) Preparation of Nucleic Acid-Immobilized Slices

Nucleic acid-immobilized slices were prepared as in Examples 24 to 26, except using the acrylamide-modified probe DNA prepared in the above step (2) for immobilizing nucleic acid to gel. Accordingly, aqueous solution A was changed in composition as follows:

| Aqueous solution A | |
|---|---|
| Acrylamide | 3.7 part by weight |
| Methylene bis-acrylamide | 0.3 part by weight |
| 2,2'-azobis(2-amidinopropane) dihyrochloride | 0.1 part by weight |
| Probe K (or probes L, M, N) | 0.005 part by weight |

The thus obtained seven porous hollow fibers retaining probe K immobilized gel were aligned on a Teflon plate, close to but without overlapping with one another, and then fixed at both ends. To this plate was applied, a thin coat of a polyurethane resin adhesive (manufactured by Nippon Polyurethane Industry Co., Ltd., coronate 4403, nippolan 4223) to adhere said nucleic acid-immobilized porous hollow fibers. After the polyurethane resin had sufficiently solidified, the fibers were removed from the Teflon plate, so as to obtain a sheet like product on which porous hollow fibers were arranged in line. With probes L, M and N, similar products were obtained. In addition, a similar sheet like product was prepared without immobilizing nucleic acid (as a blank).

Then, these 7 sheet like products were laminated in order of blank, probe K, probe L, blank, probe N, probe M and blank, and adhered to each other with said adhesive, resulting in a porous hollow fiber alignment retaining nucleic acid-immobilized gel wherein 7 each in both longitudinal and transverse directions, i.e., 49 in total, of nucleic acid-immobilized porous hollow fibers were arranged regularly in a square.

(4) Preparation of Fluorescently Labeled Samples

Samples W (SEQ ID NO: 23) and Z (SEQ ID NO: 26) were prepared by synthesizing oligonucleotides labeled at 5'-terminus with Cy5, while samples X (SEQ ID NO: 24) and Y (SEQ ID NO: 25) by synthesizing those labeled at 5'-terminus with Cy3 (manufactured by Amasham Pharmacia Biotech, OlidoExpress) to use, all of which samples hybridize uniquely to their respective probes.

(5) Hybridization

The nucleic acid-immobilized slices prepared in the above step (3) were put in a bag for hybridization, into which a hybridization solution was poured to carry out pre-hybridization at 45° C. for 30 min. Subsequently, the fluorescently-labeled samples were added, followed by further hybridization at 45° C. for 15 hours.

After the hybridization was completed, the nucleic acid-immobilized slices were transferred into 50 ml of a pre-warmed solution of 0.1×SSC, 0.1% SDS, which was then washed with shaking 3 times, at 45° C. for 20 min for each. Thereafter, the solution was replaced by 0.5×SSC, and then the slices were observed by means of a fluorescence detector (fluorescence microscope).

As a result, it was found that sample W specifically hybridized only to the porous fiber section with probe K immobilized in the nucleic acid-immobilized slices, the sample X only to the porous fiber section with probe L immobilized, sample Y only to the porous fiber section with probe M immobilized thereon, and the sample Z only to the porous fiber section with the probe N immobilized thereon.

Example 29

(1) Hybridization

The nucleic acid-immobilized slices prepared in the Examples 5, 9, 12, 17, 20, 23 and 26 were put in a bag for hybridization, into which a hybridization solution having the following composition was poured to carry out pre-hybridization at 45° C. for 30 min.

Subsequently, DIG labeled DNA prepared in Reference 4 was added, followed by further hybridization at 45° C. for 15 hours.

Composition of Hybridization Solution:

5×SSC (0.75M sodium chloride, 0.075M sodium citrate, pH 7.0)

5% blocking reagent (Roche Diagnostic Systems)

0.1% sodium N-lauroyl sarcosinate 0.02% SDS (sodium lauryl sulfate)

50% formamide (2) Detection

After the hybridization was completed, the nucleic acid-immobilized slices were transferred into 50 ml of a solution of 0.1×SSC, 0.1% SDS which was then washed with shaking 3 times, at 45° C. for 20 min for each.

Thereafter, DIG buffer 1 was added and then, SDS was removed with shaking at a room temperature. This was repeated again before DIG buffer 2 was added and shaken for 1 hour. After removing the buffer, there was added 10 ml of solution containing 1/10,000 volumes of an anti-DIG alkaline phosphatase labeled antibody solution to DIG buffer 2, which was then gently shaken for 30 min so as to cause an antigen-antibody reaction. Next, this reaction solution was washed by shaking in DIG buffer 1 containing 0.2% Tween 20 for 15 min twice, and subsequently immersed in DIG buffer 3 for 3 min. After removing DIG buffer 3, 3 ml of DIG buffer containing AMPPD was added to equilibrate for 10 min.

After draining, the resultant solution was transferred into a new hybridization bag, which was then left at 37° C. for 1 hour and bound together with a X ray film by means of a binder for X ray film, which film was then sensitized.

As a result, it was found that in each of them, oligonucleotide C bound to the site where probe A was placed and oligonucleotide D to the site where probe B was placed.

DIG buffer 1: 0.1 M maleic acid, 0.15 M sodium chloride (pH 7.5).

DIG buffer 2: a buffer to which a blocking reagent is added at a concentration of 0.5%.

DIG buffer 3: 0.1 M Tris-hydrochloric acid (pH 9.5), 0.1 M sodium chloride, and 0.05 M magnesium chloride.

Blocking reagent: an anti-DIG alkaline phosphatase labeled antibody solution, AMPPD being a reagent included in DIG Detection kit (Roche-Diagnostic Systems).

Example 30

Preparation of Fiber Alignment Slices

In order to enable identification of each fiber unit, 10 fibers with a size of about 0.25 (mm) were prepared, respectively dyed in each of the following colors: orange, pink, light green, blue, green, blue-green, red, brown, white and yellow. These 10 fibers were suspended, with the orange and pink fibers being as base coordinates, at an appropriate interval in a plastic container having an about 10 mm×10 mm square and a length of 50 mm, into which polyurethane resin adhesive was filled and hardened to prepare a fiber alignment.

The resultant fiber alignment was taken out from the plastic container and sliced in a direction perpendicular to the axis of fiber using a microtome into slices having a thickness of 0.25 mm, to obtain fiber alignment slices.

Example 31

Determination of Fiber Unit Coordinates

As described below, fiber unit coordinates were determined. Namely, the fiber alignment slices obtained in Example 30 are numbered 1, 2, 3, . . . , m in order of being sliced off. In order to determine the two-dimensional coordinates of each fiber unit in the slices from the fiber alignment, Nos. 1 to 5 out of the resultant slices were placed on a projection microscope (Nikon PROFILER PROJECTOR V-12, with a magnifying power of 100) equipped with an XY stage capable of reading XY coordinates, followed by naked-eye reading of the coordinates, on the XY stage, of a position of center of gravity of the section of each fiber unit in the slice which was firstly sliced off. Based on the base coordinates of Slice No.1, the two-dimensional coordinates of each fiber unit in Slice No.1 were obtained according to the formulas (1) and (2). The coordinates thus determined are shown in Table 2.

TABLE 2

Two-dimensional coordinates of each fiber unit in Slice No. 1

| Fiber units as base | Slice No. 1 X (mm) | Slice No. 1 Y (mm) |
|---|---|---|
| coordinates in Slice No. 1 | | |
| Orange (P1) | 4.147 | 7.894 |
| Pink (P2) | 12.084 | 7.744 |
| θ 1 (radian) | −0.0189 | |

| Fiber unit | Coordinates on XY stage of fiber units in Slice No. 1 X (mm) | Coordinates on XY stage of fiber units in Slice No. 1 Y (mm) | Coordinates determined based on base coordinates of fiber units in Slice No. 1 X (mm) | Coordinates determined based on base coordinates of fiber units in Slice No. 1 Y (mm) |
|---|---|---|---|---|
| Light green | 6.636 | 4.056 | 2.561 | −3.790 |
| Blue | 6.062 | 5.182 | 1.966 | −2.675 |
| Green | 5.266 | 8.840 | 1.101 | 0.967 |
| Blue-green | 9.792 | 4.100 | 5.716 | −3.687 |
| Red | 9.866 | 4.998 | 5.773 | −2.787 |
| Brown | 10.876 | 7.463 | 6.736 | −0.304 |
| White | 8.044 | 9.870 | 3.859 | 2.049 |
| Yellow | 8.800 | 10.480 | 4.603 | 2.673 |

In order to determine the two-dimensional coordinates of each fiber unit in the slice secondly sliced off, this Slice No.2 was placed on a projection microscope equipped with an XY stage. From the coordinate data, determined based on the base coordinates of Slice No.1, of each fiber unit in the slice firstly sliced off, the coordinates of fiber units in Slice No.2, identical to the fiber units of Slice No.1, on the XY stage was obtained according to the formulas (3) and (4), and then, the XY stage was moved to the position of the coordinates thus determined. At this time, the color of fiber unit indicated that the fiber unit closest to the position of said coordinates was the same fiber unit as that in Slice No.1. After reading coordinates on the XY stage of a center of gravity of the section of a fiber unit closest to Slice No.2, on the basis of the base coordinates of Slice No.2, two-dimensional coordinates of fiber units in Slice No.2, identical to those in No.1, were obtained according to the formulas (1) and (2). The determined coordinates are shown in Table 3. As clearly seen from Table 3, the coordinates of each fiber unit obtained by calculation were approximate to those obtained by visual observation using the projection microscope, showing that the above method allows extremely accurate estimation of the coordinates of each fiber unit.

TABLE 3

Two-dimensional coordinates of each fiber unit in Slice No. 2

| Fiber units as base | Slice No. 2 X (mm) | Slice No. 2 Y (mm) |
|---|---|---|
| coordinates in Slice No. 2 | | |
| Orange (P3) | 3.893 | 19.277 |
| Pink (P4) | 11.738 | 20.350 |
| θ 2 (radian) | 0.1359 | |

| Fiber units | Coordinates corresponding to fiber units in No. 1, calculated according to formulas (3) and (4) X (mm) | Y (mm) | Coordinates on XY stage of fiber units in Slice No. 2 X (mm) | Y (mm) | Coordinates determined based on base coordinates of fiber units in Slice No. 2 X (mm) | Y (mm) |
|---|---|---|---|---|---|---|
| Light green | 6.944 | 15.869 | 6.910 | 15.870 | 2.527 | −3.784 |
| Blue | 6.203 | 16.893 | 6.160 | 16.885 | 1.922 | −2.677 |
| Green | 4.853 | 20.384 | 4.830 | 20.351 | 1.074 | 0.937 |
| Blue-green | 10.056 | 16.399 | 10.004 | 16.421 | 5.668 | −3.658 |
| Red | 9.990 | 17.298 | 9.943 | 17.306 | 5.727 | −2.773 |
| Brown | 10.608 | 19.889 | 10.545 | 19.858 | 6.669 | −0.326 |
| White | 7.439 | 21.830 | 7.443 | 21.819 | 3.862 | 2.037 |
| Yellow | 8.092 | 22.550 | 8.052 | 22.492 | 4.556 | 2.622 |

Similarly, the coordinate data of fiber units in Slice No.2 allowed us to obtain the two-dimensional coordinates of each fiber unit in the slice thirdly sliced off.

Same operations can be repeated as described above to obtain two-dimensional coordinates of fiber units contained in Slice No. m. At this time, in any of the slices with an identical fiber unit, according to the coordinate data, determined based on the base coordinates of Slice No. (n−1), of fiber units in the slice (n−1)thly sliced off, the fiber unit having the coordinate position on the XY stage in No. (n) slice being closest to the coordinates on the XY stage obtained by the formulas (3) and (4) was found, by the color of fiber unit, to be identical to the fiber unit in No. (n−1) slice. Further, it was also confirmed that where coordinates of a fiber unit determined based on the (n−1)th base coordinates in Slice No. (n−1) are the most approximate to those of a fiber unit determined based on the (n)th base coordinates in Slice No. (n), these fiber units are identical. Tables 4, 5 and 6 show the coordinates of fiber units in No. 3, 4 and 5 slices, respectively.

TABLE 4

Two-dimensional coordinates of each fiber unit in Slice No. 3

| Fiber units as base | Slice No. 3 X (mm) | Slice No. 3 Y (mm) |
|---|---|---|
| coordinates in Slice No. 3 | | |
| Orange (P3) | 4.66 | 30.414 |
| Pink (P4) | 12.575 | 30.399 |
| θ 2 (radian) | −0.0019 | |

TABLE 4-continued

Two-dimensional coordinates of each fiber unit in Slice No. 3

| Fiber units | Coordinates corresponding to fiber units in Slice No. 2, calculated according to formulas (3) and (4) X (mm) | Y (mm) | Coordinates on XY stage of fiber units Slice No. 3 X (mm) | Y (mm) | Coordinates determined based on base coordinates of fiber units in Slice No. 3 X (mm) | Y (mm) |
|---|---|---|---|---|---|---|
| Light green | 7.180 | 26.625 | 7.190 | 26.629 | 2.537 | −3.780 |
| Blue | 6.577 | 27.733 | 6.626 | 27.742 | 1.971 | −2.668 |
| Green | 5.736 | 31.349 | 5.730 | 31.339 | 1.068 | 0.927 |
| Blue-green | 10.321 | 26.745 | 10.315 | 26.736 | 5.662 | −3.667 |
| Red | 10.382 | 27.630 | 10.389 | 27.638 | 5.734 | −2.765 |
| Brown | 11.329 | 30.076 | 11.325 | 30.026 | 6.666 | −0.375 |
| White | 8.526 | 32.444 | 8.522 | 32.385 | 3.858 | 1.978 |
| Yellow | 9.221 | 33.027 | 9.212 | 32.992 | 4.547 | 2.587 |

TABLE 5

Two-dimensional coordinates of each fiber unit in No. 4 slice

| Fiber units as base | No. 4 slice X (mm) | No. 4 slice Y (mm) |
|---|---|---|
| coordinates in No. 4 slice | | |
| Orange (P3) | 15.506 | 7.738 |
| Pink (P4) | 23.356 | 7.173 |
| θ 2 (radian) | −0.0719 | |

| Fiber units | Coordinates corresponding to fiber units in Slice No. 3, calculated according to formulas (3) and (4) X (mm) | Y (mm) | Coordinates on XY stage of fiber units in No. 4 slice X (mm) | Y (mm) | Coordinates determined based on base coordinates of fiber units in No. 4 slice X (mm) | Y (mm) |
|---|---|---|---|---|---|---|
| Light green | 17.765 | 3.785 | 17.721 | 3.789 | 2.493 | −3.780 |
| Blue | 17.280 | 4.935 | 17.240 | 4.939 | 1.930 | −2.667 |
| Green | 16.638 | 8.586 | 16.623 | 8.549 | 1.056 | 0.889 |
| Blue-green | 20.890 | 3.674 | 20.846 | 3.700 | 5.616 | −3.644 |
| Red | 21.027 | 4.568 | 20.969 | 4.583 | 5.675 | −2.755 |
| Brown | 22.128 | 6.885 | 22.059 | 6.853 | 6.600 | −0.412 |
| White | 19.496 | 9.434 | 19.417 | 9.392 | 3.782 | 1.930 |
| Yellow | 20.227 | 9.992 | 20.177 | 9.977 | 4.498 | 2.569 |

TABLE 6

Two-dimensional coordinates of each fiber unit in No. 5 slice

| Fiber units as base | No. 5 slice X (mm) | No. 5 slice Y (mm) |
|---|---|---|
| coordinates in No. 5 slice | | |
| Orange (P3) | 15.78 | 18.445 |
| Pink (P4) | 23.575 | 18.323 |
| θ 2 (radian) | −0.0156 | |

TABLE 6-continued

Two-dimensional coordinates of each fiber unit in No. 5 slice

| | Coordinates corresponding to fiber units in No. 4, calculated according to formulas (3) and (4) | | Coordinates on XY stage of fiber units in No. 5 slice | | Coordinates determined based on base coordinates of fiber units in No. 5 slice | |
|---|---|---|---|---|---|---|
| Fiber units | X (mm) | Y (mm) | X (mm) | Y (mm) | X (mm) | Y (mm) |
| Light green | 18.213 | 14.627 | 18.195 | 14.662 | 2.474 | −3.745 |
| Blue | 17.668 | 15.748 | 17.634 | 15.768 | 1.896 | −2.648 |
| Green | 16.850 | 19.317 | 16.845 | 19.346 | 1.051 | 0.918 |
| Blue-green | 21.338 | 14.713 | 21.297 | 14.715 | 5.575 | −3.643 |
| Red | 21.412 | 15.602 | 21.375 | 15.624 | 5.638 | −2.733 |
| Brown | 22.372 | 17.929 | 22.309 | 17.904 | 6.537 | −0.439 |
| White | 19.592 | 20.316 | 19.581 | 20.301 | 3.771 | 1.915 |
| Yellow | 20.318 | 20.943 | 20.297 | 20.881 | 4.478 | 2.506 |

Example 32

Computer-Readable Recording Medium on which Fiber Unit Coordinate Data was Recorded A personal computer (manufactured by Nihon Denki Co., Ltd., Type PC9821) was used to record the coordinate data of individual fiber units in each fiber alignment determined in Example 31 in a floppy disk in a text form. The data were read by use of said personal computer from the resultant disk on which the coordinate data was recorded so as to output the coordinate data in the same form as when said data were input.

Example 33

Preparation of Hollow Fiber Alignment (1)

Two guide plates were used in which 20 each in both longitudinal and transverse directions in a square of 1 $cm^2$, i.e., 400 holes in total were regularly arranged in a square. Through said holes, 400 nylon hollow fibers (an outer diameter of about 300 μm, a length of about 50 cm) were passed to obtain a hollow fiber alignment.

An interval between the two fiber guide plates was made to be 20 cm, and the space between the plates was fixed with a polyurethane resin to prepare a hollow fiber alignment having portions not immobilized with the resin at each end.

Example 34

Preparation of Hollow Fiber Alignment (2)

Instead of the nylon hollow fibers, using polyethylene hollow fibers (an outer diameter of about 300 μm, a length of about 50 cm) that were treated to make the inner surface hydrophilic with a polyethylene-vinyl alcohol copolymer, the same procedure was carried out as in Example 33, thereby obtaining a hollow fiber alignment having portions not immobilized with the resin at each end.

Example 35

Preparation of Porous Hollow Fiber Alignment

The procedure in Example 33 was repeated except the nylon hollow fibers were replaced with a porous hollow fiber membrane MHF200TL (Mitsubishi Rayon Co., Ltd., outer diameter of 290 μm, inner diameter of 200 μm, length of about 50 cm) having a non-porous intermediate layer, resulting in a porous hollow fiber alignment having portions not immobilized with the resin at each end.

Example 36

Inner Surface Treatment of Porous Hollow Fiber Alignment (1)

Formic acid was introduced through the fiber portion not immobilized with resin into the hollow portion of each hollow fiber forming the hollow fiber alignment obtained in Example 33, and held therein for 1 min. Then, said hollow portion was well washed by introducing a large amount of water at a room temperature and then dried to complete the pre-treatment of the nylon hollow fibers.

Example 37

Inner Surface Treatment of Porous Hollow Fiber Alignment (2)

The procedure in Example 36 was repeated except that a solution of sulfuric acid in 10% ethanol was used instead of formic acid, to carry out a pre-treatment of the nylon hollow fibers.

Example 38

Introduction and Immobilization of a Biological Substance in a Hollow Fiber Alignment (1)

After subjecting each of the hollow fibers constituting the hollow fiber alignment prepared in Example 33 to the inner surface treatment as described in Examples 36 and 37, the oligonucleotides having amino groups synthesized in Reference 3 (probe A and probe B) were introduced, as an example of biological substance, into each of the hollow fibers constituting the hollow fiber alignment and immobilized on the hollow fibers according to the following procedure.

Through one end of the hollow fiber alignment was introduced a solution made by adding the oligonucleotide having amino groups synthesized in Reference 1 to a potassium phosphate buffer, and held therein at 20° C. overnight.

Thereafter, the inside of each hollow fiber was washed with a potassium phosphate buffer, a potassium chloride solution, then water, to prepare a nucleic acid-immobilized hollow fiber alignment wherein the oligonucleotides were immobilized on the inner wall surface of each hollow fiber.

In the above procedure, the oligonucleotides, probe A and probe B, were introduced and immobilized such that the arrangement in the hollow fiber alignment would be realized as shown in FIG. 2.

Example 39

Introduction and Immobilization of a Biological Substance in a Hollow Fiber Alignment (2)

Using the hollow fiber alignment prepared in Example 34, the same procedure was carried out as in Example 38 to prepare a nucleic acid-immobilized hollow fiber alignment wherein the oligonucleotides were immobilized on the inner wall surface of each hollow fiber.

In this procedure as well, the sequences of the oligonucleotides, probe A and probe B, were identical to those described in Example 38.

Example 40

Preparation of Biological Substance-Immobilized Fiber Alignment Slices

The biological substance-immobilized hollow fiber alignments prepared in Examples 38 and 39 were sliced off in a direction perpendicular to the axis of fiber using a microtome into slices having a thickness of about 100 μm, to obtain slices of a biological substance-immobilized fiber alignment, wherein 20 each in both longitudinal and transverse directions, i.e., 400 in total, of oligonucleotides were regularly arranged in a square (see FIG. 3).

Example 41

(1) Hybridization

The biological substance alignment sheet prepared in the Example 40, wherein oligonucleotides were regularly arranged in a square, was put in a bag for hybridization, into which a hybridization solution having the composition described below was poured to carry out pre-hybridization at 45° C. for 30 min.

Subsequently, DIG labeled DNA prepared in Reference 4 was added, followed by further hybridization at 45° C. for 15 hours.

Composition of Hybridization Solution:

5×SSC (0.75M sodium chloride, 0.075M sodium citrate, pH 7.0)

5% blocking reagent (Roche-Diagnostic Systems)

0.1% sodium N-lauroyl sarcosinate 0.02% SDS (sodium lauryl sulfate)

50% formamide (2) Detection:

After completing the hybridization, the biological substance alignment slices wherein oligonucleotides were regularly arranged in a square were transferred into 50 ml of a pre-warmed solution of 0.1×SSC, 0.1% SDS, and then washed with shaking 3 times, at 45° C. for 20 min for each.

Thereafter, DIG buffer 1 was added and SDS was removed with shaking at a room temperature. This procedure was repeated again before addition of DIG buffer 2 and 1-hour shaking. After removing the buffer, there was added 10 ml of a solution containing 1/10,000 volumes of an anti-DIG alkaline phosphatase labeled antibody solution to DIG buffer 2, which was then gently shaken for 30 min so as to cause an antigen-antibody reaction. Next, washing was performed by shaking twice in DIG buffer 1 containing 0.2% Tween 20 for 15 min, and subsequently immersed in DIG buffer 3 for 3 min. After removing DIG buffer 3, 3 ml of DIG buffer containing AMPPD was added to equilibrate for 10 min.

After draining, the resultant slices were transferred to a new hybridization bag, which was then left at 37° C. for 1 hour and bound together with a X-ray film by means of a binder for X-ray film, which film was then sensitized.

As a result, it was fount that in any of the biological substance alignment slices, oligonucleotide C bound to the site where probe A was placed while oligonucleotide D to the site where probe B was placed.

DIG buffer 1: 0.1 M maleic acid, 0.15 M sodium chloride (pH 7.5).

DIG buffer 2: a buffer to which a blocking reagent is added at a concentration of 0.5%.

DIG buffer 3: 0.1 M Tris-hydrochloric acid (pH 9.5), 0.1 M sodium chloride, and 0.05 M magnesium chloride.

Blocking reagent: an anti-DIG alkaline phosphatase-labeled antibody solution and AMPPD are reagents in a DIG Detection kit (Roche Diagnostic Systems)

Example 42

Preparation of Hollow Fiber Alignment (1)

Two perforated plates having a thickness of 0.1 mm were used, wherein 20 each in both longitudinal and transverse directions in a 10 mm×10 mm square, i.e., 400 in total of pores having a diameter of 0.32 mm were regularly arranged with a pitch of 0.5 mm, and through all of said pores, 400 nylon hollow fibers (an outer diameter of about 0.3 mm, a length of about 500 mm) were passed to obtain a hollow fiber alignment.

The interval was made 20 cm between the two fiber guide plates, and the space between the plates was fixed with a polyurethane resin to prepare a hollow fiber alignment having portions not immobilized with the resin at each end.

Example 43

Preparation of Hollow Fiber Alignment (2)

Instead of the nylon hollow fibers, polyethylene hollow fibers (an outer diameter of about 0.3 mm, a length of about 500 mm) that were treated to make the inner surface hydrophilic with a polyethylene-vinyl alcohol copolymer were subject to the same procedure which was carried out in Example 42.

Example 44

Preparation of Hollow Fiber Alignment (3)

Instead of the nylon hollow fiber, using polymethyl methacrylate hollow fiber (an outer diameter of about 0.3 mm, a length of about 500 mm), the same procedure was carried out as in Example 42 to prepare a hollow fiber alignment having portions not immobilized with the resin at each end.

Example 45

Preparation of Porous Hollow Fiber Alignment

The procedure described in Example 42 was repeated except the nylon hollow fiber was replaced with a porous hollow fiber membrane MHF200TL (Mitsubishi Rayon Co., Ltd., an outer diameter of 0.29 mm, an inner diameter of 0.2 mm, a length of about 500 mm) having a non-porous intermediate layer, resulting in a porous hollow fiber alignment having portions not immobilized with the resin at each end.

Example 46

Twenty-five porous polyethylene hollow fiber membranes MHF200TL (Mitsubishi Rayon Co., Ltd., an outer diameter of 290 μm, an inner diameter of 200 μm) were brought together into a bundle, one end of which was fixed with a urethane resin such that the hollow portions of the hollow fiber membranes would remain open. In a reactor, the hollow fibers of this block were filled with an ethanol solution A having the composition described below, by means of suction. Thereafter, the pressure within the reactor was slightly reduced from normal pressure to release a part of ethanol solution A from the hollow portions. After converting the pressure inside the reactor to normal pressure, polymerization was conducted under the nitrogen atmosphere at 70° C. for 3 hours. Upon completing the polymerization, the resultant product was dried in a vacuum dryer overnight to remove ethanol.

| Ethanol solution A: | |
|---|---|
| N,N-dimethylacrylamide | 19 parts by weight |
| N,N'-methylene-bis-acrylamide | 1 part by weight |
| 2,2'-azobisisobutyronitrile | 0.1 part by weight |
| ethanol | 80 parts by weight |

Example 47

An ethanol solution B having the following composition was prepared for treatment inside the hollow fibers in the same manner as described in Example 46.

| Ethanol solution B: | |
|---|---|
| N,N-dimethylacrylamide | 10 parts by weight |
| 2-hydroxyethyl(meth)acrylate | 9 parts by weight |
| N,N'-methylene-bis-acrylamide | 1 part by weight |
| 2,2'-azobisisobutyronitrile | 0.1 part by weight |
| ethanol | 80 parts by weight |

Example 48

An ethanol solution C having the following composition was prepared for treatment inside the hollow fibers in the same manner as described in Example 46.

| Ethanol solution C: | |
|---|---|
| N,N-dimethylacrylamide | 38 parts by weight |
| N,N'-methylene-bis-acrylamide | 2 parts by weight |
| 2,2'-azobisisobutyronitrile | 0.2 part by weight |
| ethanol | 60 parts by weight |

Example 49

An ethanol solution D having the following composition was prepared for treatment inside the hollow fibers in the same manner as described in Example 46.

| Ethanol solution D: | |
|---|---|
| N,N-dimethylacrylamide | 19 parts by weight |
| N,N'-methylene-bis-acrylamide | 1 part by weight |
| Benzoyl peroxide | 0.1 part by weight |
| ethanol | 80 parts by weight |

Example 50

An ethanol solution E comprising having the composition was prepared for treatment inside the hollow fibers in the same manner as described in Example 46.

| Ethanol solution E: | |
|---|---|
| N,N-dimethylacrylamide | 19 parts by weight |
| N,N'-methylene-bis-acrylamide | 1 part by weight |
| 2,2'-azobisisobutyronitrile | 0.1 part by weight |
| ethanol | 80 parts by weight |

Example 51

Twenty-five polymethyl methacrylate hollow fibers (an outer diameter of 300 μm, an inner diameter of 180 μm) were brought together into a bundle, of which one end was fixed with a urethane resin such that the hollow portions of hollow fibers would be remained open. An ethanol solution F having the following composition was prepared for treatment inside the hollow fibers in the same manner as described in Example 46.

| Ethanol solution F: | |
|---|---|
| N,N-dimethylacrylamide | 19 parts by weight |
| N,N'-methylene-bis-acrylamide | 1 part by weight |
| 2,2'-azobisisobutyronitrile | 0.1 part by weight |
| ethanol | 80 parts by weight |

Example 52

The block that had been treated inside the hollow fibers in Example 46 was used to verify the effect of treatment. After completing polymerization of acrylamide gel inside each of the hollow fibers according to the following procedure, the resultant block was sliced in a direction perpendicular to the axis of hollow fibers into slices having a thickness of about 750 μm. These slices were introduced in water, which was then shaken at 38° C. overnight and further at 50° C. for 1 hour. After shaking, the slices were observed, showing that they were filled with acrylamide gel in all of the 25 hollow fibers.

<Polymerization of Acrylamide Gel>

An aqueous solution G having the following composition was prepared to fill by suction the inside of hollow fibers of the blocks prepared in Examples 46 to 51. After filling with the aqueous solution, polymerization was carried out under the nitrogen atmosphere at 70° C. for 3 hours.

| Aqueous solution G | |
|---|---|
| acrylamide | 9 parts by weight |
| N,N'-methylene-bis-acrylamide | 1 part by weight |
| 2,2'-azobis(2-methylpropionamidine) dihydrochloride (V-50) | 0.1 part by weight |
| water | 90 parts by weight |

Example 53

The block treated inside the hollow fibers in Example 47 was used to verify the effect of the treatment in the same manner as in Example 52. After operations, the slices were observed, confirming that all of the 25 hollow fibers were filled with acrylamide gel.

Example 54

The block treated inside the hollow fibers in Example 48 was used to verify the effect of the treatment in the same manner as in Example 52. After operations, the slices were observed, confirming that all of the 25 hollow fibers were filled with acrylamide gel.

Example 55

The block treated inside the hollow fibers in Example 49 was used to verify the effect of the treatment in the same manner as in Example 52. After operations, the slices were observed, confirming that all of the 25 hollow fibers were filled with acrylamide gel.

Example 56

The block treated inside the hollow fibers in Example 50 was used to verify the effect of the treatment in the same manner as in Example 52. After operations, the slices were observed, confirming that all of the 25 hollow fibers were filled with acrylamide gel.

Example 57

The block treated inside the hollow fibers in Example 51 was used to verify the effect of the treatment in the same manner as in Example 52. After operations, the slices were observed, showing that all of the 25 hollow fibers were filled with acrylamide gel.

Comparative Example 1

Twenty-five porous polyethylene hollow fiber membranes MHF200TL (manufactured by Mitsubishi Rayon Co., Ltd., an outer diameter of 290 μm, an inner diameter of 200 μm) were brought together into a bundle, of which one end was fixed with a urethane resin such that the hollow portions of the hollow fibers would be remained open.

Comparative Example 2

An ethanol solution G having the following composition was prepared for treatment inside the hollow fibers in the same manner as described in Example 46.

| Ethanol solution G: | |
|---|---|
| N,N-dimethylacrylamide | 86 parts by weight |
| N,N'-methylene-bis-acrylamide | 4 part by weight |
| 2,2'-azobisisobutyronitrile | 0.45 part by weight |
| ethanol | 10 parts by weight |

Comparative Example 3

The block prepared in Comparative Example 1 was used to observe the effect of treatment. When preparing slices by slicing the blocks, 4 out of 25 hollow fibers were found to lose the gel. After shaking the slices, complete loss of the gel was observed in 12 hollow fibers in total.

Comparative Example 4

Using the block prepared in Comparative Example 2, we tried to observe the effect of treatment. However, the inside of hollow fibers was stuffed with the gel for treatment, thus not allowing us to inject therein the acrylamide solution.

Reference 5

(a) Preparation of Oligonucleotide Probes Having Methacrylate Group.

Oligonucleotides (probe A, probe B) as shown below were synthesized.

Probe A: GCGATCGAAACCTTGCTGTACGAGCGAGGGCTC (SEQ ID NO: 1)

Probe B: GATGAGGTGGAGGTCAGGGTTTGGGACAGCAG (SEQ ID NO: 2)

Synthesis of the oligonucleotides was carried out using an automated synthesizer, DNA/RNA synthesizer (model 394). In the final step of DNA synthesis, $NH_2(CH_2)_6$-group was introduced using Aminolink II (Trademark) (Applied Biosysytems, Inc.) into each oligonucleotide at the 5'-terminus to prepare aminated probes. These probes were deprotected and purified according to general procedures for subsequent use.

Five μl of resultant probe A or B (500 nmol/ml) was mixed with 0.5 μl of glycidyl methacrylate (GMA) and the mixture was reacted at 70° C. for 2 hours to prepare an oligonucleotide probe having methacrylate group. 190 μl of water was added to obtain a solution of 100 nmol/mil probe (GMA modified probe A and GMA modified probe B) having methacrylate group.

(b) Preparation of Nucleic Acid Sample Model

As nucleic acid sample models, oligonucleotides (C, D) were synthesized, which are respectively complementary to a part of the sequences of oligonucleotides (probe A, probe B) synthesized in the above step (a).

Oligonucleotide C: GAGCCCTCGCTCGTACAGCAAGGTTTCG (SEQ ID NO: 3)

Oligonucleotide D: CTGCTGTCCCAAACCCTGACCTCCACC (SEQ ID NO: 4)

Synthesis of the oligonucleotides was carried out in the similar manner to the above step (a). Thus, fluorescently labeled nucleic acid sample models were prepared wherein Cy3 was introduced at the 5'-terminus of oligonucleotide C, and Cy5 at the 5'-terminus of oligonucleotide D. These products were deprotected and purified according to general procedures for subsequent use.

(c) Preparation of Fiber Alignment

Five porous polyethylene hollow fiber membranes MHF200TL (Mitsubishi Rayon Co., Ltd., an outer diameter of 290 μm, an inner diameter of 200 μm) were aligned on a Teflon plate, close to but without overlapping with each other, and then fixed at both ends. This plate was applied with a thin coat of a polyurethane resin adhesive (manufactured by Nippon Polyurethane Industry Co., Ltd., collonate4403, Nipporan4223) to adhere the hollow fibers. The polyurethane resin, after being well solidified, was removed from the Teflon plate, to obtain a sheet like product wherein the porous hollow fibers were arranged in line. Then, these 5 sheet like products were laminated and adhered each other with said adhesive, resulting in a porous hollow fiber alignment wherein 5 each in both longitudinal and transverse directions, i.e., 25 in total, of hollow fibers were arranged regularly in a square.

Example 58

(1) Synthesis of Fluorescently Labeled Oligonucleotide

Oligonucleotide having a sequence of GCAT was synthesized as described in Reference 5(a), in which fluorescein isothiocyanate (FITC) was introduced at the 5'-terminus.

(2) Preparation of Fluorescent Pigment Having Methacrylate Group

50 μl of oligonucleotide (500 nmol/ml) having FITC at the 5'-terminus, prepared in the above step (1), was mixed with 5 μl of glycidyl methacrylate and 5 μl of dimethyl formamide (DMF). Resultant mixture was reacted at 70° C. for 2 hours to prepare a fluorescent pigment having methacrylate group. 190 μl of water was added to said fluorescent pigment, to a solution of 100 nmol/ml fluorescent pigment (GMA denatured fluorescent pigment) having methacrylate group.

(3) Preparation of Fiber Alignment Retaining Biological Substance-Immobilized Gel Polymerization solutions 1 to 3 having the compositions shown in Table 7 were prepared to fill the hollow portions of the hollow fibers constituting a certain row of the alignment prepared in Reference 5 (c), which was then transferred to a sealed glass container saturated inside with water vapor and left at 80° C. for 4 hours to carry out polymerization reaction.

<Preparation of a Monomer Solution and a Polymerization Initiator Solution>

A monomer solution and an initiator solution were prepared by mixing components at the following weight ratio.

| | |
|---|---|
| a) Monomer solution: | |
| acrylamide | 0.76 part by weight |
| methylene-bis-acrylamide | 0.04 part by weight |
| water | 4.2 parts by weight |
| b) Initiator solution: | |
| 2,2'-azobis(2-amidinopropane) dihydrochloride | 0.01 part by weight |
| water | 4.99 parts by weight |

<Preparation of Polymerization Solutions>

Polymerization solutions 1 to 3 were prepared by mixing said monomer solution a), said initiator solution b), the GMA modified probe A or GMA modified probe B prepared in the above step (2) and the GMA modified FITC prepared in Reference 5(c) at the volume ratios shown in Table 7. Resultant polymerization solutions were used to fill the hollow portions of the hollow fibers constituting a certain row of the hollow fiber alignment prepared in Reference (c), which was then transferred to a sealed glass container saturated inside with water vapor and left at 80° C. for 4 hours to effect a polymerization reaction.

TABLE 7

| | Polymerization solution 1 | Polymerization solution 2 | Polymerization solution 3 |
|---|---|---|---|
| Monomer solution | 500 μl | 500 μl | 500 μl |
| Initiator solution | 500 μl | 500 μl | 500 μl |
| GMA modified FITC (100 nmol/ml) | 5 μl | 5 μl | 5 μl |
| GMA modified probe A (100 nmol/ml) | 0 | 50 μl | 0 |
| GMA modified probe B (100 nmol/ml) | 0 | 0 | 50 μl |
| Row No. in the alignment | 1, 3, 5 | 2 | 4 |

(4) Observation of Slices and Condition of Filling with Gel

The alignment prepared in (3) above was sliced by means of a microtome into slices having a thickness of 500 μm. These slices were observed by means of a fluorescence microscope (a fluorescence microscope E400 manufactured by Nikon) using a filter for FITC (an excitation wave length range from 465 to 495 nm, a fluorescence wave length range from 515 to 555 nm), allowing us to observe readily the condition of filling with the gel.

(5) Hybridization

The slices prepared in the above step (4) were put in a bag for hybridization, into which a hybridization solution of the following composition was poured to carry out pre-hybridization at 45° C. for 30 min.

<Composition of Hybridization Solution>

5×SSC (0.75 mol/l sodium chloride, 0.075 mol/l sodium citrate, pH 7.0)

5% blocking reagent (Roche-Diagnostic Systems)

0.1% sodium N-lauroyl sarcosinate 0.02% SDS (sodium lauryl sulfate)

50% formamide

Subsequently, the fluorescently labeled nucleic acid sample model prepared in Reference 5(b) was added at a concentration of 50 pmol/ml, followed by hybridization at 45° C. for 15 hours.

After completing the hybridization, resultant nucleic acid-immobilized slices were transferred into 50 ml of a pre-warmed solution of 0.1×SSC, 0.1% SDS, which was then washed 3 times with shaking at 45° C. for 20 min.

(6) Detection

Chips obtained in the above step (5) were observed after hybridization using a filter for CY3 (an excitation wave length peak range: 535 nm, a half-value width: 50 nm, a fluorescence wavelength peak: 610 nm, a half-value width: 75 nm), resulting in images showing that only Row No.2 of the alignment was emitting fluorescence without being prevented by fluorescence of the GMA modified FITC. Then, observation was carried out by means of a fluorescence microscope using a filter for FITC as described in (4) above, indicating that all of the hollow fibers were filled with the gel, even for the Row Nos. with no emission of fluorescence using the filter for CY3. Likewise, a filter for CY5 (excitation wave length peak range: 620 nm, half-value width: 60 nm, fluorescence wavelength peak: 700 nm, half-value width: 75 nm) was used to observe, providing an image showing that only Row No.4 of the alignment was emitting fluorescence, without being prevented by fluorescence of the GMA modified FITC. From the above results, it was verified that oligonucleotide C hybridized specifically only to the sections wherein the probes A was immobilized while oligonucleotide D to the sections wherein the probes B was immobilized and that there was no falling off or deformation of the gel during the operation of hybridization.

Example 59

Slices of a fiber alignment were prepared under the same conditions as described in Example 58 except that the GMA modified FITC was replaced with Fluorescein Dimethacrylate manufactured by Polysciences, Inc. These slices were observed by means of a fluorescence microscope, allowing us to observe with ease the condition of filling with the gel. Further, hybridization, being carried out as Example 58, indicated that detection of fluorescence of CY3 and CY5 was not prevented by fluorescence of the Fluorescein and that there was no falling off or deformation of gel during the operation of hybridization.

Comparative Example 5

Slices were prepared in the same manner as in Example 58 without using GMA modified FITC. These slices were observed by means of a microscope using a filter for CY3, providing an image showing that only Row No.2 of alignment was emitting fluorescence. However, it was difficult to observe the filling conditions such as loss of the gel in rows other than Row No.2, that is, it was difficult to determine whether the rows emitting no fluorescence did not form any hybrid or lost the gel.

Example 60

(1) Preparation of Oligonucleotides Having Amino Group at 5'-Terminus

Oligonucleotides (probe A, probe B) as shown below were synthesized.

Probe A: GCGATCGAAACCTTGCTGTACGAGCGAGGGCTC (SEQ ID NO: 1)

Probe B: GATGAGGTGGAGGTCAGGGTTTGGGACAGCAG (SEQ ID NO: 2)

Synthesis of the oligonucleotides was carried out using an automated synthesizer, DNA/RNA synthesizer (model 349) (manufactured by PE Biosystems, Inc.). In the final step of DNA synthesis, $NH_2(CH_2)_6$-group was introduced into each oligonucleotide at the 5'-terminus by use of Aminolink II (manufactured by Applied Biosysytems, Inc.), to prepare aminated probes. These probes were deprotected and purified according to general procedures for subsequent use.

(2) Preparation of Nucleic Acid-Immobilized Macromolecule Gel

Five μl of the probe A or B (500 nmol/ml) prepared in the above step (1) was mixed with 5 μl of glycidyl methacrylate and the mixture was reacted at 70° C. for 2 hours. To the reaction mixture, were added 50 μl of a monomer mixed aqueous solution (an aqueous solution containing acrylamide 47.5% w/w and methylene-bis-acrylamide 2.5% w/w), 450 μl of water and 5 μl of 10% aqueous solution of azobisisobutylonitrile, which mixture was subjected to a polymerization reaction at 70° C. for 2 hours, to prepare a nucleic acid-immobilized macromolecule gel. The nucleic acid-immobilized macromolecule gel thus prepared was sliced into slices having a thickness of 5 mm for detection operations.

(3) Labeling of Sample Nucleic Acid

As nucleic acid sample models, oligonucleotides (C, D) were synthesized, which are respectively complementary to a part of the sequences of the probes A and B prepared in the above step (1).

Oligonucleotide C: GAGCCCTCGCTCGTACAGCAAGGTTTCG (SEQ ID NO: 3)

Oligonucleotide D: CTGCTGTCCCAAACCCTGACCTCCACC (SEQ ID NO: 4)

$NH_2(CH_2)_6$-group was introduced into each oligonucleotide at the 5'-terminus by use of Aminolink II (manufactured by PE Biosysytem Japan, Inc.) as described in the above step (1), which was then labeled with Digoxygenin (DIG: manufactured by Roche-Diagnostic Systems) according to a following procedure.

The oligonucleotides aminated at the termini were individually dissolved in 100 mM borate buffer (pH 8.5) to a final concentration of 2 mM. After adding an equal amount of Digoxygenin-3-0-methylcarbonyl-ε-aminocapronic acid-N-hydroxy-succinimide ester (26 mg/ml dimethyl formamide solution), the mixture was left at a room temperature overnight.

The resultant mixture, its volume being adjusted to 100 μl, was charged with 2 μl of glycogen (manufactured by Roche-Diagnostic Systems), 10 μl of 3M sodium acetate (pH 5.2) and 300 μl of cold ethanol, and then subjected to centrifugation at 15,000 rpm for 15 min to recover the pellet. Further, 500 μl of 70% ethanol was added to the pellet which was then centrifuged at 15,000 rpm for 5 min to recover the pellet again. The pellet was dried with air and dissolved in 100 μl of 10 mM Tris-HCl (pH 7.5), 1 mM EDTA. DIG-labeled oligonucleotides thus obtained were used as nucleic acid sample models.

(4) Hybridization

The nucleic acid-immobilized macromolecule gel slices prepared in the above step (2) were put in a bag for hybridization, into which a hybridization solution of the following composition was poured to carry out pre-hybridization at 45° C. for 30 min. Subsequently, DIG labeled DNA prepared in the above step (3) was added, followed by hybridization at 45° C. for 15 hours.

Composition of Hybridization Solution:

5×SSC

5% blocking reagent (a reagent included in a DIG Detection kit)

0.1% sodium N— lauroyl sarcosinate 0.02% SDS (sodium lauryl sulfate)

50% formamide (5) Detection

After the hybridization was completed, the nucleic acid-immobilized macromolecule gel slices were transferred into 50 ml of a pre-warmed solution of 0.1×SSC, 0.1% SDS, which was then washed with shaking 3 times, at 45° C. for 20 min for each.

Thereafter, DIG buffer 1 (0.1 M maleic acid, 0.15 M sodium chloride (pH 7.5)) was added and then, SDS was removed by shaking at a room temperature. This was repeated again before addition of DIG buffer 2 (made by adding a blocking reagent at a concentration of 0.5% in DIG buffer) and 1-hour shaking. After removing the buffer, there was added 10 ml of DIG buffer 2 containing $10^{-4}$ volumes of an anti-DIG alkaline phosphatase labeled antibody (a reagent of DIG Detection kit), which was then gently shaken for 30 min so as to cause an antigen-antibody reaction to take place. Next, this reaction solution was washed by immersing twice in DIG buffer 1 containing 0.2% Tween 20 for 15 min, and subsequently soaked in DIG buffer 3 (0.1 M tris-chloric acid (pH 9.5), 0.1 M sodium chloride, 0.05M magnesium chloride) for 3 min. After removing DIG buffer 3, 3 ml of DIG buffer containing CDP-Star (manufactured by Roche-Diagnostic Systems) was added.

After draining, the resultant solution was transferred to a new hybridization bag, which was bound together with an X-ray film by means of a binder for X-ray film, which was then sensitized.

As a result, it was found that the oligonucleotide C bound to the gel slices of probe A and the oligonucleotide D to those of the probe B.

Example 61

(1) Preparation of Glycidyl Group-Containing Macromolecule Gel

Azobisisobutylonitrile was added at a concentration of 0.1% to an aqueous solution of 4.65 parts by weight (pbw) of acrylamide, 0.25 pbw of methylene-bis-acrylamide and 0.1 pbw of glycidyl methacrylate, which was then subjected to polymerization reaction at 70° C. for 2 hours, to prepare a macromolecule gel.

(2) Preparation of Nucleic Acid-Immobilized Macromolecule Gel

The macromolecule gel prepared in the above step (1) was cut into 10 mm cubes, which were mixed with 100 μl of the probe A or B (500 nmol/ml) prepared by the process described in Example 60(1) and reacted at 70° C. for 2 hours, to obtain a nucleic acid-immobilized macromolecule gel. The nucleic acid-immobilized macromolecule gel thus prepared was sliced into slices having a thickness of 5 mm, for detection by similar operations to (3), (4) and (5) in Example 60.

As a result, it was found that oligonucleotide C bound to the gel slices of probe A and oligonucleotide D to those of the probe B.

Example 62

(1) Preparation of Oligonucleotides Having Amino Group at 5'-Terminus

Oligonucleotides (probe A, probe B) as shown below were synthesized.

Probe A: GCGATCGAAACCTTGCTGTACGAGCGAGGGCTC (SEQ ID NO: 1)

Probe B: GATGAGGTGGAGGTCAGGGTTTGGGACAGCAG (SEQ ID NO: 2)

Synthesis of the oligonucleotides was carried out using an automated synthesizer, DNA/RNA synthesizer (model 349) (manufactured by PE Biosystems, Inc.). In the final step of DNA synthesis, a $NH_2(CH_2)_6$-group was introduced in each of the oligonucleotides at the 5'-terminus by use of Aminolink II (manufactured by Applied Biosysytems, Inc.) to prepare aminated probes. These probes were deprotected and purified according to general procedures for subsequent use.

(2) Preparation of Nucleic Acid-Immobilized Macromolecule Gel

Five μl of the probe A or B (500 nmol/ml) prepared in the above step (1) was mixed with 5 μl of glycidyl methacrylate and the mixture was reacted at 70° C. for 2 hours. To the reaction mixture were added 50 μl of 50% aqueous solution of acrylamide, 10 μl of 10% aqueous solution of ethylene diamine, 450 μl of water and 5 μl of 10% aqueous solution of azobisisobutylonitrile, followed by polymerization reaction at 70° C. for 2 hours, to prepare a nucleic acid-immobilized macromolecule gel. The nucleic acid-immobilized macromolecule gel thus prepared was sliced into slices having a thickness of 5 mm for detection operations.

(3) Labeling of Sample Nucleic Acid

As nucleic acid sample models, oligonucleotides (C, D) were synthesized, which are respectively complementary to a part of the sequence of the probe A and B prepared in the above step (1).

Oligonucleotide C: GAGCCCTCGCTCGTACAGCAAGGTTTCG (SEQ ID NO: 3)

Oligonucleotide D: CTGCTGTCCCAAACCCTGACCTCCACC (SEQ ID NO: 4)

$NH_2(CH_2)_6$-group was introduced in each oligonucleotide at the 5'-terminus by use of Aminolink II (manufactured by PE Biosysytems Japan, Inc.) as described in the above step (1), which was then labeled with Digoxygenin (DIG: manufactured by Roche-Diagnostic Systems) according to the following procedure.

The oligonucleotides aminated at the termini were individually dissolved in 100 mM borate buffer (pH 8.5) to a final concentration of 2 mM. After adding an equivalent amount of Digoxygenin-3-0-methylcarbonyl-ε-aminocapronic acid-N-hydroxy-succinimide ester (26 mg/ml dimethyl formamide solution) therein, the mixture was left at a room temperature overnight.

The resultant mixture, its volume being adjusted to 100 μl, was loaded with 2 μl of glycogen (manufactured by Roche-Diagnostics Inc.), 10 μl of 3M sodium acetate (pH 5.2) and 300 μl of cold ethanol, and then subjected to centrifugation at 15,000 rpm for 15 min, to recover the pellet. Further, 500 μl of 70% ethanol was added to the pellet, which was then centrifuged at 15,000 rpm for 5 min so as to recover the pellet. The resultant pellet was dried with air and dissolved in 100 μl of 10 mM Tris-HCl (pH 7.5), 1 mM EDTA. DIG-labeled oligonucleotides thus prepared were used as nucleic acid sample models.

(4) Hybridization

The nucleic acid-immobilized macromolecule gel slices prepared in the above step (2) were introduced in a bag for hybridization, into which a hybridization solution of the following composition was poured to carry out pre-hybridization at 45° C. for 30 min. Subsequently, DIG-labeled DNA prepared in the above step (3) was added therein, followed by hybridization at 45° C. for 15 hours.

Composition of Hybridization Solution:

5×SSC

5% blocking reagent (a reagent included in a DIG Detection kit)

0.1% sodium N-lauroyl sarcosinate 0.02% SDS (sodium lauryl sulfate)

50% formamide (5) Detection

After completion of hybridization, the nucleic acid-immobilized macromolecule gel slices were transferred to 50 ml of a pre-warmed solution of 0.1×SSC, 0.1% SDS, which was then washed with shaking 3 times, at 45° C. for 20 min for each.

Thereafter, DIG buffer 1 (0.1 M maleic acid, 0.15 M sodium chloride (pH 7.5)) was added and then, SDS was removed with shaking at a room temperature. This was repeated again before addition of DIG buffer 2 (made by adding a blocking reagent at a concentration of 0.5% in DIG buffer) and 1-hour shaking. After removing the buffer, there was added 10 ml of DIG buffer 2 containing $10^{-4}$ volumes of an anti-DIG alkaline phosphatase labeled antibody (a reagent of DIG Detection kit), which was then gently shaken for 30 min so as to cause an antigen-antibody reaction to take place. Next, this reaction mixture was washed by shaking in DIG buffer 1 containing 0.2% Tween 20 for 15 min twice, and subsequently immersed in DIG buffer 3 (0.1 M tris-chloric acid (pH 9.5), 0.1 M sodium chloride, 0.05M magnesium chloride) for 3 min. After removing DIG buffer 3, 3 ml of DIG buffer containing CDP-Star (manufactured by Roche-Diagnostic Systems) was added.

After draining, the resultant slices were transferred to a new hybridization bag, which was bound together with an X-ray film by means of a binder for X-ray film, which film was then sensitized.

As a result, it was found that oligonucleotide C bound to the gel slices of probe A and oligonucleotide D to those of the probe B.

Example 63

(1) Preparation of Macromolecule Gel Containing Glycidyl Group

Azobisisobutylonitrile was added at a concentration of 0.1% to an aqueous solution comprising 4.88 parts by weight (pbw) of acrylamide, 0.02 pbw of ethylene diamine and 0.1 pbw of glycidyl methacrylate, which was then subjected to polymerization reaction at 70° C. for 2 hours, to prepare a macromolecule gel.

(2) Preparation of Nucleic Acid-Immobilized Macromolecule Gel

The resultant macromolecule gel was cut into 10 mm cube, which were mixed with 100 μl of the probe A or B (500 nmol/ml) prepared by the process described in Example 62(1) and reacted at 70° C. for 2 hours, to prepare a nucleic acid-immobilized macromolecule gel. Also, for the probe B, the same operations were carried out as above to prepare a nucleic acid-immobilized macromolecule gel. The nucleic acid-immobilized macromolecule gels thus prepared were sliced into slices with a thickness of 5 mm, for detection by similar operations to (3), (4) and (5) in Example 62.

As a result, it was found that oligonucleotide C bound to the gel slices of probe A and oligonucleotide D to those of the probe B.

Example 64

(1) Preparation of Chromosomal DNAs

*Rhodococcus Rhodochrous* J-1 (FERM BP-1478) was cultured in a nutrient medium (15 g of glucose, 1 g of yeast extract, 10 g of sodium glutamate, 0.5 g of $KH_2PO_4$, 0.5 g of $K_2HPO_4$, 0.5 g of $MgSO_4.7H_2O$ per liter, pH 7.2) at 30° C. for 3 days to collect the bacterial cells. The chromosomal DNA was prepared from the cells to use as a template for PCR.

(2) Preparation of Probes

The positions of oligonucleotides synthesized for preparing probes are shown in FIG. 9. The oligonucleotide A (SEQ ID NO: 1) is positioned about 400 bases upstream the oligonucleotide B (SEQ ID NO: 2), while the oligonucleotide E (SEQ ID NO: 5) is positioned about 400 bases downstream of oligonucleotide A, and the oligonucleotide F (SEQ ID NO: 6) about 600 bases downstream of oligonucleotide B. In PCR, those oligonucleotides were used wherein the oligonucleotides A and B are acrylamide modified at the 5'-termini (commissioned synthesis by Wako Pure Chemical Industries, Ltd.). As for PCR, Asymmetric PCR was performed in the presence of an excess amount of one primer. The concentration of primers was adjusted such that 5'-acrylamide-modified oligonucleotide A: oligonucleotide E is 100:1 or that 5'-acrylamide-modified oligonucleotide B: oligonucleotide F is 100:1. The other conditions used were as described in the specification of Ex-Taq (Takara Shuzo Co., Ltd). PCR was carried out using TaKaRa PCR Thermal Cycler PERSONAL. The reaction was carried out in a total volume of 100 μl, with 40 cycles of the following temperature conditions: 93° C. for 30 sec, 65° C. for 30 sec and 72° C. for 2 min per cyle. This PCR amplified 5' acrylamide modified probe DNAs of about 400 bases (probe G: SEQ ID NO: 7) and 600 bases (probe G: SEQ ID NO: 8).

(3) Preparation of Nucleic Acid-Immobilized Slices

An aqueous solution A of the following composition was prepared: acrylamide, 3.7 parts by mass; methylene bisacrylamide, 0.3 part by mass; 2,2'-azobis(2-amidinopropane) dihyrochloride, 0.1 part by mass; probe G or probe H, 0.005 part by mass. In this solution A were immersed porous polyethylene hollow fiber membranes having a non-porous intermediate layer, MHF200TL, (Mitsubishi Rayon Co., Ltd., an outer diameter of 290 μm and an inner diameter of 200 μm), which was then transferred to a sealed glass container and left at 80° C. for 4 hours to cause polymerization reaction to take place.

The porous layer inside the resultant porous hollow fiber membranes retained the gel immobilizing probe G or H rather than the hollow portions or non-porous intermediate layers. The thus obtained porous hollow fibers retaining the probe G-immobilized gel were aligned on a Teflon plate, close to but without overlapping each other, and then fixed at both ends. This plate was applied with a thin coat of a polyurethane resin adhesive (manufactured by Nippon Polyurethane Industry Co., Ltd., coronate4403, nippolan4223) to adhere said nucleic acid-immobilized porous hollow fibers. The polyurethane resin, after being well solidified, was removed from the Teflon plate, to obtain a sheet like product wherein the porous hollow fibers retaining the nucleic acid-immobilized gel were arranged in line. Likewise, with the probe H, a sheet like product was obtained, wherein the porous hollow fibers retaining the nucleic acid-immobilized gel were arranged in line. In addition, a similar sheet like product was prepared as a blank with no immobilized nucleic acid.

Then, these 5 sheet formed products were laminated in an order of the blank, the probe G, the blank, the probe H, and the blank and then adhered each other with said adhesive, resulting in a porous hollow fiber alignment retaining nucleic acid-immobilized gel, wherein 5 each in both longitudinal and transverse directions, i.e., 25 in total, of nucleic acid-immobilized porous hollow fibers were arranged regularly in a square. The porous hollow fiber alignment retaining nucleic acid-immobilized gel thus prepared was sliced to a thickness of 0.1 mm by means of a microtome, to obtain slices wherein 20 each in both longitudinal and transverse directions, i.e., 400 in total, of porous hollow fibers retaining nucleic acid-immobilized gel, in section, were arranged regularly.

(4) Preparation of Fluorescently Labeled Samples

The following samples were prepared as nucleic acid sample models to use for hybridization. For preparing the sample to hybridize only to the probe G, the oligonucleotides E and A were used to carry out PCR, resulting in a sample I of about 400 bases (SEQ ID NO: 9). On the other hand, for preparing the sample to hybridize only to the probe H, the oligonucleotides F and B were used to carry out PCR, to prepare a sample J of about 600 bases (SEQ ID NO: 10).

In order to fluorescently label the sample, oligonucleotides labeled at the 5'-terminal with Cy5 (Cy5-oligonucleotide E, Cy5-oligonucleotide F) were synthesized (using Amasham Pharmacia Biotech, OlidoExpress) to use for PCR. PCR was carried out with the concentration of primers being adjusted such that Cy5-oligonucleotide E: oligonucleotide A is 100:1 or that Cy5-oligonucleotide F: oligonucleotide B is 100:1, the other conditions being according to the specification of Ex-Taq (Takara Shuzo Co., Ltd), by use of TaKaRa PCR Thermal Cycler PERSONAL. The reaction was performed in a total volume of 100 μl, with 40 cycles of the following temperature conditions: 93° C. for 30 sec, 65° C. for 30 sec and 72° C. for 2 min per cycle. This PCR amplified DNAs of samples I and J. After completing the reaction, SUPEC-02 (Takara Shuzo Co., Ltd.) was used to remove unreacted primers, and the samples were recovered by means of GFX PCR DNA and Gel Band Purification Kit (Amasham Pharmacia Biotech).

(5) Hybridization

Two μl of each sample thus recovered was spotted on a filter paper (PhastTransfer Filter Paper: Amasham Pharmacia Biotech), which was then stuck to one side of the DNA immobilized slice prepared in Example 64 (3) and applied with a voltage of 5V for 2 hours to achieve hybridization.

After washing, the resultant samples were observed by means of a fluorescence detector (a fluorescence microscope).

As a result, it was found that the sample I hybridized only to the porous fiber section with the probe G immobilized, and the sample J only to the porous fiber section with the probe H immobilized, both specifically in the nucleic acid-immobilized slice.

All of the publications, patents and patent applications cited herein are incorporated herein by reference in their entirety.

Sequence Listing Free Text

SEQ ID No.1: synthetic DNA

SEQ ID No.2: synthetic DNA

SEQ ID No.3: synthetic DNA

SEQ ID No.4: synthetic DNA

SEQ ID No.5: synthetic DNA

SEQ ID No.6: synthetic DNA

SEQ ID No.15: synthetic DNA with acrylamide attached to the 5'-terminus

SEQ ID No.16: synthetic DNA with acrylamide attached to the 5'-terminus

SEQ ID No.17: synthetic DNA with acrylamide attached to the 5'-terminus

SEQ ID No.18: synthetic DNA with acrylamide attached to the 5'-terminus

SEQ ID No.23: synthetic DNA which is labeled with Cy5 at the 5'-terminus

SEQ ID No.24: synthetic DNA which is labeled with Cy3 at the 5'-terminus

SEQ ID No.25: synthetic DNA which is labeled with Cy3 at the 5'-terminus

SEQ ID No.26: synthetic DNA which is labeled with Cy5 at the 5'-terminus

INDUSTRIAL APPLICABILITY OF THE INVENTION

The present invention allows the obtainment of biological substance-immobilized macromolecule materials wherein any biological substance is firmly immobilized at high density. Further, in the present invention, it is possible to readily obtain a large amount of slices having a wide range of nucleic acids immobilized within a small area, because of the following facts: the immobilization process is not carried out on two-dimensional planes but is carried out separately and independently on fibers as a one-dimensional structure, enabling a quantitative immobilization of nucleic acid regardless of the chain length; the introduction of various techniques for fiber shaping and preparing woven materials in the alignment process makes it possible to achieve a higher density; in order to prepare target two-dimensional alignments from the resulting fiber bundle that is in the form of a three-dimensional structure, a slicing process was newly introduced that did not exist in the prior art, thereby eliminating the need for micro-injection operations such as a spotting process that are prone to generate errors, while allowing continuous slicing. Thus, the present invention is useful in the fields of clinical tests and food inspections etc. that use analysis of gene structure or the like.

Also, the present invention provides a process for treating the inner wall part of hollow fibers, a process for filling the hollow part of hollow fibers with gel and a process for preparing fibers filled with gel.

The gel inside the fibers that is filled according to the present invention is resistant to coming out as it is physically fixed to the inner wall part of hollow fibers. The fibers filled with gel, thus prepared, can be used for preparing microarrays or the like for capillary electrophoresis and DNA analysis. In particular, in the capillary electrophoresis, the interfaces of the gel and the inner wall part of the capillary are firmly attached so that there is no short pass in the inner wall parts of migrating solutes such as DNA or the like, allowing the formation of a uniform band.

SEQUENCE LISTING

```
<160> NUMBER OF SEQ ID NOS: 26

<210> SEQ ID NO 1
<211> LENGTH: 33
<212> TYPE: DNA
<213> ORGANISM: ARTIFICIAL SEQUENCE
<220> FEATURE:
<223> OTHER INFORMATION: SYNTHETIC DNA

<400> SEQUENCE: 1

gcgatcgaaa ccttgctgta cgagcgaggg ctc                                33


<210> SEQ ID NO 2
<211> LENGTH: 32
<212> TYPE: DNA
<213> ORGANISM: ARTIFICIAL SEQUENCE
<220> FEATURE:
<223> OTHER INFORMATION: SYNTHETIC DNA

<400> SEQUENCE: 2
```

-continued gatgaggtgg aggtcagggt ttgggacagc ag 32

<210> SEQ ID NO 3
<211> LENGTH: 28
<212> TYPE: DNA
<213> ORGANISM: ARTIFICIAL SEQUENCE
<220> FEATURE:
<223> OTHER INFORMATION: SYNTHETIC DNA

<400> SEQUENCE: 3 gagccctcgc tcgtacagca aggtttcg 28

<210> SEQ ID NO 4
<211> LENGTH: 27
<212> TYPE: DNA
<213> ORGANISM: ARTIFICIAL SEQUENCE
<220> FEATURE:
<223> OTHER INFORMATION: SYNTHETIC DNA

<400> SEQUENCE: 4 ctgctgtccc aaaccctgac ctccacc 27

<210> SEQ ID NO 5
<211> LENGTH: 31
<212> TYPE: DNA
<213> ORGANISM: ARTIFICIAL SEQUENCE
<220> FEATURE:
<223> OTHER INFORMATION: SYNTHETIC DNA

<400> SEQUENCE: 5 gctcaagcgc gatttcggtt tcgacatccc c 31

<210> SEQ ID NO 6
<211> LENGTH: 30
<212> TYPE: DNA
<213> ORGANISM: ARTIFICIAL SEQUENCE
<220> FEATURE:
<223> OTHER INFORMATION: SYNTHETIC DNA

<400> SEQUENCE: 6 catgtcgcgt cgttgttgga cgaagcggta 30

<210> SEQ ID NO 7
<211> LENGTH: 388
<212> TYPE: DNA
<213> ORGANISM: Rhodococcus rhodochrous

<400> SEQUENCE: 7 gcgatcgaaa ccttgctgta cgagcgaggg ctcatcacgc ccgccgcggt cgaccgagtc 60 gtttcgtact acgagaacga gatcggcccg atgggcggtg ccaaggtcgt ggccaagtcc 120 tgggtggacc ctgagtaccg caagtggctc gaagaggacg cgacggccgc gatggcgtca 180 ttgggctatg ccggtgagca ggcacaccaa atttcggcgg tcttcaacga ctcccaaacg 240 catcacgtgg tggtgtgcac tctgtgttcg tgctatccgt ggccggtgct tggtctcccg 300 cccgcctggt acaagagcat ggagtaccgg tcccgagtgg tagcggaccc tcgtggagtg 360 ctcaagcgcg atttcggttt cgacatcc 388

<210> SEQ ID NO 8
<211> LENGTH: 611
<212> TYPE: DNA
<213> ORGANISM: Rhodococcus rhodochrous

<400> SEQUENCE: 8

-continued

```
gatgaggtgg aggtcagggt ttgggacagc agctccgaaa tccgctacat cgtcatcccg     60

gaacggccgg ccggcaccga cggttggtcc gaggaggagc tgacgaagct ggtgagccgg    120

gactcgatga tcggtgtcag taatgcgctc acaccgcagg aagtgatcgt atgagtgaag    180

acacactcac tgatcggctc ccggcgactg ggaccgccgc accgccccgc gacaatggcg    240

agcttgtatt caccgagcct tgggaagcaa cggcattcgg ggtcgccatc gcgctttcgg    300

atcagaagtc gtacgaatgg gagttcttcc gacagcgtct cattcactcc atcgctgagg    360

ccaacggttg cgaggcatac tacgagagct ggacaaaggc gctcgaggcc agcgtggtcg    420

actcggggct gatcagcgaa gatgagatcc gcgagcgcat ggaatcgatg gccatcatcg    480

actgacatcc cctgtgtctc catctagcag cagtgcgggc gtaccccgac ggtgctgagc    540

cgacggggta cgcccgcact tcatcaatga cggtggttcc taatttggct cggtggatac    600

tgatctcgcg g                                                         611
```

<210> SEQ ID NO 9
<211> LENGTH: 388
<212> TYPE: DNA
<213> ORGANISM: Rhodococcus rhodochrous

<400> SEQUENCE: 9

```
ggatgtcgaa accgaaatcg cgcttgagca ctccacgagg gtccgctacc actcgggacc     60

ggtactccat gctcttgtac caggcgggcg ggagaccaag caccggccac ggatagcacg    120

aacacagagt gcacaccacc acgtgatgcg tttgggagtc gttgaagacc gccgaaattt    180

ggtgtgcctg ctcaccggca tagcccaatg acgccatcgc ggccgtcgcg tcctcttcga    240

gccacttgcg gtactcaggg tccacccagg acttggccac gaccttggca ccgcccatcg    300

ggccgatctc gttctcgtag tacgaaacga ctcggtcgac cgcggcgggc gtgatgagcc    360

ctcgctcgta cagcaaggtt tcgatcgc                                       388
```

<210> SEQ ID NO 10
<211> LENGTH: 611
<212> TYPE: DNA
<213> ORGANISM: Rhodococcus rhodochrous

<400> SEQUENCE: 10

```
ccgcgagatc agtatccacc gagccaaatt aggaaccacc gtcattgatg aagtgcgggc     60

gtaccccgtc ggctcagcac cgtcggggta cgcccgcact gctgctagat ggagacacag    120

gggatgtcag tcgatgatgg ccatcgattc catgcgctcg cggatctcat cttcgctgat    180

cagccccgag tcgaccacgc tggcctcgag cgcctttgtc cagctctcgt agtatgcctc    240

gcaaccgttg gcctcagcga tggagtgaat gagacgctgt cggaagaact cccattcgta    300

cgacttctga tccgaaagcg cgatggcgac cccgaatgcc gttgcttccc aaggctcggt    360

gaatacaagc tcgccattgt cgcggggcgg tgcggcggtc ccagtcgccg ggagccgatc    420

agtgagtgtg tcttcactca tacgatcact tcctgcggtg tgagcgcatt actgacaccg    480

atcatcgagt cccggctcac cagcttcgtc agctcctcct cggaccaacc gtcggtgccg    540

gccggccgtt ccgggatgac gatgtagcgg atttcggagc tgctgtccca aaccctgacc    600

tccacctcat c                                                         611
```

<210> SEQ ID NO 11
<211> LENGTH: 651
<212> TYPE: DNA

-continued

<213> ORGANISM: Saccharomyces cerevisiae

<400> SEQUENCE: 11 caaccaacca caactacata cacatacata cacaatggtc gctcaagttc aaaagcaagc 60 tccaactttt aagaaaactg ccgtcgtcga cggtgtcttt gacgaagtct ccttggacaa 120 atacaagggt aagtacgttg tcctagcctt tattccattg gccttcactt tcgtctgtcc 180 aaccgaaatc attgctttct cagaagctgc taagaaattc gaagaacaag gcgctcaagt 240 tcttttcgcc tccactgact ccgaatactc ccttttggca tggaccaata tcccaagaaa 300 ggaaggtggt ttgggcccaa tcaacattcc attgttggct gacaccaacc actctttgtc 360 cagagactat ggtgtcttga tcgaagaaga aggtgtcgcc ttgagaggtt tgttcatcat 420 cgacccaaag ggtgtcatta gacacatcac cattaacgat ttgccagtcg gtagaaacgt 480 tgacgaagcc ttgagattgg ttgaagcctt ccaatggacc gacaagaacg gtactgtctt 540 gccatgtaac tggactccag gtgctgctac catcaagcca accgttgaag actccaagga 600 atacttcgaa gctgccaaca aataagacgc ttgcagagtt gtctaaatga c 651

<210> SEQ ID NO 12
<211> LENGTH: 586
<212> TYPE: DNA
<213> ORGANISM: Saccharomyces cerevisiae

<400> SEQUENCE: 12 caaagcatac ctaataacaa tataatccca taatgctagc cctagctgat aacattctac 60 gtataataaa tttcctattt ttggttattt ccatcggttt aatcagttcg ttgttaaaca 120 cccaacatag gcacagctcc agagtaaact actgtatgtt tgcttgtgca tatggtatat 180 tcaccgattc attgtacggt gtctttgcca acttcattga accattggca tggccactag 240 ttttgttcac actggacttt ttgaactttg tgttcacttt cactgccggt acagtgttgg 300 ccgttggtat cagagctcac tcatgtaaca acagctcata cgttgacagt aacaagatta 360 ctcaaggttc cggtaccaga tgtagacaag ctcaagccgc tgttgcattc ctctacttct 420 cttgtgccat ctttttggct aagaccctga tgtctgtttt caacatgatc tccaatggtg 480 cctttggttc tggttctttc tccaagagaa gaagaactgg ccaagtcggt gttccaacca 540 tttcccaagt ctaattgaag cgcaccaact taaattttac gccact 586

<210> SEQ ID NO 13
<211> LENGTH: 1105
<212> TYPE: DNA
<213> ORGANISM: Saccharomyces cerevisiae

<400> SEQUENCE: 13 aagaaacatc cctcatacta ccacacatat gccaactcta gtaaatggac caagaagaga 60 ctctaccgaa gggtttgata ccgatatcat cactcttcct agattcataa tcgagcacca 120 gaagcaattt aagaacgcta ctggtgattt cacattagta ctgaatgcct tgcaattcgc 180 gttcaaattt gtatctcaca ccatcagacg tgctgaattg gttaacttgg ttgggttagc 240 aggcgcttcc aacttcactg gtgaccagca aaagaagttg gacgttctag gtgatgaaat 300 atttatcaat gccatgaggg ctagtgggat catcaaggtc cttgtatctg aagaacagga 360 agacttgatc gtttttccca caaacacggg ctcatacgca gtgtgttgtg atcctattga 420 tggctcctca aatttggacg ccggtgtctc cgttggaact atcgcgtcta tattcagact 480 gctaccagac tcatcaggta ctataaacga cgtactgaga tgtggtaaag aaatggtagc 540

-continued

```
cgcttgctat gccatgtacg gatcctctac gcatctagta ttgacattgg gtgatggagt    600

tgatgggttt accttagaca caaacttggg cgaattcatc ttgactcatc ctaacttaag    660

aattccgcct caaaaggcca tctactcaat taatgaaggt aacaccctct actggaacga    720

gactataaga acatttattg agaaagtcaa acaaccccaa gcagacaaca acaacaagcc    780

tttctcggct aggtatgttg gatccatggt tgctgatgtt cacaggacgt ttctttacgg    840

tggccttttc gcataccctt gcgacaagaa gagccccaac ggaaaactga ggttgcttta    900

tgaggccttc ccaatggctt tcttaatgga acaagcaggg ggaaaagcgg tcaacgatcg    960

cggagagaga atcttggatt tggtgccaag tcatatccat gacaaatctt ctatttggtt   1020

gggttcttca ggtgaaattg acaaattttt agaccatatt ggcaagtcac agtagttcaa   1080

tgatcgcctt cttttcttat tttct                                         1105
```

<210> SEQ ID NO 14
<211> LENGTH: 670
<212> TYPE: DNA
<213> ORGANISM: Saccharomyces cerevisiae

<400> SEQUENCE: 14

```
ctaagaaaac cacgatcaaa caaataaatc agcaatgggt gcctacaaat atttggaaga     60

attgcaaaga aagaagcaat ctgatgtttt gagattcttg caaagagtca gagtctggga    120

atacagacaa aagaatgtca ttcacagagc cgctagacca actagaccag acaaggctag    180

aagattgggt tacaaagcta agcaaggttt cgttatctac cgtgtcagag ttagacgtgg    240

taacagaaag agacctgttc caaagggtgc tacttacggt aagccaacta accaaggtgt    300

caatgaattg aaataccaaa gatccttgag agctaccgct gaagaaagag ttggtcgtcg    360

tgccgctaac ttgagagtct tgaactccta ctgggttaac caagattcta cttacaagta    420

cttcgaagtt atcttggtcg accctcaaca caaggctatc agaagagatg ctcgttacaa    480

ctggatctgt gacccagttc acaagcaccg tgaagctaga ggtttgactg ccactggtaa    540

gaaatccaga ggtatcaaca agggtcacaa attcaacaac accaaggctg gtagaagaaa    600

gacctggaag agacaaaaca ctttgtcctt gtggagatac agaaaataag ctggttgatg    660

gaaaatataa                                                           670
```

<210> SEQ ID NO 15
<211> LENGTH: 27
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = c having 5' linkage to acrylamide

<400> SEQUENCE: 15

```
naaccaacca caactacata cacatac                                         27
```

<210> SEQ ID NO 16
<211> LENGTH: 21
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = c having 5' linkage to acrylamide -continued

<400> SEQUENCE: 16 ntaagaaaac cacgatcaaa c 21

<210> SEQ ID NO 17
<211> LENGTH: 26
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = a having 5' linkage to acrylamide

<400> SEQUENCE: 17 nagaaacatc cctcatacta ccacac 26

<210> SEQ ID NO 18
<211> LENGTH: 21
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = c having 5' linkage to acrylamide

<400> SEQUENCE: 18 ntaagaaaac cacgatcaaa c 21

<210> SEQ ID NO 19
<211> LENGTH: 25
<212> TYPE: DNA
<213> ORGANISM: ARTIFICIAL SEQUENCE
<220> FEATURE:
<223> OTHER INFORMATION: SYNTHETIC DNA

<400> SEQUENCE: 19 gtcatttaga caactctgca agcgt 25

<210> SEQ ID NO 20
<211> LENGTH: 21
<212> TYPE: DNA
<213> ORGANISM: ARTIFICIAL SEQUENCE
<220> FEATURE:
<223> OTHER INFORMATION: SYNTHETIC DNA

<400> SEQUENCE: 20 ttatattttc catcaaccag c 21

<210> SEQ ID NO 21
<211> LENGTH: 25
<212> TYPE: DNA
<213> ORGANISM: ARTIFICIAL SEQUENCE
<220> FEATURE:
<223> OTHER INFORMATION: SYNTHETIC DNA

<400> SEQUENCE: 21 agaaaataag aaaagaaggc gatca 25

<210> SEQ ID NO 22
<211> LENGTH: 21
<212> TYPE: DNA
<213> ORGANISM: ARTIFICIAL SEQUENCE
<220> FEATURE:
<223> OTHER INFORMATION: SYNTHETIC DNA

<400> SEQUENCE: 22

-continued

```
ttatattttc catcaaccag c                                                21


<210> SEQ ID NO 23
<211> LENGTH: 40
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = g having 5' linkage to Cy5

<400> SEQUENCE: 23

naacttgagc gaccattgtg tatgtatgtg tatgtagttg                           40


<210> SEQ ID NO 24
<211> LENGTH: 40
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = a having 5' linkage to Cy5

<400> SEQUENCE: 24

ntcagctagg gctagcatta tgggattata ttgttattag                           40


<210> SEQ ID NO 25
<211> LENGTH: 40
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = g having 5' linkage Cys

<400> SEQUENCE: 25

ntccatttac tagagttggc atatgtgtgg tagtatgagg                           40


<210> SEQ ID NO 26
<211> LENGTH: 40
<212> TYPE: DNA
<213> ORGANISM: ARTIFICIAL SEQUENCE
<220> FEATURE:
<223> OTHER INFORMATION: SYNTHETIC DNA
<221> NAME/KEY: misc_feature
<222> LOCATION: (1)..(1)
<223> OTHER INFORMATION: n = a having 5' linkage to Cy5

<400> SEQUENCE: 26

ntttgtaggc acccattgct gatttatttg tttgatcgtg                           40
```

What is claimed is:

1. A method for determining the two-dimensional coordinates of sequential cross-sectional slices of a fiber bundle which may be used to form a chip or a micro-array comprising:

(a) producing a series of sequential cross-sectional slices of a bundle of adhered linearly-aligned fibers, wherein each sequential slice comprises multiple fiber units that are bound or immobilized to each other, and each bound or immobilized fiber unit is produced by the cross-sectional slicing of the individual fibers in the bundle, wherein said fiber bundle comprises fibers containing one or more immobilized biological substance(s) and at least two coordinate reference points, (b) determining the two-dimensional coordinates of each fiber unit within a fiber alignment slice S(h) using the coordinates of the fiber units formed by said two or more coordinate reference points;

(c) determining the two-dimensional coordinates of each fiber unit corresponding to those in fiber alignment slice S(h) which are in an adjacent or sequential fiber alignment slice S(i) of said fiber bundle, based on the coordinate data obtained for fiber alignment slice S(h)

in step (b) and based on the positions of the coordinate reference points in the adjacent or sequential fiber alignment slice; and (d) repeating steps (b) and (c) to determine the two-dimensional coordinates of fiber units in one or more successive or adjacent fiber alignment slices of said fiber bundle.

2. The method of claim 1, wherein, in step (b), the two-dimensional coordinates of each fiber unit in slice S(h) are first determined relative to an XY plane, and the resulting values are then translated into a coordinate system based on the coordinate reference points in said slice S(h), to form translated coordinates for each fiber in slice S(h).

3. The method of claim 1, wherein said fibers are selected from the group consisting of hollow fibers incorporating an immobilized biological substance, porous fibers incorporating an immobilized biological substance, and porous hollow fibers incorporating an immobilized biological substance, wherein the biological substance is directly immobilized on the fiber, in the fiber, or both on and in the fiber.

4. The method of claim 1, wherein said fibers are fibers retaining a gel which incorporates one or more immobilized biological substance(s), whereby the biological substance is immobilized on the fiber, in the fiber, or both on and in the fiber.

5. The method of claim 2, wherein, in step (c), the two-dimensional coordinates of each fiber unit in slice S(i) are first determined relative to an XY plane, using the corresponding translated coordinates for each fiber in slice S(h), and the resulting values are then translated into a coordinate system based on the coordinate reference points in said slice S(i).

6. The method of claim 3, wherein the one or more biological substance(s) is one selected from a group consisting of:

(a) nucleic acid, amino acid, sugar or lipid;

(b) a polymer consisting of one or more kinds of ingredients from the substances stated in (a) above; and (c) a substance interacting with substances stated in (a) or (b) above.

7. The method of claim 4, wherein said fibers are selected from the group consisting of solid fibers, hollow fibers, porous fibers and hollow porous fibers.

8. The method of claim 6, wherein the one or more biological substance(s) is nucleic acid.

9. The method of claim 4, wherein said fibers also have a pigment retained on the fiber, in the fiber or both on and in the fiber, by means of the gel.

10. The method of claim 4, wherein said fiber bundles contain 100 or more individual fibers.

11. The method of claim 4, wherein said fiber bundles contain 1000 to 10,000,000 individual fibers.

12. The method of claim 4, wherein said fiber bundles have a fiber density ranging from 100 to 1,000,000 fibers per $cm^2$.

13. The method of claim 4, wherein the thickness of the fibers is 1 mm or less.

14. The method of claim 5, wherein the coordinate reference points correspond to chosen fiber units in said bundle.

15. The method of claim 5, wherein the coordinate reference points correspond to lines drawn on the side(s) of the fiber alignment.

16. The method of claim 5, wherein the coordinate reference points correspond to slots on the side(s) of the fiber alignments.

17. The method of claim 5, wherein said bundle contains 2 coordinate reference points per 1,000 fiber units.

18. The method of claim 7, wherein said fibers are solid fibers, and wherein the gel incorporating an immobilized biological substance is retained on a surface of the fibers.

19. The method of claim 7, wherein said fibers are hollow fibers, and wherein the gel incorporating an immobilized biological substance is retained in a hollow part of the fibers.

20. The method of claim 7, wherein said fibers are porous fibers, and wherein the gel incorporating an immobilized biological substance is retained in the pore(s) of the fibers.

21. The method of claim 7, wherein said fibers are porous hollow fibers, and wherein the gel incorporating an immobilized biological substance is retained in a hollow part and the pore(s) of the fibers.

22. The method of claim 4, wherein the one or more biological substance(s) is selected from a group consisting of:

(a) nucleic acid, amino acid, sugar or lipid;

(b) a polymer consisting of one or more kinds of ingredients from the substances stated in (a) above; and (c) a substance interacting with substances stated in (a) or (b) above.

23. The method of claim 22, wherein the biological substance is nucleic acid.

24. A method for determining the two-dimensional coordinates of sequential cross-sectional slices of a fiber bundle which may be used to form a chip or a micro-array comprising:

(a) producing a series of sequential cross-sectional slices of a bundle of adhered linearly-aligned fibers, wherein each sequential slice comprises multiple fiber units that are bound or immobilized to each other, and each bound or immobilized fiber unit is produced by the cross-sectional slicing of the individual fibers in the bundle, wherein said fiber bundle comprises fibers containing one or more immobilized biological substance(s), and the bundle contains two or more coordinate reference points;

(b) determining the two-dimensional coordinates of each fiber unit within a fiber alignment slice S(h) using the coordinate reference points;

(c) determining the two-dimensional coordinates of each fiber unit corresponding to those in fiber alignment slice S(h) which are in an adjacent or sequential fiber alignment slice S(i) of said fiber bundle, based on the coordinate data obtained for fiber alignment slice S(h) in step (b) and based on the positions of the coordinate reference points in the adjacent or sequential fiber alignment slice; and (d) repeating steps (b) and (c) to determine the two-dimensional coordinates of fiber units in one or more successive or adjacent fiber alignment slices of said fiber bundle.

* * * * *